US005415142A

United States Patent [19]

Tsubakiji et al.

[11] Patent Number: 5,415,142

[45] Date of Patent: May 16, 1995

[54] CONTROL METHOD AND APPARATUS FOR INTERNAL COMBUSTION ENGINE

[75] Inventors: Tadashi Tsubakiji; Yukinobu Nishimura; Nobutake Taniguchi, all of Himeji, Japan

[73] Assignee: Mitsubishi Denki Kabushiki Kaisha, Tokyo, Japan

[21] Appl. No.: 200,701

[22] Filed: Feb. 23, 1994

[30] Foreign Application Priority Data

| | | | |
|---|---|---|---|
| Feb. 23, 1993 | [JP] | Japan | 5-033590 |
| Mar. 10, 1993 | [JP] | Japan | 5-049243 |
| Mar. 11, 1993 | [JP] | Japan | 5-051009 |

[51] Int. Cl.[6] ..... F02D 9/00

[52] U.S. Cl. ..... 123/336

[58] Field of Search ..... 123/336, 399, 337, 319, 123/328; 74/865, 866, 867; 417/107, 906, 907

[56] References Cited

U.S. PATENT DOCUMENTS

| | | | |
|---|---|---|---|
| 4,424,785 | 1/1984 | Ishida et al. | 123/399 |
| 4,796,579 | 1/1989 | Wolfe et al. | 123/399 |
| 4,892,071 | 1/1990 | Asayama | 123/399 |
| 5,366,424 | 11/1994 | Wataya | 123/336 |

FOREIGN PATENT DOCUMENTS

| | | | |
|---|---|---|---|
| 61-8441 | 1/1986 | Japan | 123/336 |
| 294630 | 12/1991 | Japan | 123/336 |
| 294636 | 12/1991 | Japan | 123/336 |

*Primary Examiner*—Raymond A. Nelli

*Attorney, Agent, or Firm*—Sughrue, Mion, Zinn, Macpeak and Seas

[57] ABSTRACT

An apparatus for controlling air supply to an internal combustion engine comprises a main intake pipe for supplying air to the engine, a throttle valve disposed in the main intake pipe for controlling flow rate of the air supplied to the engine in dependence on depression of an accelerator pedal, a plurality of bypass passages disposed in parallel with the main intake pipe for allowing the air to be supplied to the engine by bypassing the throttle valve, a plurality of bypass valves installed in the plurality of bypass passages, respectively, a diagnosis means for diagnosing the throttle valve and devices associated therewith as to occurrence of abnormality, and a controller responsive to detection of the abnormality to close the throttle valve while allowing the bypass valves to control the intake air flow in dependence on depression of the accelerator pedal. The controller responds to detection of the abnormality for shifting a range of engine operation from a normal operation range. Besides, upon occurrence of abnormality in the throttle valve and the associated devices, the controller converts the opening degree of the bypass valves determined arithmetically on the basis of a driving force required for driving the bypass valves into a corresponding opening degree of the throttle valve, and controls the speed of the motor vehicle and a fuel supply to the engine on the basis of the converted opening degree. A limp-homing operation of the motor vehicle can be ensured.

42 Claims, 29 Drawing Sheets

D2 : PREDETERMINED VALUE

D3 : PREDETERMINED VALUE

CONTROL METHOD AND APPARATUS FOR INTERNAL COMBUSTION ENGINE

BACKGROUND OF THE INVENTION

1. Field of the Invention

The present invention generally relates to a control apparatus for an internal combustion engine of an automobile or motor vehicle in which a bypass intake air passage is provided in parallel with a main intake pipe for affecting the idling operation of the engine. More particularly, the invention is concerned with a control apparatus which can positively assure a limp-homing operation (or backup operation) for driving a motor vehicle to a service station or the like place even when abnormality occurs in a main intake air flow control means provided in association with the main intake pipe. Further, the invention is concerned with a method and apparatus for ensuring controllability of engine speed as well as fuel injection and an automatic transmission even in the trouble-suffering state where the motor vehicle has to be driven by resorting to the limp-homing or backup function.

2. Description of the Related Art

In general, in the intake air control system for an internal combustion engine (hereinafter also referred to simply as the engine) of a motor vehicle, opening degree of a throttle valve disposed in an intake pipe (main intake air flow passage) is controlled via a wire-linkage which mechanically interconnects the throttle valve and an accelerator pedal to each other. Further, in an idling operation of the engine in which the main throttle valve is positioned to the fully closed state, the intake air flow is controlled by means of a bypass throttle valve installed in a bypass passage connected in parallel to the main intake pipe.

In recent years, however, there have been developed and increasingly adopted in practical applications the systems for electrically controlling the main throttle valve installed in the main intake pipe as well as the bypass throttle valve disposed in the bypass passage in an attempt to realize various functions in connection with operation of the motor vehicle, as is disclosed in, for example, Japanese Unexamined Patent Applications Nos. 294636/1991 (JP-A-H3294636) and 294630/1991 (JP-A-H3-294630).

For having better understanding of the present invention, it will he necessary to elucidate in some detail the background techniques as well as problems from which the control apparatuses known heretofore suffer.

FIG. 25 is a block diagram showing schematically a general arrangement of an engine air suction control apparatus known heretofore, wherein a traction control such as slip suppression is realized by controlling one of throttle devices disposed in series to each other.

Referring to FIG. 1, a main air flow passage (intake pipe) 1 for supplying air to an engine (not shown) as indicated by an arrow A is provided with a first air flow control means (hereinafter also referred to as the first throttle device) 11, the opening degree of which is controlled in dependence on extent or magnitude of actuation (depression stroke) of an accelerator pedal 4 in a manner described hereinafter and a second main air flow control means (hereinafter also referred to as the second throttle device) 12 which is installed in the main air flow passage (intake pipe) 1 in series to the first throttle device 11 at a position downstream thereof.

A bypass air flow passage 2 is connected in parallel to the main air flow passage 1 so that the air flow Gan bypass the first throttle device 11 and the second throttle device 12 through the bypass passage 2, wherein a bypass air flow control means (hereinafter also referred to the bypass throttle device) 21 is installed in the bypass passage 2 for the purpose of controlling rotation speed of the engine in an idling operation mode. Provided in association with the first throttle device 11 is a throttle position sensor 3 which serves for detecting an opening degree $\frac{1}{4}$ of the throttle valve constituting a major part of the first throttle device 11.

Further, an accelerator pedal depression stroke sensor 5 is provided in association with the accelerator pedal 4 for detecting the depression depth or stroke of the accelerator pedal 4. An air conditioner 6 is shown as constituting an engine load, by way of example.

A control unit 7 which is in charge of overall control of the engine system outlined above and which may be constituted by an electronic information processor or microcomputer has inputs supplied with a variety of signals indicating the engine operation states inclusive of a signal D indicative of the depression stroke of the accelerator pedal 4. The control unit 7 serves to control the opening degree of the first throttle device 11 in dependence on the depression stroke or depth D of the accelerator pedal 4 in the normal operation mode of the engine. The opening degree 8 of the first throttle device 11 is detected by a throttle position sensor 3 to be fed back to the control unit 7. On the other hand, in the idling or bypass operation mode, the control unit 7 controls the bypass throttle device 21 so that the throttle valve thereof is set to a position corresponding to a desired value of the opening degree. Besides, the control unit 7 is in charge of control of various engine loads, one of which is represented by the air conditioner 6.

Although not shown in FIG. 25, the control unit 7 incorporates therein a traction control module or means for reducing the engine output torque in order to prevent slippage of the motor vehicle upon starting operation thereof by closing the throttle valve of the second throttle device 12. Additionally, the control unit 7 incorporates a diagnosis module or means (not shown) for diagnosing the first throttle device 11 as to occurrence of trouble or abnormality therein. If occurrence of abnormality in the first throttle device 11 is decided by the diagnosis means, the second throttle device 12 is so controlled as to close the associated throttle valve.

FIG. 26 is a block diagram showing in more concrete a structure of a major part of the engine system shown in FIG. 1 partially in section. In FIG. 26, reference numerals 1 to 7, 11, 12 and 21 denote parts same as or equivalent to those designated by like reference numerals in FIG. 25, respectively.

Referring to FIG. 26, the first throttle device 11 installed in the main air flow passage 1 is comprised of a throttle valve **11*a* and an actuator, e.g. an electric motor 11*b* for operating the throttle valve 11*a*. Similarly, the second throttle device 12 includes a throttle valve 12*a* and an actuator, e.g. an electric motor 12*b* for operating the throttle valve 12*a***.

On the other hand, the bypass throttle device 21 is comprised of a linear solenoid valve **21*a* and an electromagnetic actuator 21*b* for driving the valve 21*a*. The electromagnetic actuator 21*b* is adapted to be periodically excited by the control unit 7 for holding stationarily the linear solenoid valve 21*a*** at a given position.

An air cleaner 13 is mounted at the entrance of the main air flow passage (main intake pipe) 1. Further, an air flow sensor 14 is installed in the main air flow passage 1 at a position downstream of the air cleaner 13 for detecting an intake air flow rate B. Provided in association with the first throttle device 11 is an idle switch 15 for detecting the fully closed state of the throttle valve 11*a* of the first throttle device 11. Further, installed in the main air flow passage 1 at a position downstream of the second throttle device 12 is a fuel injector 16 for injecting a fuel into the main air flow passage 1. An intake manifold 17 is formed in fluidal communication with the main air flow passage 1 at a location downstream of the fuel injector 16 for accommodating therein the air-fuel mixture which is supplied to cylinders (only one cylinder 18 is shown) of the engine. A water temperature sensor 19 is installed in association with the engine cylinder for detecting the temperature T of cooling water W for the cylinder 18 (or radiator thereof).

The air flow rate signal B generated by the air flow sensor 14, the fully closed throttle signal outputted from the idle switch 15 and the temperature signal T from the water temperature sensor 19 are inputted to the control unit 7 similarly to the signals indicating other engine operation state parameters (not shown).

In the foregoing description made by reference to FIGS. 25 and 26, it has been assumed that the first throttle valve 11*a* is controlled by the electromagnetic actuator 11*b*. It should however be understood that the first throttle valve 11*a* may be controlled straightforwardly by the accelerator pedal 4 through a linkage means. FIG. 27 shows schematically another exemplary structure of the first throttle device 11 and that of the second throttle device 12, wherein the throttle valve 11*a* and the accelerator pedal 4 are directly linked to each other by means of a wire 11*c*, while the second throttle valve 12*a* is adapted to be controlled by an electric motor. For more details of the illustrated structure of the first throttle device 11 and the second throttle device 12 shown in FIG. 27, reference should be made to, for example, Japanese Unexamined Patent Application Publication No. 294636/1991 (JP-A-H3-294636).

In the case of the engine system shown in FIGS. 25 and 26, the main air flow control means is constituted by the first throttle device 11 and the second throttle device 12 disposed in series to each other. However, the main air flow control means may be implemented by a single electrically driven throttle device 11, as shown in FIG. 28. More specifically, referring to FIG. 28, a throttle valve 11*a* adapted to be driven by an electric motor 11*b* is continuously controlled so as to serve for the function of the second throttle device 12 shown in FIG. 27 as well. Thus, the second throttle device 12 can be spared. The structure of this throttle device 11 is disclosed in detail, for example, in JP-A-H3-294630.

FIGS. 29A and 29B are characteristic diagrams illustrating relations between a desired or target throttle opening degree $\theta_0$ and the depression depth or stroke D of the accelerator pedal in the form of functions $F_1(D)$. More specifically, FIG. 29A shows a non-linear relation in which the target throttle opening degree $\theta_0$ is so set that it increases more steeply within a predetermined range of the accelerator pedal stroke D which is set close to the upper limit thereof, while FIG. 29B shows a relation in which the target throttle opening degree $\theta_0$ is set essentially as a linear function of the accelerator pedal stroke D.

Next, referring to FIGS. 25 to 29A and 29B, description will turn to operation of the conventional engine intake air control apparatus of the structure described above. The throttle valve 12*a* of the second throttle device 12 driven under the control of the control unit 7 is susceptible to the control only in the closing direction and ordinarily remains in the open state. Referring to FIGS. 25 to 27, the intake air flow rate B and hence the engine rotation speed (rpm) as well as the engine output torque are controlled in dependence on the throttle opening degree $\theta$ of the throttle valve 11*a* of the first throttle device 11.

Upon activation of traction control, the control unit 7 suppresses the engine output torque by decreasing the intake air flow rate B in order to prevent the driving wheels of the motor vehicle from slippage. By way of example, upon starting of the motor vehicle, the second throttle device 12 is controlled so that the throttle valve 12*a* is closed to thereby reduce the flow rate B of the intake air A (and thus the engine output torque) in order to prevent the slippage of tires of the wheels. This control is referred to as the traction control.

In the ordinary running state of the motor vehicle, the control unit 7 determines the desired or target value $\theta_0$ of the throttle opening degree $\theta$of the throttle valve 11*a* in dependence on the accelerator pedal depression stroke D in accordance with the relation illustrated in FIG. 29A or 29B to thereby control the electric motor 11*b* so that the throttle opening degree signal $\theta$ derived from the output of the throttle position sensor 3 coincides with the target value $\theta_0$. At that time, the throttle valve 12*a* of the second throttle device 12 is maintained in the open state.

The relation between the target throttle opening degree $\theta_0$ and the accelerator pedal depression stroke D illustrated in FIG. 29B applies valid to the control in the case where the throttle valve 11*a* is mechanically coupled to the accelerator pedal 4, while in the case of the control corresponding to the relation illustrated in FIG. 29A, drivability of the motor vehicle can be changed or modified as desired.

The control unit 7 arithmetically determines or calculates the amount of fuel to be injected to the engine on the basis of the intake air flow rate B measured by the air flow sensor 14 and the engine speed (rpm), whereon the amount of fuel as calculated is corrected by taking into account the other operation parameters to thereby generate a signal indicative of the optimal amount of fuel injection for controlling the operation of the fuel injector 16 correspondingly.

In this manner, a demanded amount of the intake air A is fed to the engine through the main air flow passage 1 via the first throttle device 11 which is controlled by the electric motor 11*b* so as to provide the desired opening degree $\theta$ and the second throttle device 12 whose throttle valve 12*a* is constantly maintained in the open state. The injector 16 charges an amount of fuel which corresponds to the intake air flow B at a predetermined timing to produce an air-fuel mixture which is then charged to the engine cylinder 18 and undergoes explosive combustion at a predetermined ignition timing. Ultimately, the engine generates an output torque which corresponds to the depression stroke D of the accelerator pedal 4 (and thus corresponds to the intake air flow rate B).

In a steady running state of the motor vehicle at a high engine rotation speed (rpm), the control unit 7-holds the throttle valve 12*a* of the second throttle device 12 in the open state so long as the first throttle device 11 operates normally, while controlling constantly the flow rate B of the intake air A flowing through the main air flow passage 1 by the first throttle valve in dependence on the accelerator pedal depression stroke D.

Further, in the idling operation in which the throttle valve 11*a* is fully closed, the control unit 7 triggers the idling engine speed control at a low speed in response to the signal generated by the idle switch 15 when the throttle valve 11*a* is fully closed or in response to disappearance of the signal D indicating the actuation of the accelerator. More specifically, the control unit 7 controls the linear solenoid valve 21*a* of the bypass throttle device 21 (FIG. 26) to thereby maintain the engine rotation speed (rpm) at a target value (e.g. 700 rpm) for the idling operation.

On the other hand, in the steady operation state, the diagnosis means incorporated in the control unit 7 checks the signal indicative of the throttle opening degree $\theta$ of the throttle valve 11*a* as fed back from the throttle position sensor 3 and decides that the first throttle device 11 operates normally so long as a demanded opening degree thereof is detected for the effective depression stroke D of the accelerator pedal 4. If otherwise, the diagnosis means decides that the first throttle device 11 suffers abnormality. Further, occurrence of abnormality may be decided when the throttle opening degree 8 does not vary even when the electric motor 11*b* is electrically energized.

When abnormality of the first throttle device 11 is decided, the control unit 7 closes the throttle valve 12*a* of the second throttle device 12 to thereby stop the engine in order to prevent occurrence of unwanted situation such as overrun of the motor vehicle.

Needless to say, when the second throttle device 12 falls in a fault in the fully closed state, the engine operation is forced to stop.

In the intake system where only one throttle valve 11*a* is employed, as is illustrated in FIG. 28, the throttle valve 11*a* regulates the flow rate B of the intake air A under the control of the control unit 7 by the motor 11*b*. However, upon occurrence of a fault in the throttle valve 11*a*, the engine will be stopped when the fault takes place in the fully closed state of the throttle valve 11*a*, while the engine may overrun when the fault occurs in the fully opened state of the throttle valve 11*a*.

For the reason mentioned above, the diagnosis means of the control unit 7 decides that the throttle valve 11*a* suffers abnormality when the demanded intake air flow rate B corresponding to the depression stroke D of the accelerator pedal 4 is not detected, whereby the throttle valve 11*a* is forcively closed, which of course results in that the engine is forcively stopped.

As is apparent from the foregoing description, occurrence of abnormality in the first throttle device 11 necessarily leads to the stoppage of the engine. In other words, it is impossible to ensure a minimum running capability (i.e., a so-called limp-homing or backup operation) which allows the driver to run the motor vehicle in any way to a destination such as a service factory or the like place.

At this juncture, it should be mentioned that the bypass throttle device 21 shown in FIG. 26 is not in the position to allow the engine to generate an output torque of magnitude enough to ensure the limp-homing or backup function because the air flow fed through the bypass throttle device 21 is excessively small. At any rate, it is impossible to drive the motor vehicle by controlling the intake air through the bypass throttle device 21 in the control apparatus described above by reference to FIGS. 25 to 29.

Besides, it is to be added that imparting of such air flow rate control capability to the bypass throttle device 21 as to allow the motor vehicle to be driven is undesirable from the practical standpoint in view of the possibility of overrun of the motor vehicle upon occurrence of a fault in the bypass throttle device 21 in the fully opened state thereof. Of course, an additional intake air control means may be resorted to for ensuring the limp-homing (backup) operation mode, which will however involve very high expensiveness, to a disadvantage from the economical standpoint.

As is now apparent, the engine intake air control apparatus known heretofore in which only one bypass passage 2 is provided in parallel to the main air flow passage 1 and in which the air flow susceptible to the control of the bypass throttle device 21 installed in the bypass passage 2 is set to the flow rate for the idling operation is incapable of realizing the above-mentioned limp-homing (backup) function when a fault takes place in the main air flow control means 11 or 12 installed in association with the main air flow passage (intake pipe) 1.

It is also known from, for example, Japanese Unexamined Patent Application Publication No. 8441/1986 (JP-A-61-8441) to regulate or control the intake air flow fed to the engine by means of a throttle valve installed in the intake pipe, wherein the throttle valve is so controlled as to be set to the fully closed state when abnormality is detected in the devices provided in associated with the throttle valve, while allowing the intake air flow to be adjusted by means of an auxiliary control system which is adapted to control the intake air flowing through a bypass passage so that the motor vehicle can be operated notwithstanding of occurrence of the abnormality mentioned above.

FIG. 30 shows a structure of the control apparatus adapted for controlling the intake air flow of an engine, which is disclosed in the publication mentioned above.

Referring to FIG. 30, the control apparatus includes a main control system, an auxiliary control system and an abnormality detecting system.

The main control system is comprised of an accelerator pedal depression stroke sensor 102 for detecting the depression stroke (i.e., magnitude of actuation) of an accelerator pedal 101, a main throttle valve 110 disposed in an intake pipe 115 which leads to the engine, a throttle position sensor 108 for detecting the position (opening degree) of the main throttle valve 110, a control signal generating means 111 for arithmetically determining or calculating a quantity for driving the main throttle valve 110 on the basis of the accelerator pedal depression stroke detected by the accelerator pedal depression stroke sensor 102 and an actual throttle valve position detected by the throttle position sensor 108, and a main throttle valve driving device 106 for driving the main throttle valve 110 in response to a signal indicative of the quantity for driving the main throttle valve 110 as calculated by the control signal generating means 111.

The abnormality detecting system includes an abnormality detecting means for detecting the occurrence of abnormality in the main air flow control means and/or the devices provided in association therewith.

The occurrence of abnormality in the main air flow control means as well as the devices associated therewith may be determined by deciding, for example, whether difference between a desired or target opening degree of the main throttle valve 110 and an actual opening degree thereof exceeds a predetermined value, or whether the detected value of the throttle position sensor 108 is deviated from a predetermined upper or lower limit value, or whether a detected value of the position of the main throttle Valve 110 is abnormal by comparing signals outputted by a plurality of the throttle position sensors 108 when provided, or whether an estimated value of the throttle valve opening degree as determined on the basis of signals outputted from an intake air flow sensor (not shown) and an engine speed (rpm) sensor 103 instead of the output signal from the throttle position sensor 108 indicates abnormality, or whether the throttle valve opening degree remain unchanged notwithstanding of change in the control signal generated by the control signal generating means 111, or whether breakage or short-circuit occurs in the electrical connection for the main throttle valve driving device 106.

When abnormality is detected by the abnormality detecting means 112 as a result of execution of any one of the abnormality detecting procedures enumerated above, a throttle valve closing means 107 is activated to thereby set the throttle valve 110 to the fully closed state.

On the other hand, the auxiliary control system is comprised of the accelerator pedal depression stroke sensor 102, a bypass throttle valve device 109 disposed in an bypass passage 116 for allowing the intake air to flow by bypassing the main throttle valve 110, a bypass throttle valve control means 113 for calculating the quantity for driving the bypass throttle valve 109 in dependence on the depression stroke of the accelerator pedal 101 detected by the accelerator pedal depression stroke sensor 102, and a bypass throttle valve driving means 114 for driving the bypass throttle valve means 109 in response to reception of the control signal from the bypass throttle valve control means 113.

Parenthetically, the control signal generating means 111, the abnormality detecting means 112 and the bypass throttle valve control means 113 are incorporated in the form of modules in a signal processing unit 105 (engine controller) which may be realized by using a microcomputer.

It should further be mentioned that the bypass throttle valve means can be used as an intake air flow control means in an idling operation mode of the engine. In that case, the bypass throttle valve control means 113 is supplied with the engine speed (rpm) signal derived from the output of the engine speed sensor 103 and a signal derived from the output of an engine load sensor 104 typified by the signal indicative of operating state of an air conditioner, to thereby effect the idling speed control on the basis of these detected quantities.

Next, description will be made of operation of the control apparatus by reference to FIG. 31.

First, in a step S101, an accelerator pedal depression stroke is detected by the accelerator pedal depression stroke sensor 102 to thereby calculate or arithmetically determine a target throttle opening degree on the basis of the output from the accelerator pedal depression stroke sensor 102.

In a step S102, an actual opening degree of the main throttle valve 110 is detected by the throttle position sensor 108 which constitutes a part of the main control system.

When abnormality is found in the detection of the throttle valve position as effected in the step S102, the abnormality is detected by the abnormality detecting means 112 in a step S103, which is then followed by the execution of a step S107 in which the main throttle valve 110 is fully closed by the throttle valve closing means 107 to thereby inhibit the intake air flow control of the main control system. At the same time, the intake air flow control is transferred to the auxiliary control system in a step S108 where the opening degree of the bypass throttle valve 109 is controlled or regulated on the basis of the output of the accelerator pedal depression stroke sensor 102 to thereby guarantee at least the minimum capability of driving the motor vehicle to a service station or home even in the state where the vehicle suffers from abnormality in the main control system (i.e., the limp-homing or backup capability).

On the other hand, when the aforementioned decision step S106 results in negation (NO), a quantity for driving the main throttle valve 110 is calculated by the control signal generating means 111 in a step S104, and the main throttle valve 110 is driven by the main throttle valve driving device 106 in accordance with the quantity as determined (step S105). When abnormality is detected in the course of driving the main throttle valve 110 in the step S106, the steps S107 and S108 are executed, whereby the intake air flow control is transferred to the auxiliary control system.

In the apparatus described above, it is noted that the amount of fuel injected into the engine is controlled on the basis of the intake air flow and the engine rotation speed (rpm), wherein similar fuel injection control procedure is performed in both the cases where the intake air flow is controlled by the main control system and where the intake air flow control is effected by the auxiliary control system. As a result of this, there arises problems mentioned below.

Heretofore, the bypass throttle valve driving means 114 constituting a part of the auxiliary control system is implemented by using an inexpensive actuator of a low control speed such as a stepping motor, a DC motor, a DC solenoid or the like. Accordingly, an appreciable delay is involved in the response of the bypass throttle valve driving means 114 to a demand for rapid reduction of the intake air flow which is issued when release of the accelerator pedal is accompanied with manipulation of the clutch. In this case, the engine speed (rpm) may increase steeply, to a problem.

By way of example, let's assume that the driver changes the gear ratio from a first to a second stage in the course of driving the motor vehicle with the intake air control being effected by the main throttle valve control system. In that case, the driver will have to release the accelerator pedal simultaneously with the manipulation of the clutch in order to prevent the engine speed from increasing steeply due to the gear ratio change. However, when the intake air flow control is being performed by the auxiliary control system (bypass intake air control system) instead of the main control system because of abnormality thereof, the release of the accelerator pedal simultaneously with the upshift of the gear ratio is reflected onto the intake air flow control only with a significant time delay particularly when the bypass throttle actuator of low response characteristic as mentioned above is employed as the bypass throttle valve driving means 114. In that case, the engine speed will increase rapidly because of a significant amount of intake air fed to the engine before the bypass throttle valve 109 is driven in the closing direction, to uncomfortableness.

Certainly, there is known a control apparatus for an internal combustion engine, which apparatus is designed to ensure a backup operation such as limp-homing (backup) operation mode even in the case where a fault occurs in the throttle valve control system in the fully closed state of the throttle valve, as is disclosed in Japanese Unexamined Patent Application No. 286837/1990 (JP-A-H2-286837) or No. 8441/1986 (JP-A-61-8441). However, this known apparatus still suffers a problem remaining to be solved, which will be made clear in the following.

FIG. 32 is a schematic block diagram showing a general arrangement of a simplified example of such a control apparatus as mentioned above. Referring to the figure, an internal combustion engine 1 for a motor vehicle is provided with an intake pipe 203 in which a throttle valve 202 is disposed for regulating or controlling the amount of air to be charged in the engine. The throttle valve 202 is adapted to be driven by a throttle actuator 204 which may be constituted by a stepping motor, a DC motor or the like. The throttle valve 202 is operatively coupled to the throttle actuator 204 by means of a shaft 205. A return spring 206 is disposed around the shaft 205 for forcively setting the throttle valve 202 to the closed state upon occurrence of abnormality in the throttle control system.

Further provided in association with the throttle valve 202 is a throttle position sensor (TPS) 207 which serves for detecting the opening degree of the throttle valve 202. A bypass passage 208 is connected to the intake pipe 203 in parallel for allowing the intake air flow to bypass the throttle valve 202. A bypass control valve 209 is installed in the bypass passage 208 primarily for the purpose of controlling the auxiliary intake air flow through the bypass passage 208 in the idling operation of the engine. An accelerator pedal 210 of the motor vehicle is equipped with an accelerator pedal depression stroke sensor (or accelerator pedal position sensor or APS) 211 for detecting the depression or actuation stroke of the accelerator pedal 210. There are further provided an engine speed (rpm) sensor 212 for detecting the engine speed, i.e., rotation number thereof and a load sensor 213 for detecting a load of equipment such as a power steering system, an air conditioner and so forth. A signal processing unit 214 which may be constituted by a microcomputer is in charge of controlling the throttle actuator 204 and the bypass control valve 209 on the basis of the signals generated by the various sensors.

The engine 201 includes a speed change gear (including a solenoid valve (SV) or the like) for controlling an automatic transmission 216 by utilizing the output of the throttle position sensor 208 as the engine output torque information, a fuel injection control means 217 for controlling the amount of fuel to be injected into the engine through a fuel injector 218 in dependence on the opening degree information available from the output of the throttle position sensor 208.

Next, operation of the control apparatus will be described by reference to a flow chart of FIG. 33. Parenthetically, it should be mentioned that arithmetic operations or calculations as well as decisions mentioned below are executed by the signal processing unit 214 which may be constituted by a microcomputer or the like.

In a step S201, a difference $\beta$ is determined between an accelerator pedal stroke $\alpha$ indicated by the output signal of the accelerator pedal depression stroke sensor 211 interlocked with the accelerator pedal 210 and an actual throttle opening degree $\theta_r$ indicated by the output signal of the throttle position sensor 208.

The relation between the accelerator pedal stroke $\alpha$ and the actual throttle opening degree $\theta_r$ is given by a predetermined function such that the actual throttle opening degree $\theta_r$ progressively increases as the accelerator pedal stroke $\alpha$ increases until the throttle valve 202 is fully opened. Accordingly, so long as the throttle valve control system is normal, the difference $\beta$ must not exceed a predetermined valve $\beta_1$.

Accordingly, in a step S202, decision is made as to whether or not the difference $\beta$ is greater than $\beta_1$. If so, it is determined that the throttle valve control system suffers some trouble, and the throttle actuator 204 is then deenergized so that the throttle valve 2 assumes the fully closed state in a step S203. At the same time, the bypass control valve 209 is driven in such direction that the auxiliary or bypass intake air flow can increase (step S204). In this manner, the backup operation (limp-homing (backup) operation mode) can be assured notwithstanding of occurrence of trouble in the fully closed state of the throttle valve 202.

On the other hand, when it is decided in the step S202 that the difference $\beta$ is smaller than the predetermined value $\beta_1$, indicating that the throttle valve control system operates normally, a normal control is performed in a step S205 in which the opening degree of the throttle valve 202 is controlled by driving the throttle actuator 204 in dependence on the output signal of the accelerator pedal depression stroke sensor 211. Of course, the idling engine speed control can be carried out by controlling the bypass control valve 209 (step S206).

The control apparatus described above however suffers a problem that the vehicle speed can not arbitrarily be set at a desired value in the backup (limp-homing) operation for driving the motor vehicle having trouble in the throttle valve control system to a service station. More specifically, in the backup operation mode, the bypass control valve can be driven only in the direction to increase the auxiliary intake air flow, making thus it impossible to set the vehicle speed at a desired value.

Moreover, because the main throttle valve 202 is constantly maintained in the fully closed state when trouble takes place in the throttle valve control system, performances of other control means such as the speed change gear control means 215 and the fuel injection control means 217 which are conventionally designed to operate on the basis of the output of the throttle position sensor 208 will be degraded, incurring degradation in the drivability of the motor vehicle in the backup (limp-homing) operation mode such as slow response to actuation of the accelerator pedal or change of the gear ratio.

SUMMARY OF THE INVENTION

In the light of the state of the art described above, it is a first object of the present invention to provide an intake air flow control apparatus for an internal combustion engine which can guarantee the limp-homing (backup) operation nevertheless of occurrence of a fault in a main intake air flow control system without incurring high cost in implementation of the apparatus.

It is a second object of the present invention to provide a control method and apparatus for an internal combustion engine of a motor vehicle, which can prevent a rotation speed of the internal combustion engine from increasing steeply in response to an up-shift of gear ratio in the case where running capability of the motor vehicle is ensured by an auxiliary intake air flow control system in place of the main intake air flow control system which suffers abnormality.

It is a third object of the present invention to provide a control apparatus for an internal combustion engine of a motor vehicle, which apparatus is capable of setting arbitrarily the engine output torque within a range limited due to trouble of a main throttle valve control system without incurring degradation in performance or function of other control means, operation of which depend on the opening degree of the throttle valve in the normal state of control and driving devices therefor.

Other objects of the present invention will become apparent as description proceeds.

In view of the first object mentioned above, there is provided according to a first aspect of the present invention an apparatus for controlling air supply to an internal combustion engine, which apparatus comprises a main intake air passage for supplying intake air to the engine, a main air flow control means disposed in association with the main intake air passage for controlling flow rate of the intake air supplied to the engine through the main intake air passage in accordance with magnitude of actuation of an accelerator pedal, a plurality of bypass passages disposed in parallel with the main intake air passage for allowing the intake air to be supplied to the engine by bypassing the main intake air flow control means, a plurality of bypass air flow control means provided in association with the plurality of bypass passages, respectively, a diagnosis means for diagnosing the main intake air flow control means as to occurrence of abnormality, and a control means responsive to an abnormality decision signal issued by the diagnosis means upon detection of abnormality in the intake air flow control means to thereby close the main intake air passage while allowing the bypass air flow control means to control the intake air flowing through the bypass passages in accordance with magnitude of actuation of the accelerator means.

With the structure of the control apparatus described above, the main intake air passage is closed upon occurrence of trouble in the main intake air flow control system and substantially at the same time the bypass air flow control means connected in parallel to the main air intake flow control means is operated in dependence on magnitude of actuation (depression stroke) of the accelerator pedal, whereby the backup operation (limp-homing function) can be guaranteed.

In a preferred mode for carrying out the invention, the control apparatus may further include a closing control means for causing the main intake air flow control means to close forcively the main intake air passage, wherein the closing control means is activated by the control means in response to the abnormality decision signal.

By virtue of the arrangement described above, the main intake air flow control means can be closed without fail by the closing control means upon occurrence of trouble in the main intake air flow control means.

In conjunction with the first aspect of the invention mentioned previously, there is further provided an apparatus for controlling air supply to an internal combustion engine, which apparatus comprises a main intake air passage for supplying air to the engine, a first main air flow control means disposed in association with the main intake air passage for controlling the flow rate of the intake air supplied to the engine through the main intake air passage in accordance with magnitude of actuation (depression depth) of an accelerator pedal, a second main intake air flow control means disposed in the main intake air passage in series to the first main intake-air flow control means, a plurality of bypass passages disposed in parallel with the main intake air passage for allowing the air to be supplied to the engine by bypassing the first and second main intake air flow control means, a plurality of bypass air flow control means provided in association with the plurality of bypass passages, respectively, a diagnosis means for diagnosing the first main intake air flow control means as to occurrence of abnormality therein, and a control means responsive to an abnormality decision signal issued by the diagnosis means upon detection of abnormality in the first main intake air flow control means to thereby close the second main intake air flow control means while allowing the bypass air flow control means to control the amount of the intake air flowing through the bypass passages in accordance with magnitude of actuation of the accelerator pedal.

In the control apparatus of the above-mentioned structure in which the first and second main intake air flow control means are disposed in series to each other in the main intake air passage, the second main intake air flow control means is closed when abnormality takes place in the first main intake air flow control means, whereby the limp-homing function can be realized by the bypass air flow control means provided in parallel to the first and second main intake air flow control means.

In the control apparatuses described above, at least one of the plurality of bypass air flow control means may be realized in the form of an on/off-solenoid valve means.

Owing to this structure, an increased amount of the bypass air flow is made available with inexpensive structure of the bypass air flow control means.

In another preferred mode for carrying out the first aspect of the invention, at least one of the plurality of bypass air flow control means may be constituted by a valve device which can be controlled linearly or continuously. In this case, the control means may control the valve device through a feedback loop so that rotation speed (rpm) of the internal combustion engine in an idling operation mode assumes a target value in a normal state where no abnormality decision signal is issued.

With the above-mentioned structure of the control apparatus, it is possible to use the continuously controllable valve device for the engine speed control in the idling operation in the normal state, while using the same valve for realizing the limp-homing function in the abnormal state.

Furthermore, at least one of the plurality of bypass air flow control means may include a valve which can be controlled continuously, wherein the control means is so arranged as to respond to generation of the abnormality decision signal for thereby controlling the continuously controllable valve through a feedback loop so that the engine speed (rpm) in the idling operation assumes a target value, while in a non-idling operation mode, the control means controls the opening degree of the continuously controllable valve in accordance with magnitude of actuation of the accelerator pedal.

Owing to the above-mentioned structure, the bypass air flow can be controlled in dependence on the depression of the accelerator pedal while assuring the engine speed control even in the abnormal state.

Further, the control means may be so designed as to respond to generation of the abnormality decision signal for thereby controlling opening degree of the continuously controllable valve so that intake air flow through the bypass passage increases at a low temperature of the internal combustion engine.

With the arrangement mentioned above, the bypass air flow in the abnormal state can be increased at a low engine temperature, whereby a so-called wax function can be realized.

The control means mentioned above may be so adapted as to respond to generation of the abnormality decision signal for thereby inhibiting power supply to an air conditioner. By disconnecting the power supply to the air conditioner when trouble takes place in the main intake air flow control means, the motor vehicle can be driven with higher performance.

In the control apparatuses mentioned above, at least one of the plurality of bypass air flow control means may include an on/off-solenoid valve means and at least another one of the plural bypass air flow control means may be constituted by a valve means which can be controlled continuously. In this case, the control means responds to generation of the abnormality decision signal for controlling the air supply to the engine through the continuously controllable valve means when the magnitude of actuation of the accelerator pedal is smaller than a predetermined value, while when the magnitude of activation of the accelerator pedal exceeds a predetermined value, the on/off-solenoid valve means is additionally actuated so that air supply to said engine is controlled through cooperation of the continuously controllable valve means and the on/off solenoid valve means.

By implementing the bypass air flow control means by a combination of the on/off solenoid valve and the continuously controllable valve as mentioned above, the bypass air flow can smoothly be controlled without incurring additional cost by turning on the on/off solenoid valve to increase the bypass air flow only when the depression stroke exceeds a predetermined value.

Further, in the control apparatus described above, at least one of the plural air flow control means may be constituted by at least two on/off-solenoid valves which differ from one another in respect to the air flow rate. In this case, the control means responds to generation of the abnormality decision signal by controlling the two on/off-solenoid valves in synchronism with one another so that the bypass air flow can be controlled stepwise. With this arrangement, the bypass air flow control can be realized more inexpensively.

Furthermore, the control means may preferably be so implemented as to control the plurality of bypass air flow control valves with delay times corresponding to delays involved in activation of the plural bypass air flow control valves, respectively. In this conjunction, the plurality of bypass air flow control valves may be operated at preset desirable timings.

In view of the second object mentioned previously, the present invention is directed to an internal combustion engine for a motor vehicle, in which the engine is provided with a main intake air flow control means for controlling an intake air flow fed to the engine, an abnormality detecting means for detecting occurrence of abnormality in the main intake air flow control means, and a bypass air flow control means for controlling the intake air flow in place of the main intake air flow control means upon occurrence of abnormality therein, a means for detecting rotation speed (rpm) of the engine, and a fuel injection control means for controlling the fuel injection to the engine on the basis of at least the engine rotation speed and the intake air flow rate. In the internal combustion engine described above, there is provided according to a second aspect of the present invention a control method which comprises a step of responding to detection of the abnormality for changing a range of engine operation relative to a normal operation range set for a normal state in which the intake air flow is controlled by the main intake air flow control means.

As a preferred mode for carrying out the control method mentioned above, there is provided a method of controlling operation of an internal combustion engine for a motor vehicle, which method comprises the steps of detecting magnitude of actuation of an accelerator pedal, detecting an opening degree of a throttle valve disposed in an intake pipe of the engine, regulating an intake air flow supplied to the engine by controlling the throttle valve on the basis of the magnitude of actuation of the accelerator pedal and the throttle valve opening degree as detected, detecting abnormality of devices involved in the control of the throttle valve, responding to detection of the abnormality for for controlling an opening degree of a bypass air flow control valve which allows the intake air flow to bypass the main throttle valve on the basis of the magnitude of actuation of the accelerator pedal, detecting a rotation speed (rpm) of the engine, controlling an amount of fuel to be injected to the engine on the basis of at least the engine rotation speed and the intake air flow rate, and responding to detection of the abnormality by changing a range of engine operation relative to a normal operation range set for a normal state in which the intake air flow is controlled by the main intake air flow regulating means.

For carrying out the control method described just above, there is further provided according to the second aspect of the present invention an apparatus for controlling operation of the internal combustion engine, which comprises an accelerator pedal actuation detecting means for detecting magnitude of actuation of an accelerator pedal, a throttle valve position detecting means for detecting an opening degree of a throttle valve disposed in an intake pipe of the engine, a throttle valve control means for regulating an intake air flow supplied to the engine by controlling the throttle valve on the basis of the magnitude of actuation of the accelerator pedal and the throttle valve opening degree as detected, an abnormality detecting means for detecting occurrence of abnormality in devices provided in association with the control of the throttle valve, a control means responsive to detection of the abnormality outputted from the abnormality detecting means for controlling a valve opening degree of a bypass air flow control means which allows the intake air flow to bypass the throttle valve on the basis of the magnitude of actuation of the accelerator pedal, an engine speed detecting means for detecting a rotation speed (rpm) of the engine, a fuel injection control means for controlling an amount of fuel to be injected to the engine on the basis of at least the engine rotation speed and the intake air flow rate, and an operation range switching means operatively connected to the abnormality detecting means and the fuel injection controlling means and responding to detection of the abnormality by changing or shifting an engine operation range relative to a normal operation range set for a normal state in which the intake air flow is regulated by the main intake air flow control means.

In the preferred mode for practically realizing the method and the apparatus described above, the engine operation range may be defined as a range of fuel injection determined in correspondence to the engine rotation speed, wherein the fuel injection range is narrowed for operation of the motor vehicle in the abnormal state relative to the normal state of engine operation. The fuel injection may be stopped when operation of the engine departs from the operation range in the abnormal state.

With the control methods and apparatus described above, the intake air to be charged into the engine is controlled by the throttle valve disposed within the intake pipe (main air flow passage) and constituting the main air flow control means while the amount of fuel to be injected into the engine is controlled on the basis of the intake air flow and the engine speed in the normal operation state. On the other hand, when abnormality is detected in the main intake air flow control means and/or associated devices thereof, the intake air flow is controlled by the bypass air flow control means in place of the main intake air flow control means. Besides, upon occurrence of abnormality, the operation range of the engine is so shifted that the engine speed is prevented from increasing steeply. More specifically, by detecting the magnitude of actuation (depression stroke) of the accelerator pedal and the throttle opening degree, it is decided whether the main throttle device suffers from abnormality. When this decision.results in affirmation, the bypass air flow is controlled by the bypass throttle valve in dependence on the depression stroke of the accelerator pedal, while-the fuel injection range for the fuel injection control means is shifted in dependence on the engine speed (rpm) such that the fuel injection is stopped when the engine speed exceeds a predetermined value.

Additionally, in view of the third object mentioned hereinbefore, there is provided according to a third aspect of the present invention a control apparatus for an internal combustion engine of a motor vehicle, which apparatus comprises a first detecting means for determining a throttle opening degree corresponding to magnitude of actuation of an accelerator pedal, a first throttle means for controlling an intake air flow to be charged into the engine, a second detecting means for detecting an actual opening degree of the first throttle means, a second throttle means for controlling an auxiliary intake air flow to be charged into the engine in idling operation thereof, a first control means for controlling the first and second throttle means on the basis of outputs of the first and second detecting means, respectively, and a second control means for controlling a speed of the motor vehicle and an amount of air flow to be charged into the engine on the basis of the output of the second detecting means, wherein upon occurrence of abnormality in the first throttle means, the first control means controls the second throttle means on the basis Of the output of the first detecting means and converts an opening degree of the second throttle means as determined arithmetically from a driving force required for controlling the second throttle means into a corresponding throttle opening degree of the first throttle means, and wherein the second control means controls the speed of the motor.vehicle and the fuel supply to the engine on the basis of the converted throttle opening degree as supplied from the first control means in place of the output of the second detecting means.

In a mode for realizing the third aspect of the invention described above, the conversion of the opening degree of the second throttle means into that of the first throttle means may be effected by the second control means itself.

By virtue of the structure of the control apparatus described above, the engine speed (rpm) and hence the vehicle speed can arbitrarily be set within a limited range of the engine output torque even in the backup or limp-homing operation mode. Besides, control performance of the second control means which utilizes the output of the second detecting means as the engine torque information in the normal state of operation can be protected against degradation in the backup or limp-homing operation mode, whereby drivability of the motor vehicle in the backup mode can be assured satisfactorily.

The above other objects, features and attendant advantages of the present invention will more clearly be understood by reading the following description of the preferred embodiments thereof taken, only by way of example, by reference to the drawings.

DESCRIPTION OF THE PREFERRED EMBODIMENTS

Now, the present invention will be described in detail in conjunction with preferred or exemplary embodiments thereof by reference to the drawings.

Embodiment 1

Figure 1:
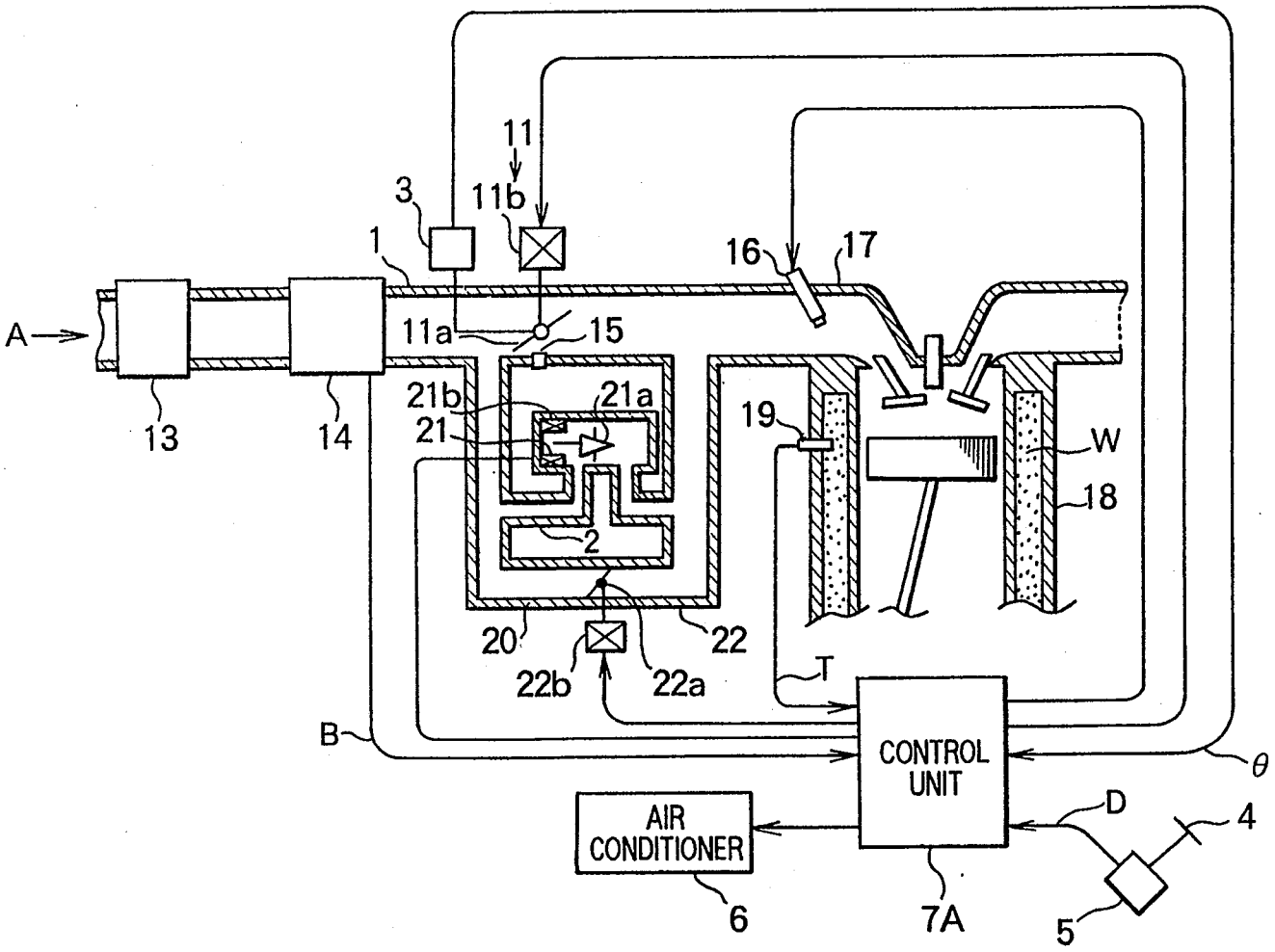
FIG. 1 shows in a block diagram partially in section a control apparatus for an internal combustion engine according to a first embodiment incarnating the first aspect of the present invention.
Figure 25:
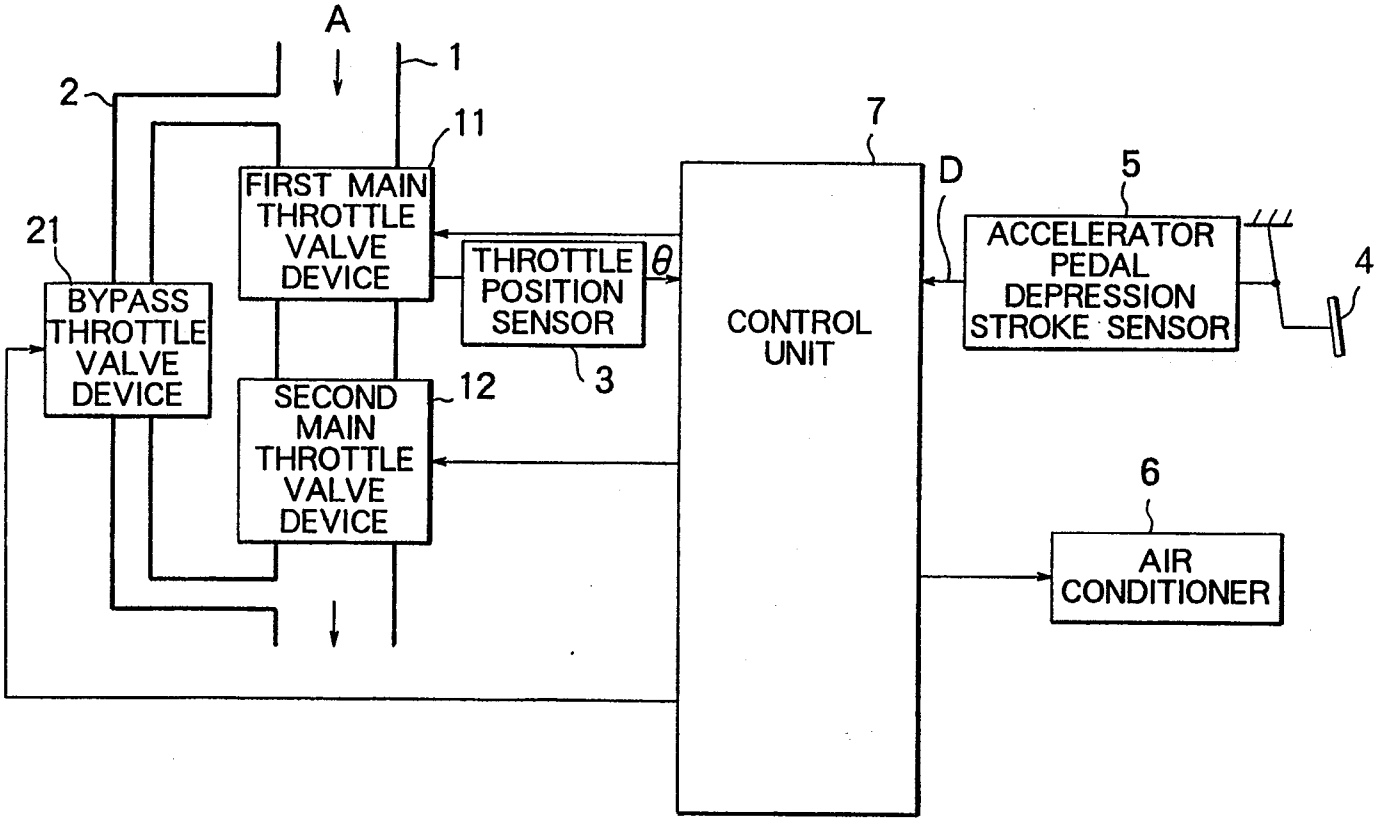
FIG. 25 PRIOR ART
FIG. 25 is a block diagram showing schematically a general arrangement of an engine intake air control apparatus known heretofore.
Figure 26:
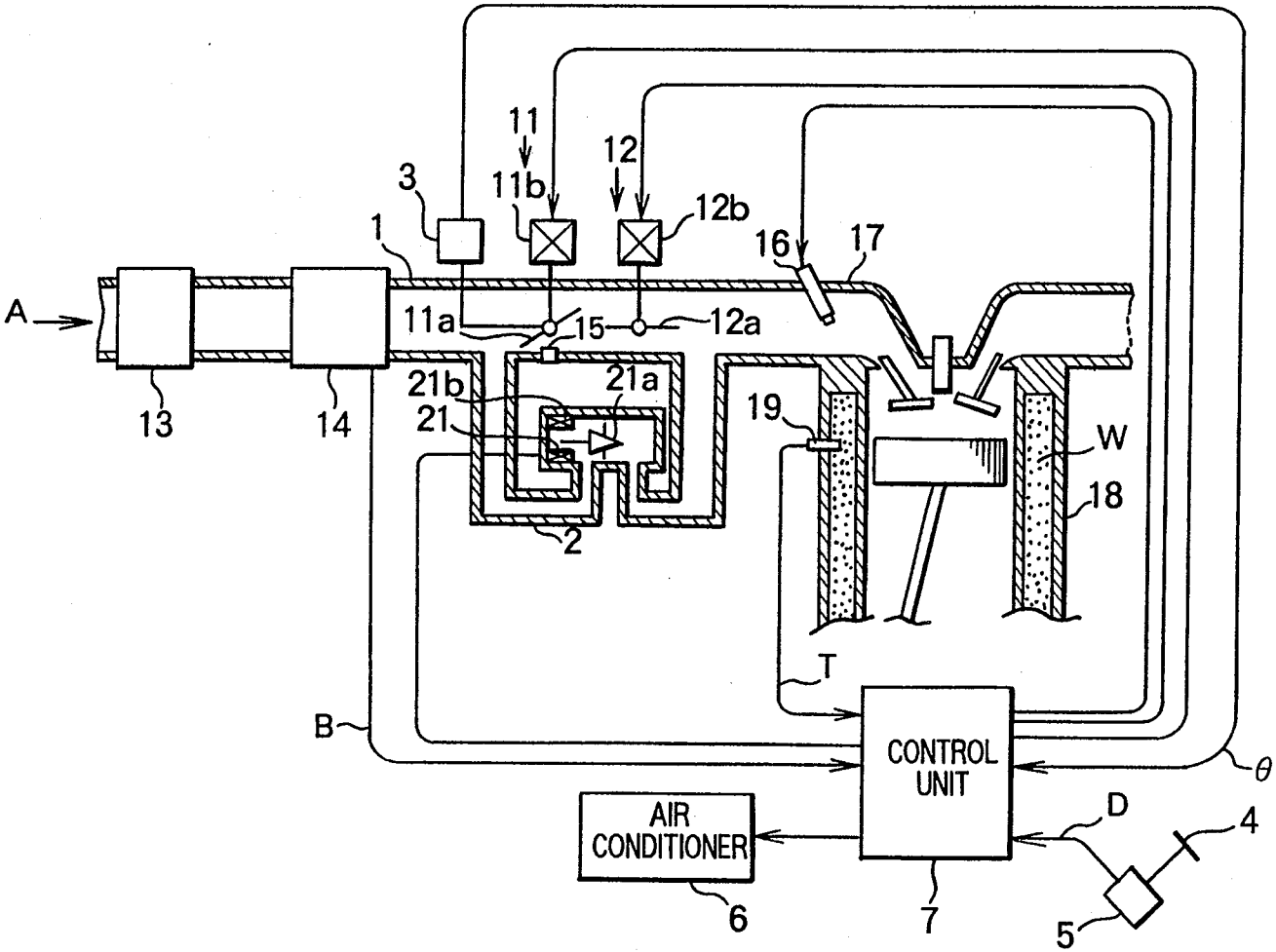
FIG. 26 PRIOR ART
FIG. 26 is a block diagram showing in more detail, a major part of the apparatus shown in FIG. 1 partially in section.
Figure 27:
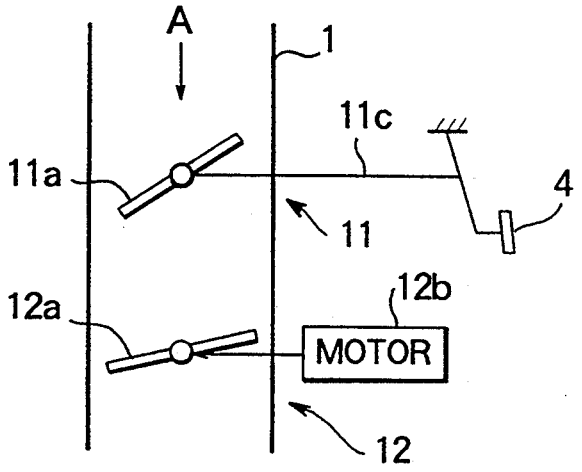
FIG. 27 PRIOR ART
FIG. 27 is a diagram showing schematically a throttle device including a pair of throttle valves disposed serially in an intake pipe of an engine known heretofore.
Figure 28:
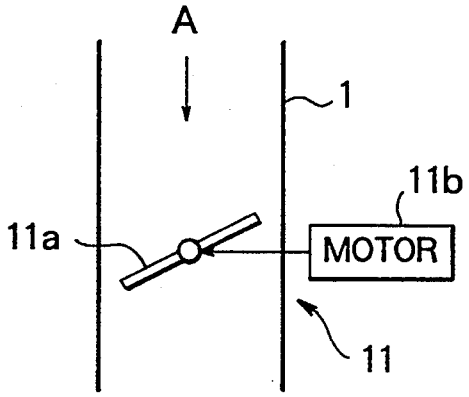
FIG. 28 PRIOR ART
FIG. 28 is a diagram showing schematically a throttle device including a single valve disposed in an intake pipe of an internal combustion engine known heretofore.
Figure 29A:
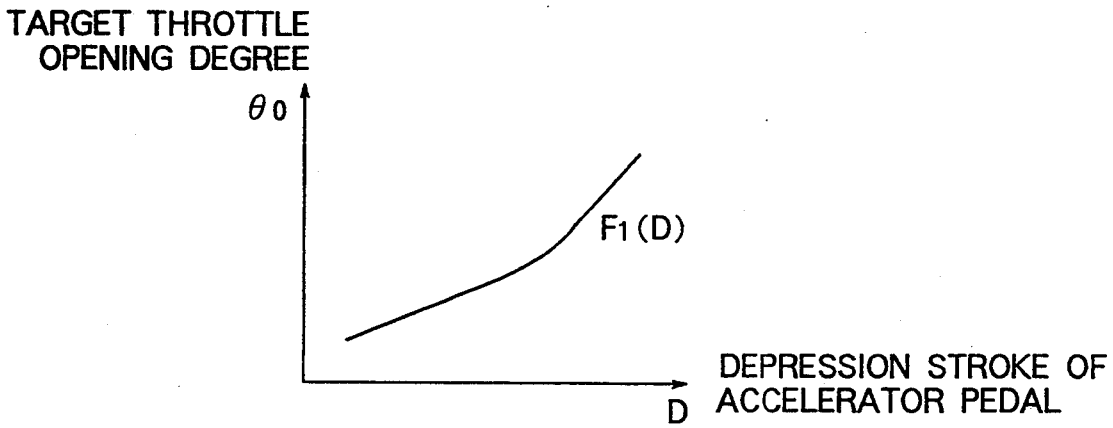
FIG. 29A PRIOR ART
FIG. 29A is diagram for illustrating a relation between a target throttle opening degree of a throttle valve and a depression stroke of an accelerator pedal when the throttle valve is electrically controlled in dependence on the latter.
Figure 29B:
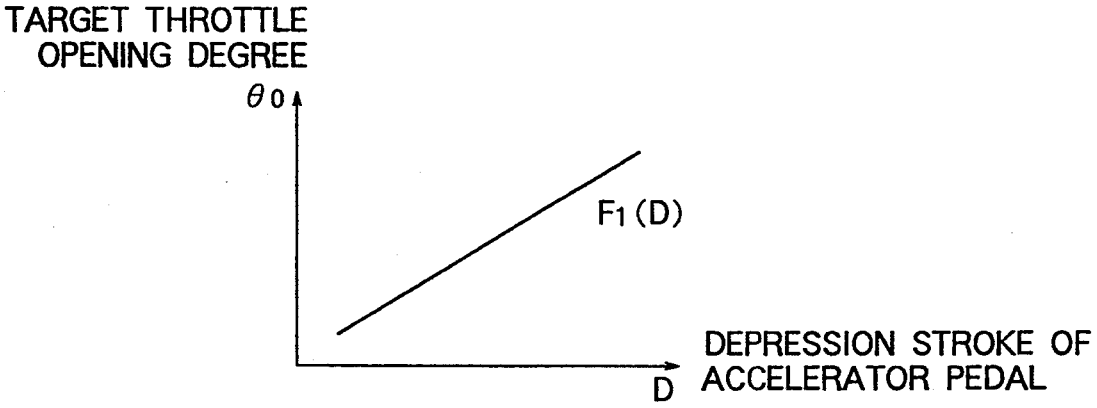
FIG. 29B PRIOR ART
FIG. 29B is diagram for illustrating a relation between a target throttle opening degree of a throttle valve and a depression stroke of an accelerator pedal in the case where the throttle valve and the accelerator pedal are interlinked with each other.

FIG. 1 shows in a bock diagram partially in section an intake air flow control apparatus for an internal combustion engine according to a first exemplary embodiment in which the first aspect of the invention described hereinbefore is incarnated. In the figure, the reference numerals 1 to 6, 11, 13 to 19, 21 and **21*a* denote parts same as or equivalent to those described hereinbefore in conjunction with the conventional apparatuses by reference FIGS. 25 to 29A and 29B. Accordingly, repeated description will be unnecessary. It should further be understood that the reference symbols A, B, D, T, W and e represent same or like information or signals also described hereinbefore in conjunction with the prior art. A control unit 7A corresponds to that designated by the numeral 7 in FIGS. 25 and 26. In the case of the instant embodiment of the invention, it is assumed that the main air flow control means is comprised only of the first throttle device 12** being spared.

The control unit 7A is in charge of controlling a bypass air flow control means (details of which will hereinafter be described) while inhibiting the power supply to the air conditioner 6, when it is decided that a fault or abnormality occurs in the main air flow control means, i.e., the first throttle valve 11.

According to the instant embodiment, there is disposed in parallel with the first bypass passage 2 a second bypass passage 20 which cooperates with the first bypass passage 2 to constitute a plurality of bypass passages for allowing the intake air to bypass the first throttle valve 11 disposed in the main intake pipe or passage 1.

A second bypass throttle device 22 which constitutes a part of a bypass air flow control means is installed in association with the second bypass passage 20 and comprised of a second bypass throttle valve **22*a* and an actuator such as a DC motor 22*b* for operating (i.e., opening or closing) the second bypass throttle valve 22*a*** under the control of the control unit 7A.

It should however be mentioned that in place of the second bypass throttle device 22 comprised of the second bypass throttle valve **22*a* and the DC motor 22*b*, any other appropriate bypass throttle device may be installed in association with the second bypass passage 20. By way example, a pulse-driven solenoid valve such as an on/off-solenoid valve, a duty-solenoid valve or the like may equally be employed to the substantially same effect. Additionally, the DC motor 22b** may be replaced by a stepping motor or a vacuum motor.

Figure 2:
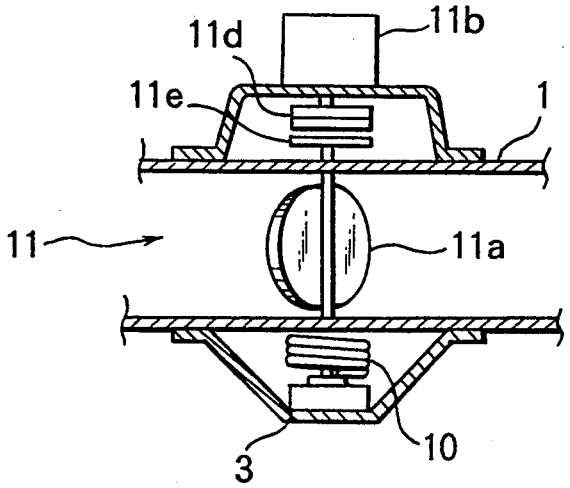
FIG. 2 is a schematic side elevational view showing partially in section structures of a main throttle device and a throttle position sensor employed in the apparatus shown in FIG. 1.

FIG. 2 shows exemplary structures of the first throttle device 11 and the throttle position sensor 3 shown in FIG. 1 in a partially sectioned plan view as viewed in the direction along the Z-axis.

In this case, it is assumed that the motor 11b for opening/closing the throttle valve 11a is also constituted by a DC motor. The throttle valve 11a is coupled to the DC motor 11b through an electromagnetic clutch 11d which is always electrically energized. A clutch disk 11e coupled to the electromagnetic clutch 11d is fixedly secured to a rotatable shaft of the throttle valve 11a.

The throttle valve 11a is constantly urged in the direction toward the close state by a return spring i0 which has one end operatively coupled to a throttle opening sensor 3. The return spring 10 constitutes a closing control means for forcively rotating the throttle valve 11a in the direction to thereby close the main intake air flow passage 1 upon detection of occurrence of a fault or abnormality in the throttle device 11.

As mentioned previously, the DC motor 11b may be replaced by a vacuum motor or a hydraulic motor. Alternatively, the DC motor 11b may be constituted by a stepping motor which is adapted to be controlled through a feedback loop which is known per se in the art. Besides, as the closing control means for forcively closing the throttle valve 11a, the return spring 10 may be replaced by a DC motor which is continuously supplied with a control current for urging the throttle valve 11a toward the close position. Of course, a stepping motor may be employed to this end.

Next, description will be directed to operation of the intake air flow control apparatus shown in FIG. 1 by also referring to FIG. 2.

The electromagnetic clutch 11d is electrically energized constantly and thus coupled to the clutch disk 11e. Consequently, the throttle valve 11a is rotated by the DC motor 11b through the electromagnetic clutch 11d and the clutch disk 11e, whereby the throttle opening degree $\Theta$ is set in correspondence to an angular position of an output shaft of the DC motor 11b. The throttle position sensor 3 detects the throttle opening degree $\Theta$ and supplies signal to the control unit 7A which in turn controls the DC motor 11b so that the throttle opening degree $\Theta$ assumes a desired or target opening degree which is determined in accordance with an accelerator pedal depression stroke signal D generated by the sensor 5.

In the idling operation of the engine, the fully closed state of the throttle valve 11a is detected by the idle switch 15, whereon a low-speed rotation control of the engine in the idling mode is effectuated by means of a linear solenoid valve 21a provided in association with the first bypass passage 2. In this case, the second bypass throttle device 22 provided in association with the second bypass passage 20 is held in the close or off-state.

When abnormality of the throttle valve 11a is detected, the control unit YA deenergizes the electromagnetic clutch 11d to thereby release the throttle valve 11a. As a result of this, the throttle valve 11a is rotationally driven toward the close position under a restoring force of the return spring 10, whereby the main air flow passage 1 is closed. In this state, however, the arrangement including the bypass passages 2 and 20 as well as the bypass throttle devices 21a; 21b and 22a; 22b provided in parallel with the main intake air flow passage 1 can guarantee a minimum driving function (i.e., a so-Galled limp-homing or backup function) required for driving the motor vehicle to a service station or the like place, as will hereinafter be described.

Next, referring to flow charts shown in FIGS. 3 and 4, operation of the intake air flow control apparatus according to the instant embodiment will be described in greater detail. FIG. S shows a routine processing for setting a target throttle opening degree, which is executed periodically at a predetermined time interval (e.g. 25 msec.) or at every predetermined crank angle representing a predetermined angular position of a crank shaft.

Figure 3:
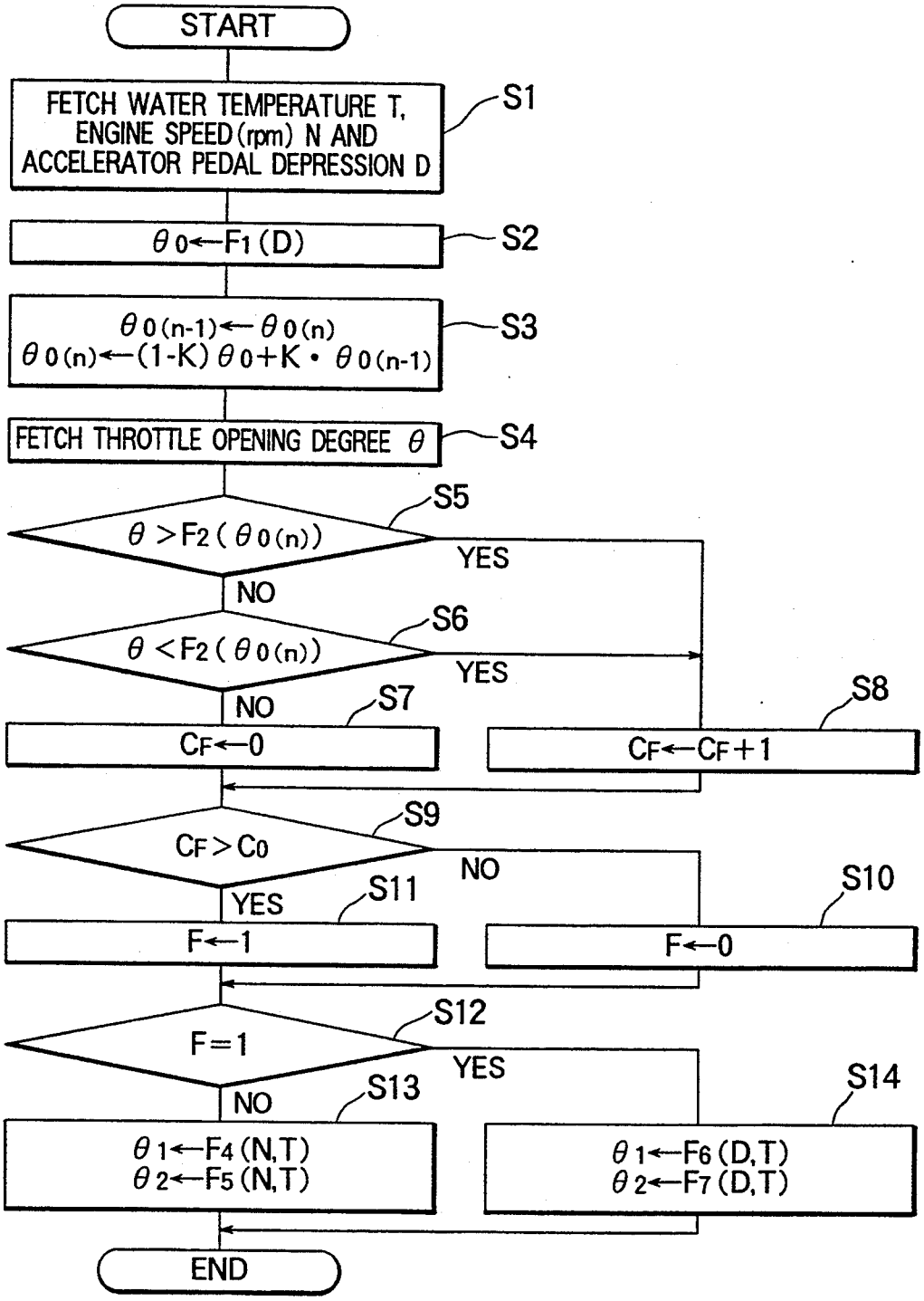
FIG. 3 is a flow chart illustrating a routine processing for setting a target throttle opening.

In the execution of the target throttle opening degree setting routine shown in FIG. 3 in the normal running state of the motor vehicle, the control unit 7A fetches in a step S1 the signals representing the water temperature T indicative of engine temperature, the engine rotation speed (rpm) N and the accelerator pedal depression stroke D from the associated sensors, respectively, to thereby determine a target throttle opening degree $\Theta_o$ of the throttle valve 11a on the basis of the fetched information mentioned above in accordance with a function $F_1(D)$ of the accelerator pedal depression stroke (step S2). This function $F_1(D)$ may be either one of those illustrated graphically in FIGS. 29A and 29B and stored in a memory incorporated in the control unit 7A in the form of map data to be referenced by the unit 7A upon determination of the target throttle opening degree $\Theta$.

Subsequently, the filtering arithmetic processing is performed on the current target throttle opening degree $\Theta_o$ by referencing the preceding value to thereby determine a convolution throttle opening degree $\Theta_o(n)$. More specifically, the current convolution target throttle opening degree $\Theta_o(n)$ is determined on the basis of the current target throttle opening degree $\Theta_o$ and the preceding convolution value $\Theta_o(n-1)$ in accordance with the following expression:

$$\Theta_o(n)=(1-K)\Theta_o+K\cdot\Theta_o(n-1) \quad (1)$$

The convolution target throttle opening degree $\Theta_o(n)$ is thus successively updated (step S3). Parenthetically, in the above expression (1), K represents a filter constant which assumes a value within a range of $0<K<1$.

Next in a step S4, the throttle opening degree $\Theta$ is fetched from the output of the throttle sensor 3 to be compared with a normal upper limit opening degree determined in accordance with a function $F_2(\Theta_o(n))$ which is based on the current convolution target throttle opening degree $\Theta_o(n)$, to thereby make decision as to whether or not the throttle valve 11a suffers from abnormality on the basis of the decision as to whether $\Theta>F_2(\Theta_o(n))$ in a step S5.

When the result of the decision step S5 is negative (NO), the fetched throttle opening degree $\Theta$ is then compared with a lower limit value of the normal range given by a function $F_3(\Theta_o(n))$ which is based on the current convolution target throttle opening degree $\Theta_o(n)$ to thereby make decision as to whether or not $\Theta<F_3(\Theta_o(n))$, i.e., whether or not the throttle valve 11a is in abnormality state (step S6).

The functions $F_2(x)$ and $F_3(x)$ which define the upper and lower limits of the normal range of the throttle opening may be given by the following expressions (2) and (3) or (4) and (5).

$$F_2(x)=x+k_1 \quad (2)$$

$$F_3(x)=x+k_2 \quad (3)$$

$$F_2(x)=k_3 \cdot x \quad (4)$$

$$F_3(x)=k_4 \cdot x \quad (5)$$

In the above expressions (2) to (5), $k_1$ to $k_4$ represent weighting coefficients used for setting abnormality decision reference values.

When the throttle valve 11*a* is in the normal state with the result of the decision step S6 being negative (NO), an abnormality decision counter $C_F$ is reset to zero in a step S7. On the other hand, in case the throttle valve 11*a* is suffering trouble with the result of the decision step S5 or S6 being affirmative (YES), the abnormality decision counter $C_F$ is incremented to allow an abnormality decision procedure to be started in a step S8.

Subsequently, the count value of the abnormality decision counter $C_F$ is compared with the decision reference value $C_o$ to decide whether $C_F > C_o$. In other words, decision is made in a step S9 as to whether the procedure is to proceed with a succeeding processing for coping with the abnormality. By way of example, when the routine shown in FIG. 3 is executed every 25 msec. and when the decision reference value $C_o$ is set to "20", decision of the step S9 is made as to whether abnormal state has continued over a period of 500 msec.

When the count value of the abnormality decision counter $C_F$ is smaller than the decision reference value $C_o$ and when the decision step S9 results in negation "NO", an abnormality decision flag F is reset to zero in a step S10. On the other hand, when the decision result is affirmative "YES" because $C_F > C_o$, the abnormality decision flag F is set to "1" in a step S11.

Subsequently, the processing proceeds to execution of a target throttle opening degree setting routine for the first bypass passage 2 and the second bypass passage 20 (steps S12 to S14). In this routine, it is first decided whether or not the abnormality decision flag F is "1", i.e., whether or not the throttle valve 11*a* is operating normally (step S12).

When the throttle valve 11*a* is normal and when the above decision results in negation "NO", the target opening degrees, $\Theta_1$ and $\Theta_2$ for the first bypass throttle valve 21*a* and the second bypass throttle valve 22*a* are determined in accordance with functions $F_4(N, T)$ and $F_5(N, T)$, respectively, on the basis of the engine speed (rpm) N and the cooling water temperature T in a step S13.

Ordinarily, the first bypass throttle valve 21*a* is controlled only in the idling operation mode with the second bypass throttle valve 22*a* being maintained in the closed state. However, either the first bypass throttle valve 21*a* or the second bypass throttle valve 22*a* may be driven even when the throttle valve 11*a* is operating in the normal state.

In contrast, when the throttle valve 11*a* suffers from a fault with the result of decision in the step S12 being negative "NO", the target opening degrees $\Theta_1$ and $\Theta_2$ for the bypass throttle valves 21*a* and 22*a* are determined in accordance with functions $F_6(D, T)$ and $F_7(D, T)$ on the basis of the accelerator pedal depression stroke D and the water temperature T (step S14). Parenthetically, it goes without saying that the functions $F_1(x), \ldots, F_7(x)$ where x represents variables mentioned above may be stored in a memory in the form of map data, respectively.

Owing to the processing in the step S14, it is possible to supply via the bypass throttle valves 21*a* and 22*a* a minimum amount of air to the engine which can ensure the limp-homing or backup operation. Further, because the main air flow passage 1 is closed during the control of the air flow through the bypass passages 2 and 20, fail-safe can be assured even upon occurrence of abnormality in the first throttle valve device 11.

During the limp-homing operation by resorting to the air supply through the bypass passage, the control unit 7 inhibits the power supply to the air conditioner 6, which contributes to sustaining at least the function for driving the motor vehicle to a service area or the like place (i.e., the limp-homing capability).

So long as the throttle valve 11*a* operates normally, the second bypass throttle valve 22*a* is fully closed. Accordingly, even when a fault takes place in the first bypass throttle valve 21*a* in the fully closed state thereof, unwanted situation such as overrun of the motor vehicle can positively be excluded even when a fault occurs in the first bypass throttle valve 21*a* in the fully opened state thereof, because then the ordinary idling operation can be conducted In conjunction with the steps S13 and S14, it should be mentioned that the engine rotation speed (rpm) N may be controlled through a feedback loop so that it can converge to a target rotation speed which is determined on the basis of the water temperature T, as will be described later on.

Figure 4:
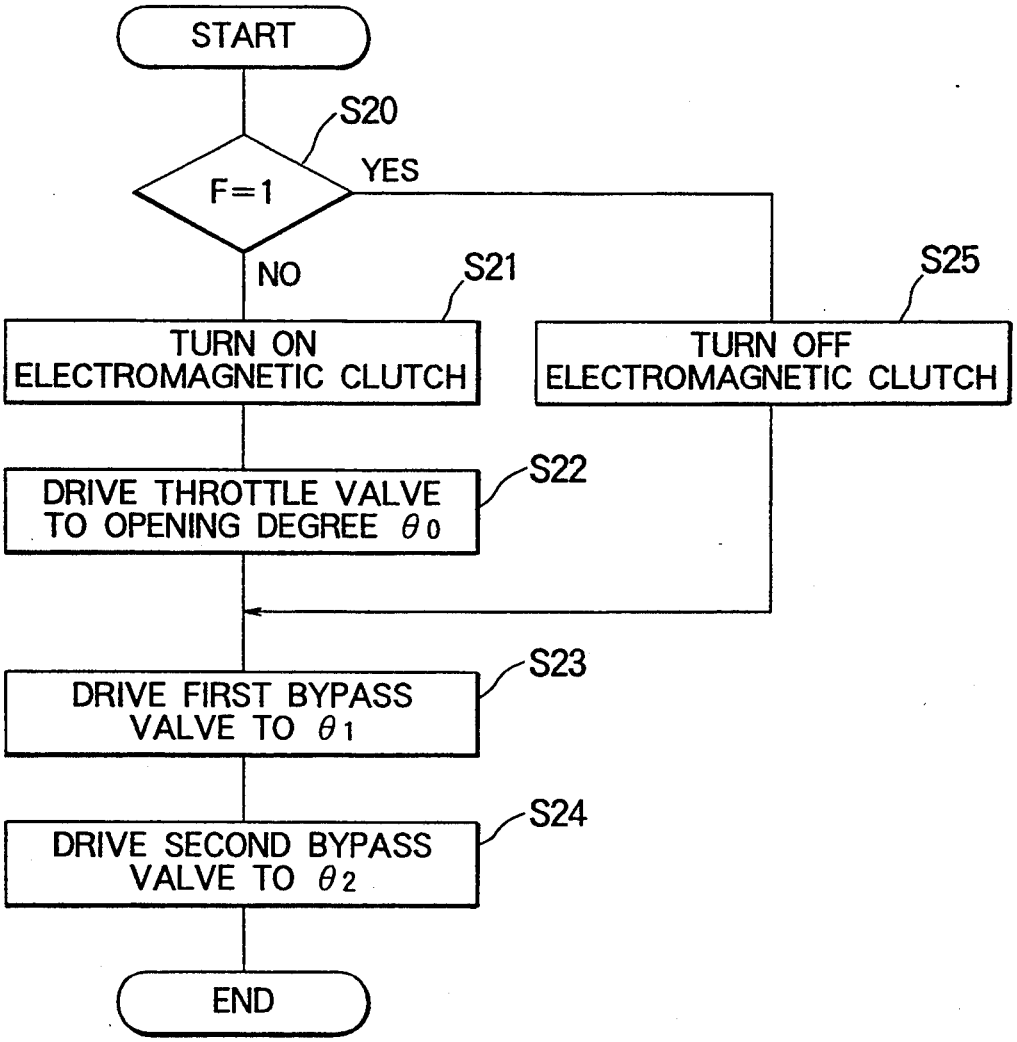
FIG. 4 is a flow chart for illustrating a throttle valve control procedure in the apparatus according to the first embodiment of the invention.

Next, description will turn to the valve control routine illustrated in FIG. 4.

Referring to the figure, in a step S20, decision is made as to whether the abnormality decision flag F is set to "1". When this decision step S20 results in negation (NO) because of the main throttle device 11 being normal, the electromagnetic clutch 11*d* is electrically energized in a step S21 to thereby allow the opening degree $\Theta$ of the throttle valve 11*a* to be set to the target throttle opening degree $\Theta_o$ in a step S22.

Additionally, the first bypass throttle valve 21*a* may be driven to a target opening degree $\Theta_1$ in a step S23. Similarly, the second bypass throttle valve 22*a* may also be set to a target throttle opening degree $\Theta_2$ in a step S24.

On the other hand, when the decision step S20 results in affirmation (YES) because of abnormality of the throttle device 11, the electromagnetic clutch 11*d* is deenergized in a step S25 to thereby allow the throttle valve 11*a* to be forcively closed under the influence of the return spring 10, whereupon the processing proceeds to the steps S23 and S24.

The target throttle opening degrees $\Theta_1$ and $\Theta_2$ of the bypass throttle valves 21*a* and 22*a* involved in execution of the steps S23 and S24 are determined, respectively, in the steps S13 and S14 shown in FIG. 3.

Parenthetically, concerning the controls to be actually adopted for driving the bypass throttle valves 21*a* and/or 22*a* upon occurrence of trouble in the main throttle device 11, there may be conceived various methods, as will be described later on in conjunction with other embodiments of the invention. However, in general, such control method should be adopted which can suppress to a minimum shocks the drier experiences upon change-over of the main throttle valve to the bypass throttle valves. Furthermore, in the state where the first throttle device 11 suffers abnormality, drivability of the motor vehicle is generally lowered to such level that the driver can recognize the occurrence of the abnormality. Accordingly, shock due to the change-over to the bypass throttle valves 21*a* and 22*a* may be admitted to some extend.

Embodiment 2

In the case of the intake air flow control apparatus according to the first embodiment, only one throttle device 11 is installed in the main intake air flow passage 1. However, a pair of serially disposed throttle devices 11 and 12 may be installed in association with the main intake air flow passage 1, as described hereinbefore by reference to FIGS. 25 and 26.

Figure 5:
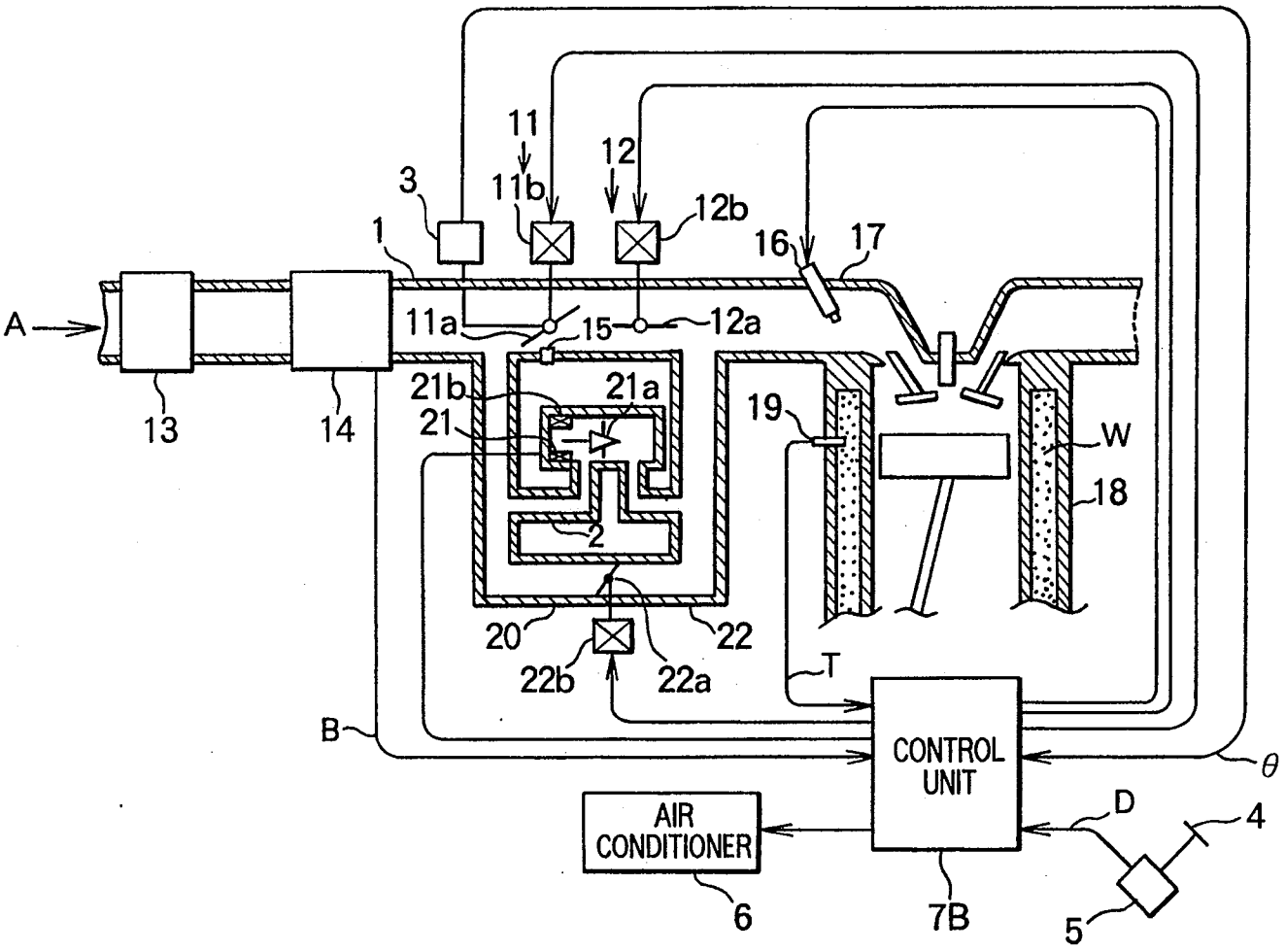
FIG. 5 is a view showing an arrangement of an intake air flow control apparatus according to a second embodiment incarnating the first aspect of the invention.

FIG. 5 is a view showing an arrangement of an intake air flow control apparatus according to a second embodiment of the invention, wherein reference numerals 1 to 6, 11 to 19, 21 and 21*a* denote parts same as or equivalent to those designated by like reference numerals used in the description of the first embodiment. Similarly, reference symbols A, D, T, W and $\Theta$ represent information or signals identical with or equivalent to those used previously.

There is also provided a control unit 7B which corresponds to the control unit 7A except that the former is so designed as to control additionally the second throttle device 12. More specifically, when diagnosis of the first throttle device 11 shows that it suffers abnormality, the control unit 7B closes the second throttle device 12 and controls a bypass air flow control means (described hereinafter) while inhibiting the power supply to the air conditioner 6.

Figure 6A:
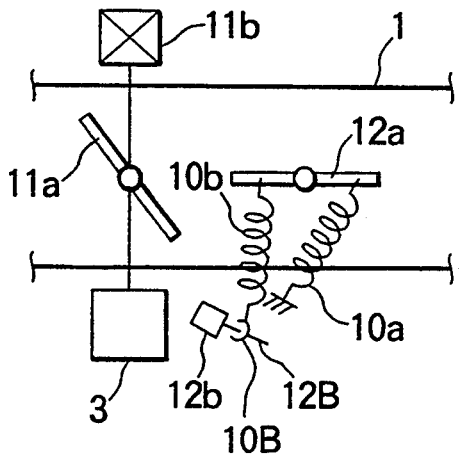
FIGS. 6A and 6B are schematic diagrams for illustrating a second throttle device installed in a main intake air flow passage downstream of a first throttle device in a normal open state and a fully closed state, respectively.
Figure 6B:
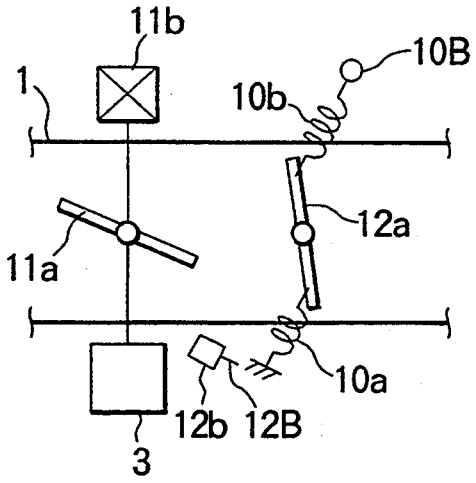

FIGS. 6A and 6B are schematic diagrams showing an exemplary structure of the second throttle device 12 installed in the main air flow passage 1 in a normal open state and a fully close state upon occurrence of a fault, respectively. The actuator 12*b* of the second throttle valve 12*a* is constituted by a solenoid valve including a retractable rod 12B.

Disposed in association with the second throttle valve 12*a* are a pull-up type return spring 10*a* which resiliently urges the solenoid valve 12*a* toward the close position and a pull-up type suspension spring 10*b* which operates to canceling out the spring force exerted by the pull-up type return spring 10*a*, wherein the suspension spring 10*b* is provided with a hook 10B at a free end thereof. More specifically, the suspension spring 10*b* has one end coupled to the second throttle valve 12*a* in opposition to the suspension spring 10*a* and the other end equipped with the hook 10B in which the retractable rod 12B of the solenoid valve 12*b* engages.

In the structure of the second throttle device 12 shown in FIGS. 6A and 6B, so long as no abnormality decision signal is issued by the diagnosis means, the rod 12B of the solenoid valve 12*b* extends outwardly, as can be seen in FIG. 6A, as a result of which the second throttle valve 12*a* is positioned to the fully opened state, which in turn means that the amount of air supply to the engine is controlled in dependence on the opening degree e of the first throttle valve 11*a* disposed upstream of the throttle valve 12A.

On the other hand, in case the abnormality decision signal is issued by the abnormality decision module contained in the control unit 7B, the rod 12B of the solenoid valve 12*b* is retracted, as illustrated in FIG. 6B. Consequently, the second throttle valve 12*a* is set to the fully closed state, whereby the main intake air flow passage 1 is closed. In this manner, when abnormality or fault occurs in the first throttle device 11, only a limited amount of air is supplied to the engine via the bypass passages 2 and 20, whereby unwanted situation such as overrun of the motor vehicle can be prevented.

Next, referring to a flow chart of FIG. 7, description will be made of operation of the intake air flow control apparatus according to the second embodiment of the invention.

Figure 7:
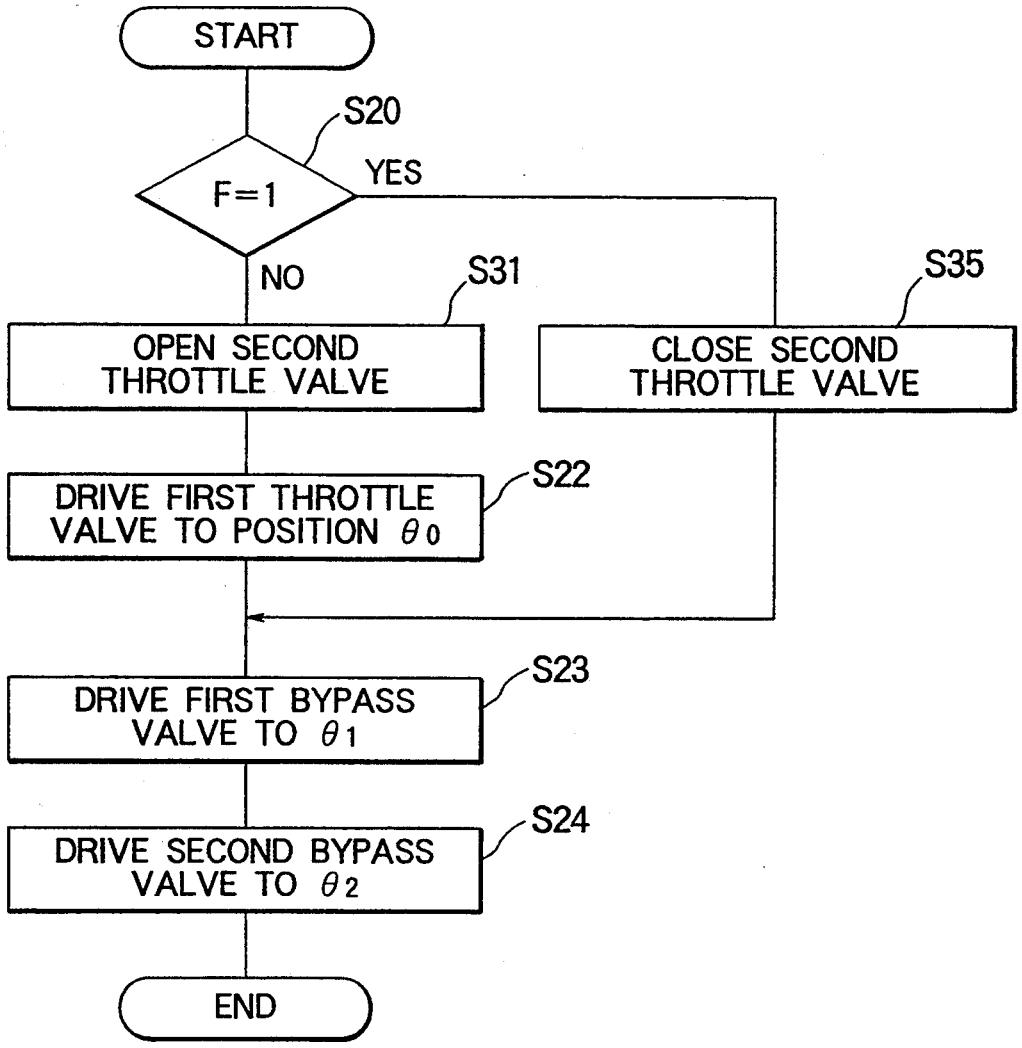
FIG. 7 is a flow chart for illustrating operation of an intake air flow control apparatus according to a second embodiment incarnating the first aspect of the present invention.

In FIG. 7, steps denoted by S20, S22 to S24 are substantially identical with the processing steps designated by like reference characters in FIG. 4. Further, steps S31 and S35 shown in FIG. 7 correspond to those designated by S21 and S25 in FIG. 4, respectively. Further, the target throttle opening setting routine is same as that illustrated in FIG. 3.

Referring to FIG. 7, when the first throttle device 11 is operating normally without suffering any fault and thus when the decision step S20 results in negation (NO), the second main throttle valve 12*a* of the second throttle device 12 is so controlled as to assume the open state in a step S31, whereupon the processing proceeds to a step S22 for controlling the opening degree of the throttle valve 11*a* of the first main throttle device 11.

On the contrary, when the first main throttle device 11 suffers a fault and thus the decision result of the step S20 is affirmative (YES), the second throttle valve 12*a* of the second throttle device 12 is so controlled to be positioned to the closed state in a step S35, whereupon the steps S23 and S24 for controlling the opening degrees of the first bypass valve 21*a* and the second bypass valve 22*a* are executed.

Next, referring to characteristic diagrams illustrated in FIGS. 8 to 12, description will be made of typical methods of controlling the bypass air flow upon detection of abnormality in the first throttle device 11. In each of FIGS. 8 to 12, depression stroke D (magnitude of actuation) of the accelerator pedal is taken along the abscissa while the bypass air flows (gram/sec.) corresponding to the throttle opening degrees $\Theta_1$ and $\Theta_2$ of the first and second bypass valves 21*a* and 22*a* are taken along the ordinate. Further, in each of FIGS. 8 to 12, the air flow controlled by the first bypass throttle valve 21*a* is illustrated in a row (a), while the air flow controlled by the second bypass throttle valve 22*a* is shown illustrated at (b). Finally, in each of the figures, overall bypass air flow controlled through cooperation of the first and second bypass throttle valve 21*a* and 22*a* are illustrated at (c).

In the bypass air flow control effected in the steps S23 and S24 shown in FIG. 7, the changed-over of the intake air flow control from the main throttle device to the bypass air flow control device should be effected in dependence on the depression stroke D of the accelerator pedal so that shock brought about thereby can be suppressed to a minimum. Parenthetically, it should be recalled that the first bypass valve 21*a* and the second bypass valve 22*a* are controlled so as to be set to the respective target opening degrees $\Theta_1$ and $\Theta_2$ in synchronism with each other.

Embodiment 3

Figure 8:
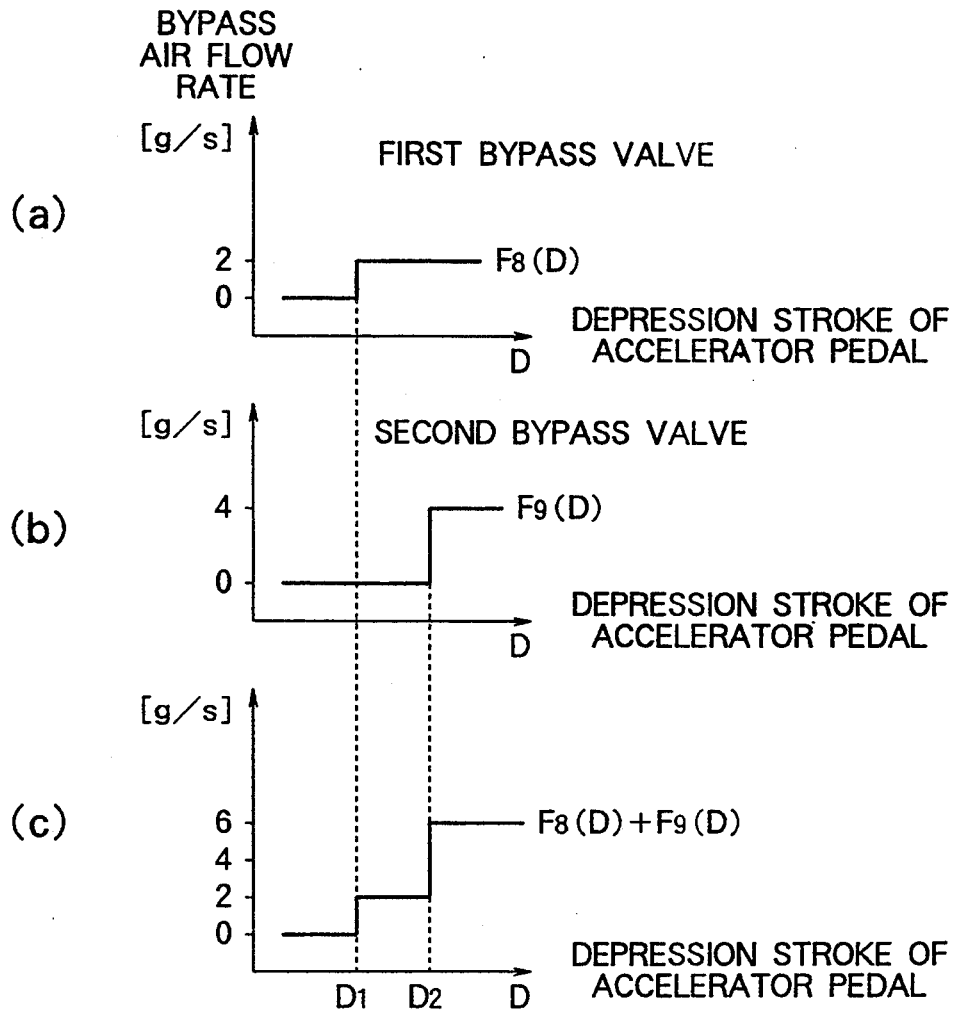
FIG. 8 shows diagrams for illustrating a method of controlling a pair of parallel bypass throttle valves according to a third embodiment incarnating the first aspect of the invention.
Figure 9:
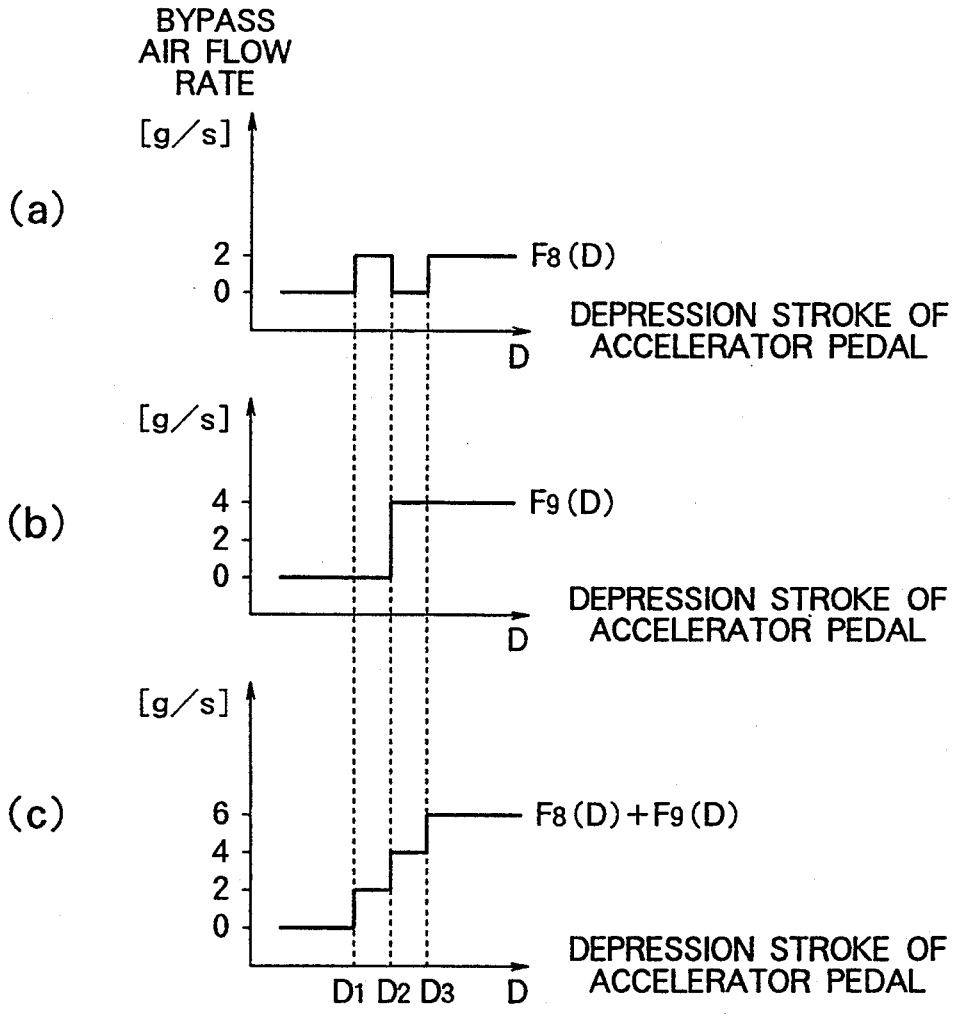
FIG. 9 shows diagrams for illustrating an another example of the method of controlling the paired bypass throttle valves.

The third embodiment of the invention is concerned with a method of controlling the bypass valves 21*a* and 22*a* on the assumption that each of these valves 21*a* and 22*a* is constituted by an on/off-solenoid valve. FIGS. 8 and 9 show characteristic diagrams for illustrating in what manner the control method according to the instant embodiment is carried out.

In the following description directed to the third embodiment, it is assumed that the air flow rate which can be controlled by the second bypass throttle valve device 22 is set to be about twice as large as the air flow rate which the first bypass valve device 22 can control. By way of example, let's assume that when the first bypass throttle valve 21*a* is in the fully opened state, the air flow rate is 2 g/s (abbreviation of gram per second), while the air flow rate in the fully opened state of the second bypass throttle valve 22*a* is 4 g/s.

Referring to FIG. 8 at (a), the first bypass throttle valve 21*a* is set to the fully closed state (i.e., the off-state where the mass air flow rate is 0 g/s) in accordance with the function $F_8(D)$ when the accelerator pedal depression stroke D is smaller than a first predetermined value D1 while the first bypass throttle valve 21*a* is set to the fully opened state (i.e., the on-state where the mass air flow rate is 2 g/s) when the accelerator pedal depression stroke D exceeds the first predetermined value D1. On the other hand, so long as the accelerator pedal depression stroke D is smaller than a second predetermined value D2 which is set greater than the first predetermined value D1, the second bypass throttle valve 22*a* continues to remain in the fully closed state (i.e., the off-state where the air flow rate is 0 g/s) in accordance with a function $F_9(D)$, while the second bypass throttle valve 22*a* is set to the fully opened state (i.e., the on-state where the air flow rate is 4 g/s) when the accelerator pedal depression stroke D exceeds the second predetermined value D2 (which is greater than D1), as is illustrated in FIG. 8 at (b).

The overall bypass air flow rate is controlled in accordance with a combination of the functions $F_8(D)$ and $F_9(D)$ so that it increases stepwise from 0 g/s to 2 g/s and then to 6 g/s at the predetermined values D1 and D2, respectively, as the acceleration pedal depression stroke D increases. At this juncture, it should be mentioned that although the functions $F_8(D)$ and $F_9(D)$ correspond to the functions $F_4(D, T)$ and $F_5(D, T)$ in the step S14 described hereinbefore, they are independent of the water temperature T.

Next referring to FIG. 9, there is used for the bypass air flow control a third predetermined value D3 which is set between the first and second predetermined values D1 and D2 so that the relation "D1<D3<D2" applies valid. In this case, it is assumed that the bypass valves 21*a* and 22*a* assume the fully closed state (off-state) when the accelerator pedal depression stroke D is zero "0" and when the accelerator pedal depression stroke has attained the first predetermined vale D1 as the depression stroke D increases, the first bypass throttle valve 21*a* is set to the on-state (open state), while the second bypass throttle valve 22*a* remains in the off-state unless the third predetermined value D3 is reached. When the third predetermined stroke value D3 is attained, the second bypass throttle valve 22*a* is fully opened while the first bypass valve 21*a* is fully closed. At the time point when the second predetermined value D2 is reached, the first bypass throttle valve 21*a* is set to the open-state again.

In this manner, the overall bypass air flow shown at (c) in FIG. 9 is controlled stepwise from 0 g/s to 2 g/s, from 2 g/s to 4 g/s and then from 4 g/s to 6 g/s at the predetermined values D1, D3 and D2, respectively, as the stroke of the accelerator pedal increases. Thus, by controlling the bypass valves 21*a* and 22*a* in the manner described above by using the third reference value, the bypass air flow can be changed more smoothly when compared with the control method described previously by reference to FIG. 8.

Embodiment 4

Figure 10:
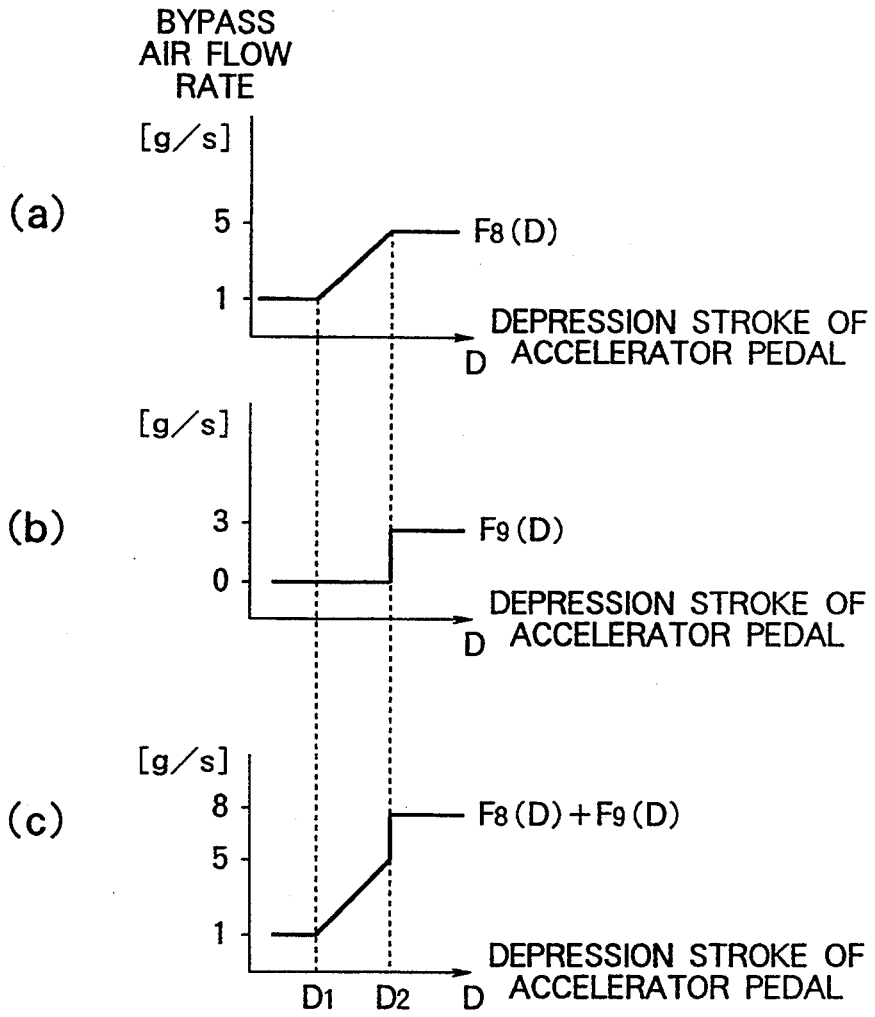
FIG. 10 shows diagrams for illustrating a bypass air control according to a fourth embodiment incarnating the first aspect of the invention.
Figure 11:
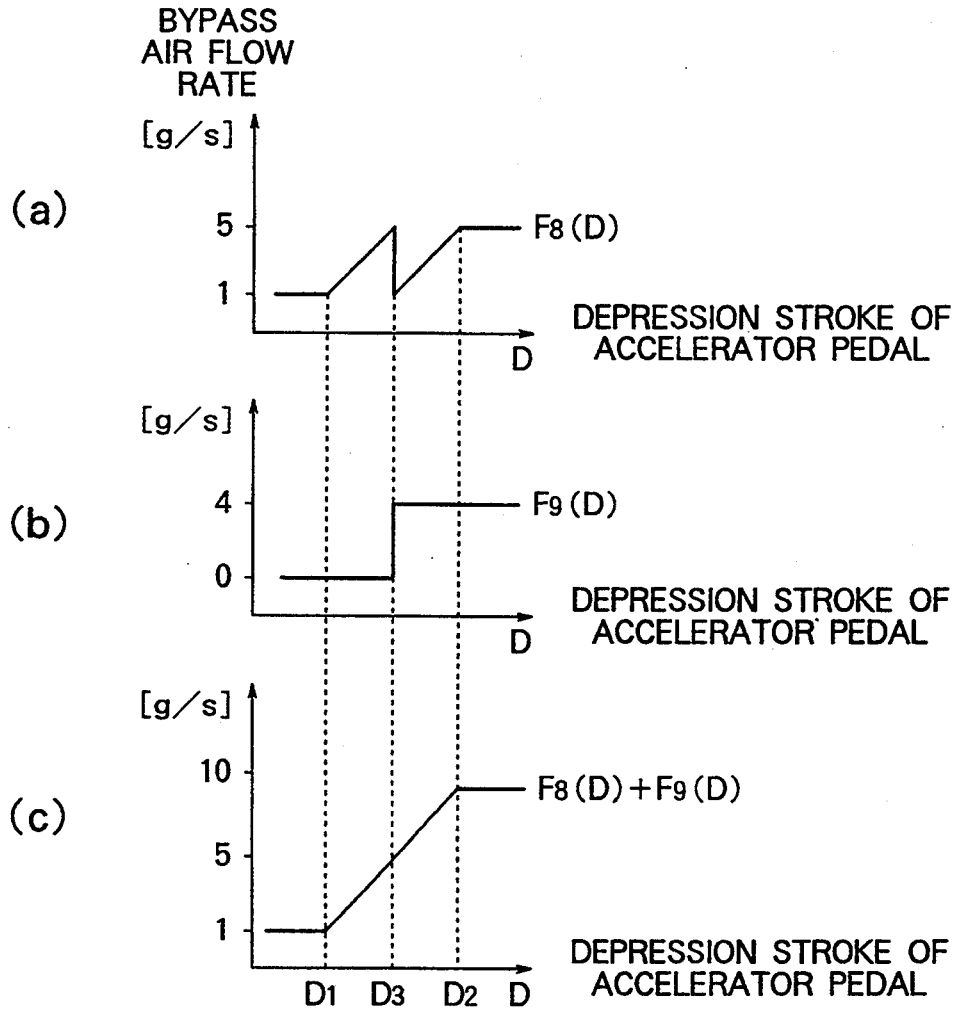
FIG. 11 shows diagrams for illustrating another example of the bypass air flow control according to the fourth embodiment.
Figure 12:
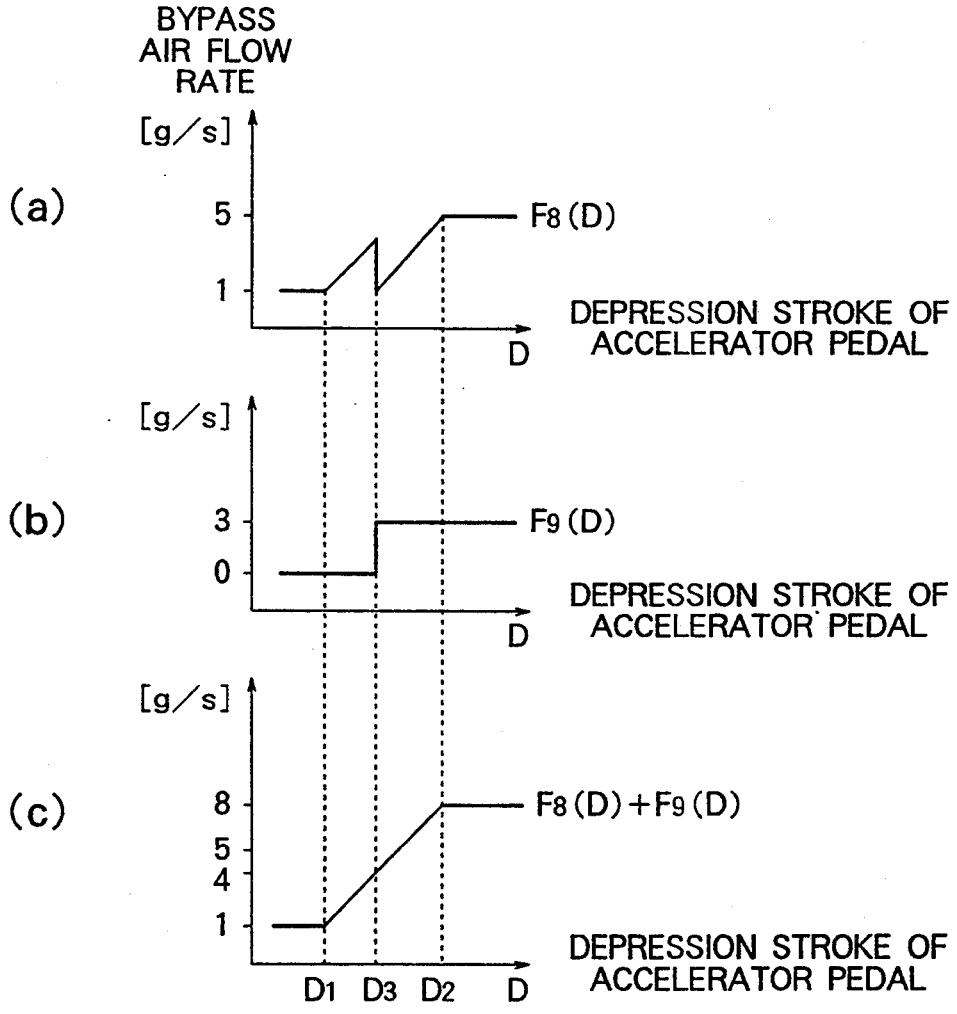
FIG. 12 shows diagrams for illustrating a further example of the bypass air flow control according to the fourth embodiment.

The fourth embodiment is also directed to a method of controlling the first bypass throttle valve 21*a* and the second bypass throttle valve 22*a*. FIGS. 10 to 12 are characteristic diagrams for illustrating the bypass valve controls according to the instant embodiment of the invention. In the intake air flow control now of concern, it is assumed that the first bypass throttle valve 21*a* is constituted by a valve which can be controlled linearly or in a continuous manner such as a linear solenoid valve and that the second bypass throttle valve 22*a* is constituted by an on/off-solenoid valve.

Further, it is assumed that the air flow rate which the first bypass throttle valve 21*a* can control is set within a range of 1 g/s to 5 g/s and that the air flow rate in the fully opened state of the second bypass throttle valve 22*a* is set to 3 g/s in the case of the control method illustrated in FIGS. 10 to 12 while it is set to 4 g/s in the control method illustrated in FIG. 11.

In general, it is difficult to control the air flow rate to zero in the strict sense even in the fully closed state of the valve. Accordingly, it is presumed, by way of example, that the minimum air flow rate which the first bypass throttle valve 21*a* can control is 1 g/s.

Referring to FIG. 10 at (a), the first bypass throttle valve 21*a* is set stationarily to the closed state (where the air flow rate is 1 g/s on the above assumption) when the accelerator pedal depression stroke D is smaller than the first predetermined value D1. At the time point when the accelerator pedal depression stroke D has reached the first predetermined value D1, the air flow through the first bypass throttle valve 21*a* starts to increase. When the accelerator pedal depression stroke D has reached the second predetermined value D2, the first bypass throttle valve 21*a* is set to the fully opened state (where the air flow rate is 5 g/s).

On the other hand, the air flow through the second bypass throttle valve 22*a* is so controlled that when the accelerator pedal depression stroke D is smaller than the second predetermined value D2, the second bypass throttle valve 22*a* is set to the fully closed state (i.e., off-state) where the air flow rate is zero while the valve 22*a* is set to the fully opened state (i.e., the on-state where the air flow rate is 3 g/s) when the accelerator pedal depression stroke D exceeds the second predetermined value D2, as can be seen in FIG. 10 at (b).

Consequently, the overall bypass air flow starts to increase continuously from 1 g/s to 5 g/s when the first predetermined value D1 is reached as the accelerator pedal depression stroke D increases. When the accelerator pedal depression stroke D has attained the second predetermined value D2, the overall air flow increases instantaneously from 5 g/s to 8 g/s, as is illustrated at (*c*) in FIG. 10.

As is apparent from the above description, by switching the second bypass throttle valve 22*a* to the on-state at the second predetermined value D2 which corresponds to the maximum air flow rate of the first bypass throttle valve 21*a*, the bypass air flow can be controlled smoothly.

Parenthetically, the first bypass valve or the continuously controllable valve 21*a* is not limited to the linear solenoid valve. Namely, other valve such as a duty solenoid valve, a rotary solenoid valve, a stepping-motor driven valve, a DC-motor driven valve, a vacuum-motor controlled valve or the like may be employed.

In the case of the bypass air flow control method shown in FIG. 11, the air flow through the first bypass throttle valve 21*a* starts to increase from the flow rate of 1 g/s at the time point when the accelerator pedal depression stroke D has reached the first predetermined value D1, while when the third predetermined value D3 has been attained, the air flow through the first bypass valve 21*a* decreases from a maximum air flow rate of 5 g/s to the flow rate of 1 g/s corresponding to the off-state, as can be seen in FIG. 11 at (*a*).

On the other hand, the second bypass throttle valve 22*a* is switched to the fully opened state (i.e., on-state) from the fully closed state (off-state) at the time point when the accelerator pedal depression stroke D has reached the third predetermined value D3, as is illustrated at (*b*) in FIG. 11.

Thus, the overall bypass air flow rate increases progressively from 1 g/s to 9 g/s as the accelerator pedal depression stroke D increases from the first predetermined value D1 to the second predetermined value D2, as is shown at (*c*) in FIG. 11.

In the case of the control method illustrated in FIG. 12, the air flow through the first bypass throttle valve 21*a* starts to increase at the time point when the accelerator pedal depression stroke D has attained the first predetermined value D1 while decreasing to the flow rate of 1 g/s from the time point when the third predetermined value D3 has been reached, and increases again up to a maximum air flow rate of 5 g/s at the second predetermined value D2 of the accelerator pedal stroke, as shown at (*a*) in FIG. 12.

On the other hand, the second bypass throttle valve 22*a* is switched to the fully opened state (on-state) from the fully closed state (off-state) at the third predetermined value D3 of the accelerator pedal depression stroke D, as shown at (*b*) in FIG. 12.

Accordingly, the overall bypass air flow increases continuously from the flow rate of 1 g/s corresponding to the first predetermined value D1 of the accelerator pedal stroke to the flow rate of 8 g/s corresponding to the second predetermined value D2 as the accelerator pedal depression stroke D increases, as shown at (*c*) in FIG. 12.

In this manner, by constituting the first bypass throttle valve 21*a* and the second bypass throttle valve 22*a* by the continuously controllable valve and the on/off-solenoid valve, respectively, and controlling them in synchronism such that the first bypass throttle valve 21*a* is once set to the closed state at the third predetermined value D3 of the accelerator pedal depression stroke D and caused to increase again, it is possible to control the bypass air flow substantially, smoothly and continuously.

Of course, when both of the first bypass throttle valve 21*a* and the second bypass throttle valve 22*a* are each constituted by the continuously controllable valve, the smoothness or continuity in the bypass air flow rate control can further be enhanced, which will however be impractical from the economical viewpoint.

Embodiment 5

Figure 13:
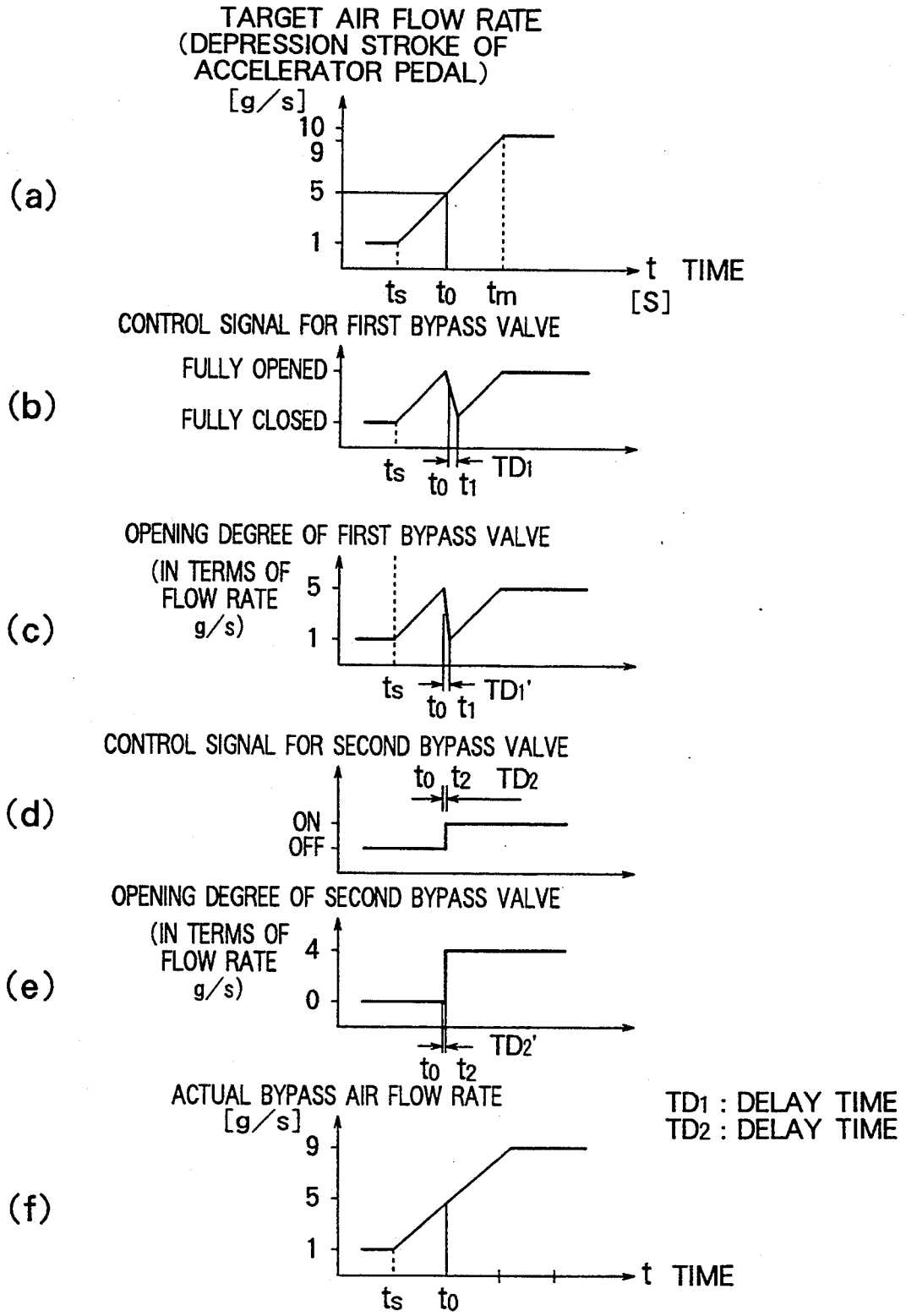
FIG. 13 shows diagrams for illustrating a method of controlling bypass throttle valves according to a fifth embodiment incarnating the first aspect of the invention.
Figure 14:
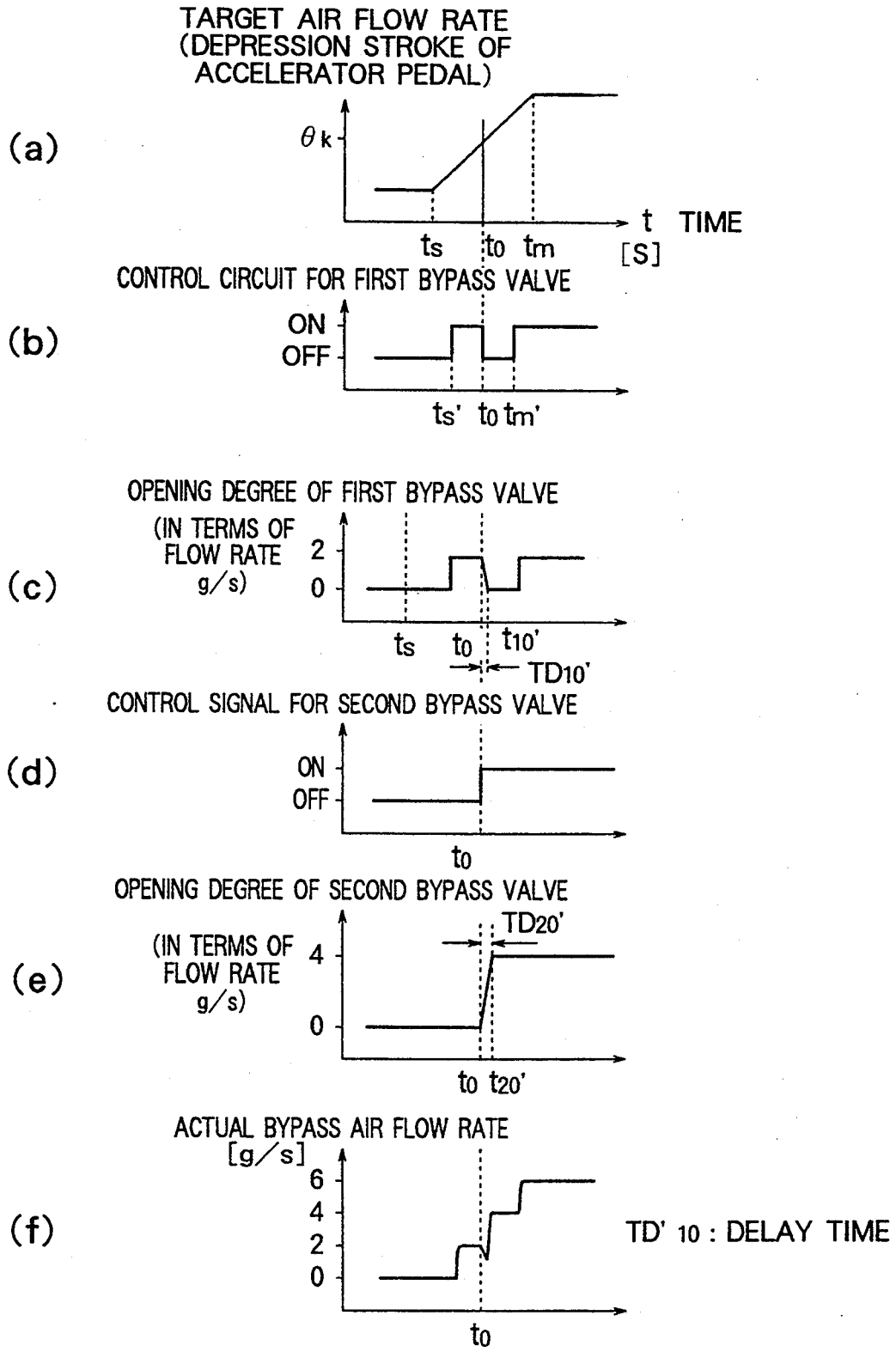
FIG. 14 shows diagrams for illustrating another example of the bypass intake air flow control according to the fifth embodiment.
Figure 15:
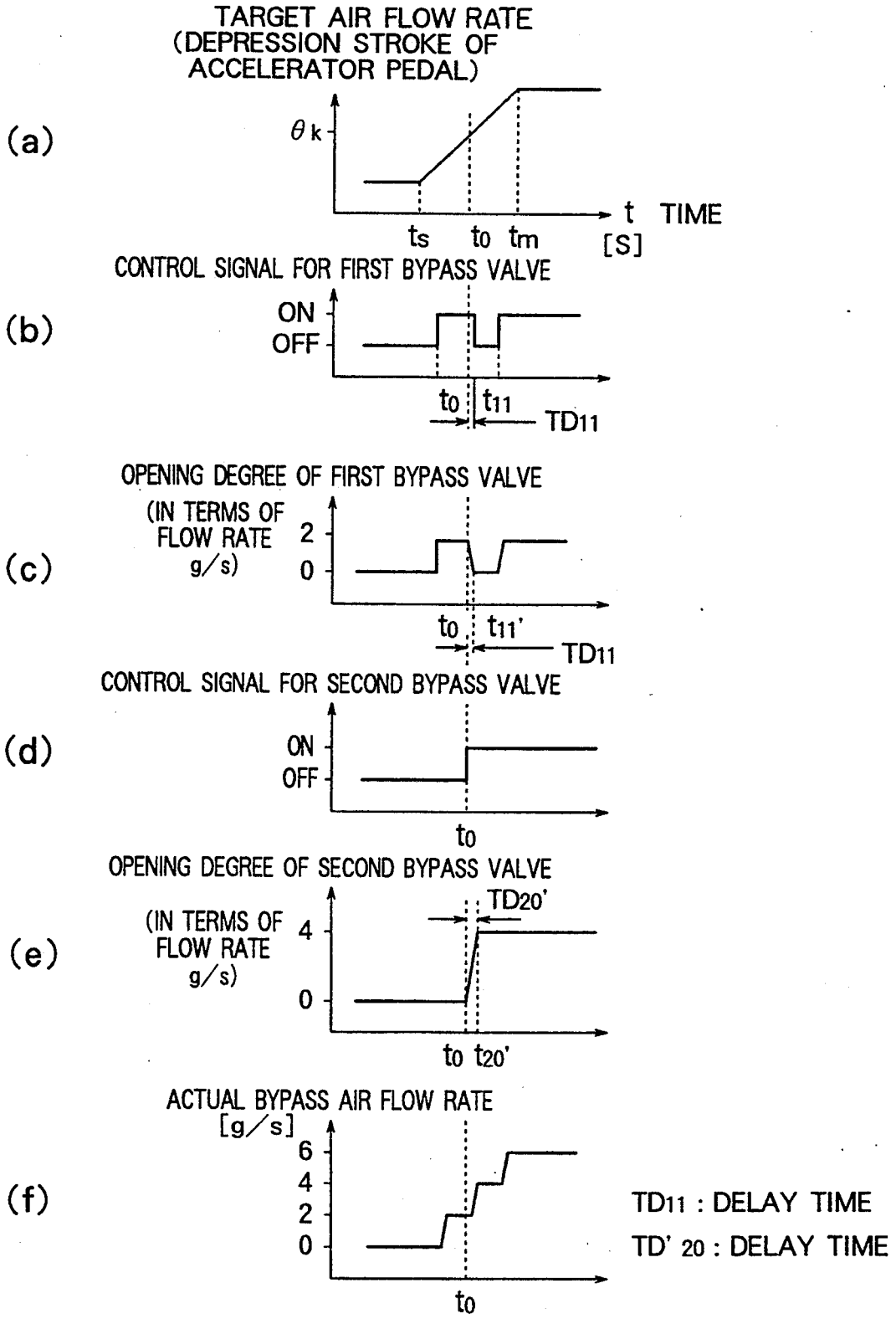
FIG. 15 shows diagrams for illustrating a further example of the bypass intake air flow control according to the fifth embodiment in which delays in operation of bypass valves are taken into consideration.

Next, referring to FIGS. 13 to 15, description will turn to a control of the bypass valve devices according to a fifth embodiment of the invention in which delays involved in operation of the bypass valves are taken into consideration. In FIGS. 13 to 15, the time t is taken along the abscissa while the target air flow (corresponding to the accelerator pedal depression stroke D or the opening degrees $\theta_1$ and $\theta_2$ representing corresponding bypass air flow rates controlled by the first and second bypass valves) is taken along the ordinate on the assumption that the accelerator pedal depression stroke D is increased as a function of lapse of time t.

In each of FIGS. 13 to 15, the target air flow rate (accelerator pedal depression) is shown at (*a*), a control signal for the first bypass throttle valve 21*a* is shown at (*b*), the opening degree of the first bypass throttle valve 21*a* is shown at (*c*), a control signal for the second bypass throttle valve 22*a* is shown at (*d*), the opening degree of the second bypass throttle valve 22*a* is shown at (*e*), and an overall bypass air flow controlled through cooperation of the first bypass throttle valve 21*a* and the second bypass throttle valve 22*a* is shown at (*f*), respectively.

Further, in conjunction with the controls illustrated in FIG. 13 (which corresponds to FIG. 11 described hereinbefore), it is assumed that the first bypass throttle valve 21*a* is constituted by a stepping-motor driven valve with the second bypass throttle valve 22*a* being realized in the form of an on/off-solenoid valve, while in the case of the controls illustrated in FIGS. 14 and 15 (corresponding to FIG. 9 mentioned previously), it is assumed that either one of the first bypass throttle valve 21*a* or the second bypass throttle valve 22*a* is constituted by an on/off-solenoid valve.

Referring to FIGS. 13 at (*a*), it is assumed that the accelerator pedal depression stroke D starts to increase from a time point $t_s$, an air flow rate (e.g. 5 g/s) corresponding to a predetermined value of the accelerator pedal depression stroke D is attained at a time point $t_0$ and that a target air flow rate becomes maximal (e.g. 9 g/s) at a time point $t_m$.

In the above-mentioned case, the control signal for the first bypass throttle valve 21*a* is generated in such a manner as illustrated at (*b*) in FIG. 13. As can be seen, at the time point $t_s$, the first bypass throttle valve 21*a* starts to open progressively from the fully closed state toward the fully opened state. At the time point $t_0$, the first bypass throttle valve 21*a* is controlled in the direction from the fully opened state to the fully closed state, and at a time point $t_1$ after lapse of a delay time TD1 from the time point $t_0$, the first bypass throttle valve 21*a* is controlled again toward the fully opened state which is attained at a time point $t_m$.

In other words, the opening degree of the first bypass throttle valve 21*a* starts to increase from the time point $t_s$ to reach the maximum value (corresponding to the air flow rate of 5 g/s) at the time point $t_0$, while at a time point $t_1'$ after lapse of a delay time TD1', a minimum opening degree (corresponding to the air flow rate of 1 g/s) is realized, after which the opening degree of the first bypass throttle valve 21*a* again starts to increase to reach the maximum value corresponding to the flow rate of 5 g/s at the time point $t_m$, as illustrated in FIG. 13 at (*c*).

Although the first bypass valve control signal (b) and the first bypass valve opening degree (c) are shown as increasing and decreasing continuously, it should be understood that this is only for the sake of convenience of description. In actuality, because the first bypass throttle valve 21*a* is assumed as being constituted by a stepping-motor driven valve, the first bypass valve control signal (b) as well as the first bypass valve opening degree (c) changes stepwise or in a saw-tooth waveform.

The delay time involved in the operation of the stepping motor can practically be neglected. Accordingly, the waveform shown at (c) in FIG. 13 substantially coincides with that shown at (b) in FIG. 13. This in turn means that the actual delay time TD1' involved in the operation of the first bypass throttle valve 21*a* is approximately equal to the delay time TD1 set for the control signal with the time point $t_1'$ coinciding approximately with the time point $t_1$.

However, because the stepping motor for driving the first bypass throttle valve 21*a* has a maximum driving cycle encompassing about 100 steps/sec., there arises a significant delay time TD1 ($\approx$TD1') for driving the first bypass throttle valve 21*a* from the fully opened state to the fully closed state, as can be seen in FIG. 13 at (*b*) and (*c*).

On the other hand, the control signal for the second bypass throttle valve 22*a* is generated in such a waveform as illustrated at (*d*) in FIG. 3. As can be seen, the second bypass throttle valve 22*a* is changed over from the fully closed state to the fully opened state at a time point $t_2$ after lapse of a delay time TD2' (<TD1) from the time pint $t_0$. At this juncture, it should be mentioned that the delay time TD2 of the control signal (d) for the second bypass throttle valve 22*a* is previously so set as to correspond to the delay time TD1' of the first bypass throttle valve 21*a*.

For the reasons mentioned above, the second bypass throttle valve 22*a* assumes a maximum opening degree (corresponding to the air flow rate of 4 g/s) after lapse of a predetermined time TD2' (corresponding to a sum of the control signal delay time TD2 and the valve operation delay time) from the time point $t_0$, as can be seen in FIG. 13 at (e). In general, the response speed of the on/off-solenoid valve is higher than that of the stepping-motor driven valve, involving thus a delay time in actual operation. Consequently, the predetermined time TD2' mentioned above will become longer than the delay time TD2 set for the control signal (d) for the second bypass throttle valve 22*a*, resulting in that the time point $t_2'$ lags relative to the time point $t_2$.

Thus, the second bypass throttle valve 22*a* is controlled by the control signal with a delay TD2 which accommodates therein the delay time TD1 involved in operation of the stepper motor as well as the delay time in operation of the second bypass throttle valve 22*a* itself.

In this conjunction, it is to be noted that the delay time TD2 may be so set that the time point $t_2'$ at which the second bypass throttle valve 22*a* is actually put into operation lies at a mid point of the period during which the first bypass throttle valve 21*a* is operated at the fully closed state (i.e., the period from $t_0$ to $t_1'$) with a view to suppressing to a minimum the shock due to the valve switching after the time point $t_0$.

More specifically, the control signal for the second bypass throttle valve 22*a* is switched at the time point $t_0$, which is followed by switching of the control signal for the second bypass throttle valve 22*a* at a time point $t_2$ after lapse of the delay time TD2 from the time point $t_2$, wherein the second bypass throttle valve 22*a* is driven to the fully opened state at the time point $t_2'$ during a period in which the first bypass throttle valve 21*a* is operated in the fully closed state. At that time, the predetermined time TD2' covering the delay in operation of the second bypass throttle valve 22*a* is set approximately to a half of the delay time TD1' which the first bypass throttle valve 21*a* experiences in activation thereof.

Thus, when the opening degree of the first bypass throttle valve 21*a* has attained an intermediate vale (corresponding to 3 g/s) in the course of control for setting the first bypass throttle valve 21*a* to the fully closed state, the second bypass throttle valve 22*a* is fully opened. In this manner, the overall bypass air flow is controlled substantially smoothly without any appreciable shock, as shown in FIG. 13 at (*f*).

In FIG. 13 at (*e*), the waveform representing operation of the second bypass throttle valve 22*a* is shown in a rectangular waveform. However, in actuality, the waveform representing operation of the on/off-solenoid valve has a slope. Accordingly, it should be understood that the overall bypass air flow can further be smoothed. Thus, the driver of the motor vehicle will scarcely experience shocks even when the first bypass throttle valve 21*a* and the second bypass throttle valve 22*a* are operated in dependence on actuation of the accelerator pedal.

When the linear solenoid valve is used as the first bypass throttle valve 21*a* in place of the stepping-motor driven valve, the delay time involved in operation will become extremely shorter than the delay time TD1 shown at (*b*) in FIG. 13. However, since the delay time cannot be nullified in any case, it goes without saying that an optimal delay time TD2 should be set for the second bypass throttle valve 22*a* by taking into account the response performance of the first bypass throttle valve 21*a*.

In the foregoing, description has been made concerning the control of the bypass valves by taking as example the acceleration mode in which the accelerator pedal depression stroke D increases as a function of time lapse. It should however be understood that the control method described above is equally applicable to the deceleration control where the accelerator pedal depression stroke D is decreased as a function of time and is effective for mitigating shock which may otherwise make the driver uncomfortable.

Next, a delay time control will be elucidated in the case where the first bypass throttle valve 21*a* and the second bypass throttle valve 22*a* are each constituted by an on/off-solenoid valve by reference to FIGS. 14 and 15, in which FIG. 14 shows a case where no delay time control is effected and FIG. 15 shows a case in which a delay time control is performed.

In FIGS. 14 and 15, symbols $t_s$, $t_o$ and $t_m$ represent the time points mentioned hereinbefore, while $t_{10}'$ and $t_{20}'$ correspond to the time points $t_1'$ and $t_2'$ shown in FIG. 13 at which the first bypass throttle valve 21*a* and the second bypass throttle valve 22*a* are operated, respectively. Further, TD10' and TD20' represent delay times TD1' and TD2' which are involved in the operation of the bypass valves 21*a* and 22*a*, respectively. Further, in these figures, a reference symbol $t_s'$ designates a time point at which the first bypass throttle valve 21*a* is first set to the fully opened state, while a symbol $t_m'$ designates a time point at which the first bypass throttle valve 21*a* is set to the fully opened state again after it has once assumed the fully closed state.

In the description which follows, it is assumed that the air flow rate (e.g. 2 g/s) capable of being controlled by the first bypass throttle valve 21*a* is smaller than that controllable by the second bypass throttle valve 22*a* (e.g. 4 g/s), the response speed of the second bypass throttle valve 22*a* is lower than that of the first bypass throttle valve 21*a* and that the delay times TD10′ and TD20′ bear such relation to each other that TD10′<TD20′.

It is again assumed that the first bypass throttle valve 21*a* is controlled toward the fully opened state at the time point $t_s'$ in dependence on the accelerator pedal depression stroke D and that the accelerator pedal depression stroke D attains a predetermined value at the time point $t_o$ with the target air flow rate reaching a predetermined value (corresponding to a predetermined bypass valve opening degree ($\theta_k$)), as shown in FIG. 14 at (*a*) and FIG. 15 at (*a*).

In this case, it is necessary to close completely the first bypass throttle valve 21*a* while opening completely the second bypass throttle valve 22*a*. However, because the delay times TD10′ and TD20′ involved in activation of the first bypass throttle valve 21*a* and the second bypass throttle valve 22*a* differ from each other, the switching time points $t_{10}'$ and $t_{20}'$ will differ from each other even when the control signals for the first bypass throttle valve 21*a* and the second bypass throttle valve 22*a* are turned on at the same time.

Consequently, the first bypass throttle valve 21*a* will be set to the fully closed state before the second bypass throttle valve 22*a* is fully opened, as a result of which the actual bypass air flow decreases steeply immediately after the time point $t_o$, giving rise to generation of a switching shock due to disturbance of the air flow, as shown in FIG. 14 at (*f*).

However, by validating in precedence the control signal for the second bypass throttle valve 22*a* having a longer delay time (TD20′) at the time point $t_o$ and invalidating the control signal for the first bypass throttle valve 21*a* having a shorter delay time (TD10′) at a time point $t_o$, $t_{11}$ after lapse of the delay time TD11 from the time point it is possible to make the operation time points $t_{20}'$ and $t_{11}'$ approximately coincide with each other.

More specifically, by setting the delay time TD11 as shown in FIG. 15 at (*b*) so that the operation delay time TD20′ of the second bypass throttle valve 22*a* shown at (*e*) in FIG. 15*a* coincides at least approximately with the delay time TD11′ of the first bypass throttle valve 21*a* shown in FIG. 15 at (*c*), there applies valid the undermentioned relation between the delay time TD11 and the delay times TD11′ and TD20′. Namely, $$TD11' = TD11 + TD10' \approx TD20'$$

As a result of the coordinated control described above, the first bypass throttle valve 21*a* assumes the fully closed state at the time point $t_{11}'$ after lapse of the predetermined time TD11′ (=TD11+TD10′) from the time point $t_o$, wherein the time point $t_{11}'$ essentially coincides with the time point $t_{20}'$ at which the second bypass throttle valve 22*a* is fully opened (FIG. 15, (*e*)), as can be seen from FIG. 15 at (*c*).

In this way, the bypass air flow rate can be controlled stepwise without being accompanied with any steep change after the time point to, as shown in FIG. 15 at (*f*), whereby shock due to the change of the air flow can be minimized.

It should here be mentioned that the bypass valve control in which the delay times TD2 and TD11 are taken into account, as described above by reference to FIGS. 13 and 15, can be equally be applied to the feedback control of the idling engine rotation speed (rpm) without being limited to the air flow control effected upon occurrence of abnormality in the main air flow control means 11 provided in association with the main intake air passage 1.

Embodiment 6

Figure 16:
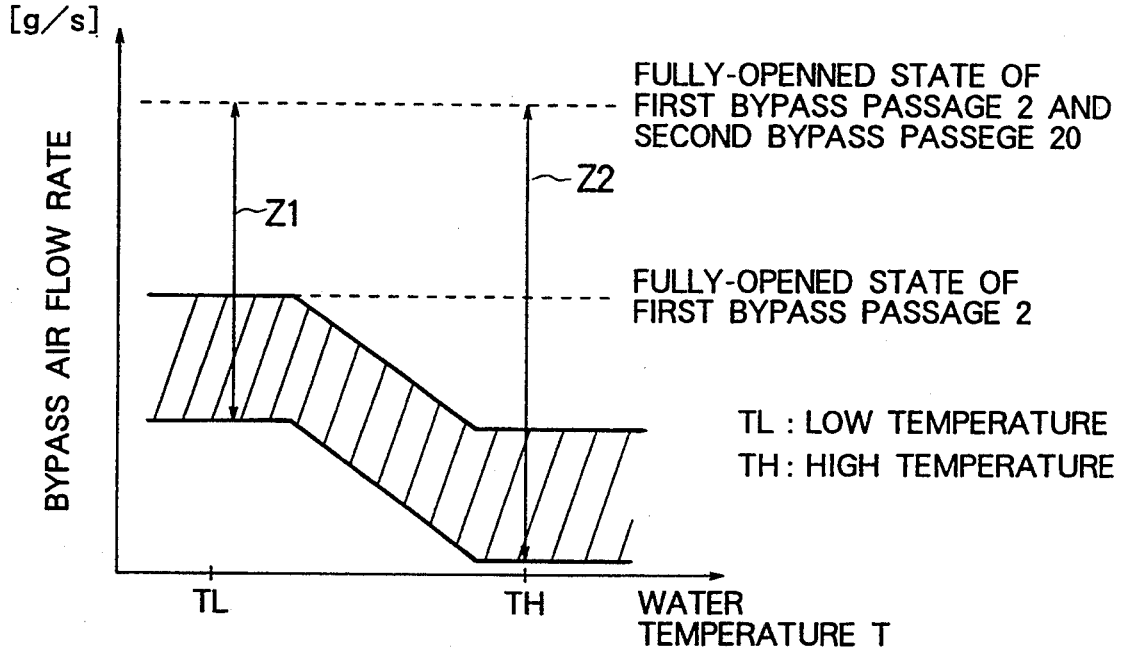
FIG. 16 is a diagram for graphically illustrating a relation between cooling water temperature and bypass air flow rate, which is referenced in carrying out a bypass air flow control according to a sixth embodiment incarnating the first aspect of the invention.
Figure 17:
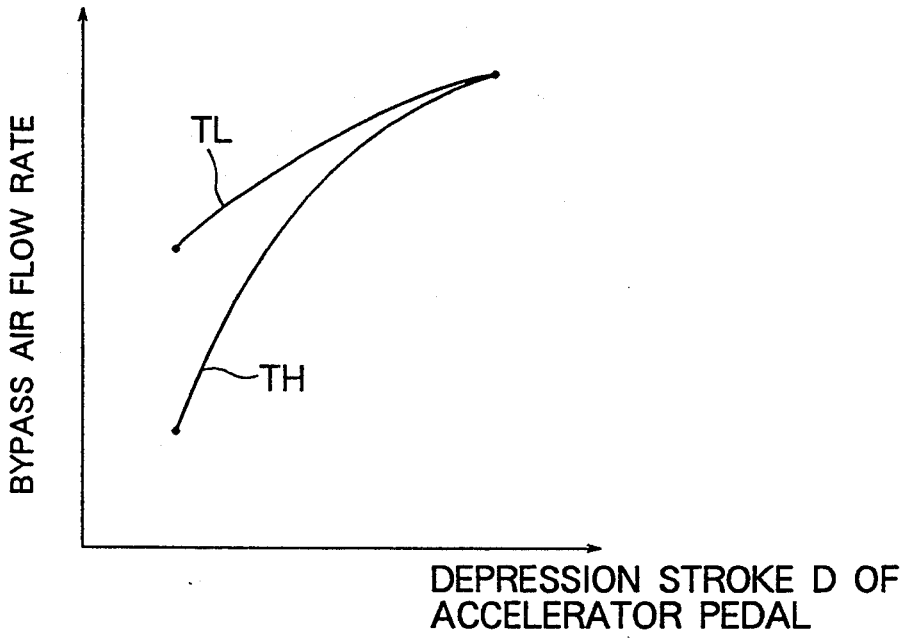
FIG. 17 is a diagram for graphically illustrating relations between bypass air flow rate and depression stroke of accelerator pedal at different engine temperatures, respectively, which is referred to in the control according to the sixth embodiment.

Next, by referring to FIGS. 16 and 17, description will turn to a variable control of the bypass air flow in which the coolant water temperature T is taken into account on the assumption that the first bypass throttle valve 21*a* is constituted by a continuously controllable valve driven by, for example, a stepping motor while the second bypass throttle valve 22*a* is realized in an on/off solenoid valve.

FIG. 16 is a characteristic diagram for illustrating a relation between the water temperature and the air flow rate (generally known as the wax characteristic), wherein a hatched area represents a control range of the bypass air flow in the idling operation, broken-lines represent maximum bypass air flows when only the bypass passage 2 is fully opened and when both the first and second bypass passages 2 and 20 are fully opened, respectively, a symbol Z1 designates a range in which the bypass air-flow through the first and second bypass passages are controlled at a low temperature TL of the cooling water, and Z2 designates a range in which the bypass air flows through the first and second bypass passages are controlled when the coolant temperature is high (TH). In general, in the state where combustion capability of the engine cylinder is lowered at low water temperature T, it is required to increase the bypass air flow.

FIG. 17 is a characteristic diagram for illustrating relations of the bypass air flow rate to the accelerator pedal depression stroke D, wherein curves TL and TH represents bypass air flow characteristics at a low temperature TL and a high temperature TH, respectively. As can be seen in FIGS. 16 and 17, the bypass air flow rate is set to be large within a range of the low temperature TL which being set small within a range of the high temperature TH.

When the first throttle device 11 servings as the main air flow control means is operating normally, the second bypass throttle valve 22*a* is closed fully. In the idling operation mode, the first bypass throttle valve 21*a* controls the bypass air flow rate within a range represented by the hatched area in FIG. 16. In other words, there can be realized a fast idling characteristic (i.e., the operation characteristics that the bypass air flow rate become high within a range of the low temperature TL while it decreases as the temperature increases) as well as an idling speed control function (i.e., the function for controlling the bypass air flow as a function of the engine load).

When the first throttle device 11 suffers trouble, the first throttle device 11 or the second throttle device 12 is fully closed, whereon the bypass air flow control is performed in dependence on the accelerator pedal depression stroke D with the aid of the first bypass throttle valve 21*a* and the second bypass throttle valve 22*a*, as described previously. This bypass air flow control is effective over wide ranges Z1 and Z2 at low and high engine temperatures, respectively, so that the wax function and the limp-homing (backup) operation mode can be sustained.

As can be seen from FIG. 17, the relation of the bypass air flow rate to the accelerator pedal depression stroke D shows different characteristics in dependence on the water temperature T. In other words, within the low temperature range TL, the bypass air flow rate is set relatively high even for a small depression stroke D of the accelerator pedal, while a low bypass air flow is set for the small depression stroke of the accelerator pedal in the high temperature range TH.

Embodiment 7

This embodiment is directed to an engine control apparatus which can ensure a fuel injection control function even in the state where the main intake air flow control means suffers abnormality.

Figure 18:
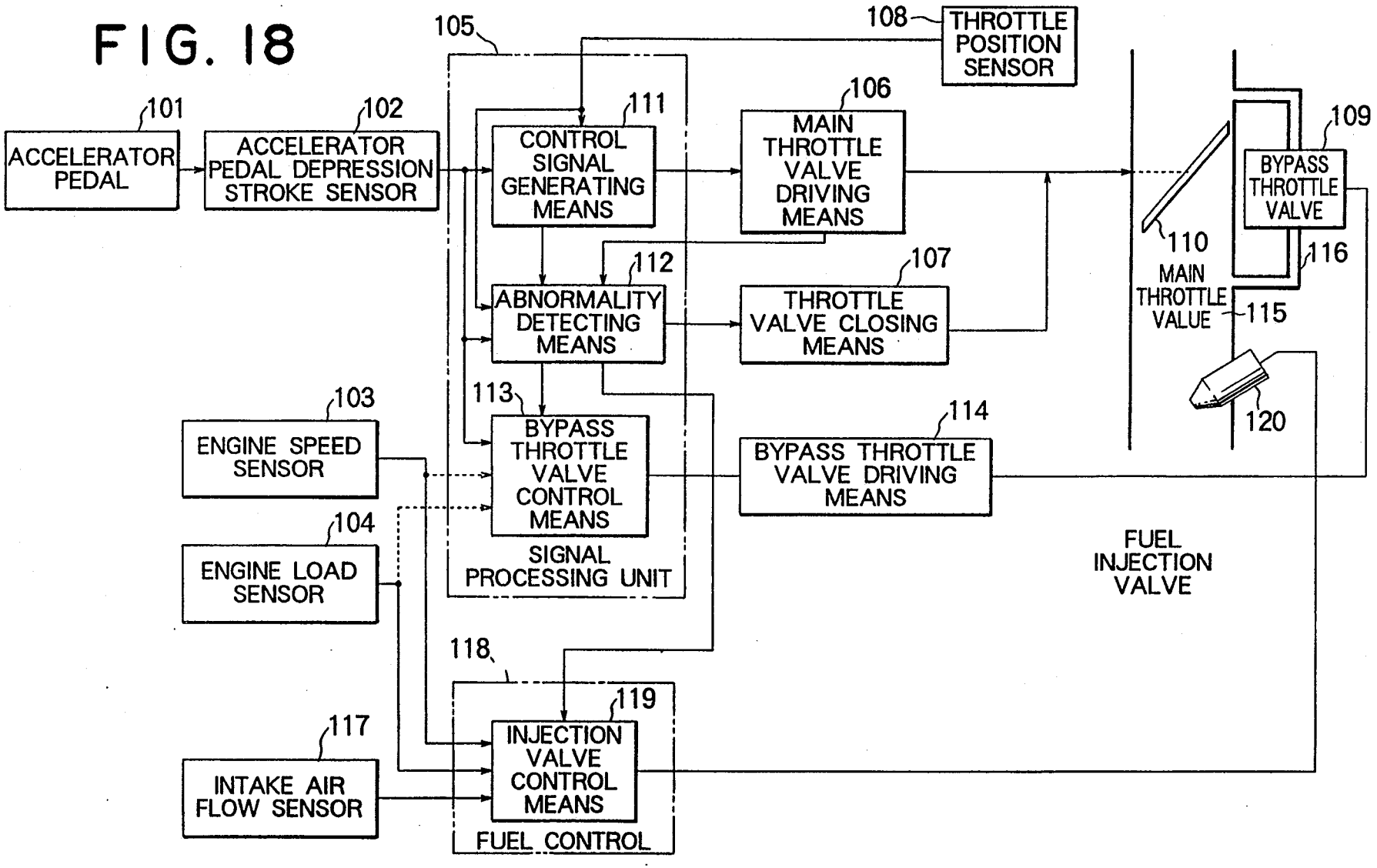
FIG. 18 is a block diagram showing a general arrangement of a control apparatus for an internal combustion of a motor vehicle according to a seventh embodiment which incarnates the second aspect of the present invention.

FIG. 18 shows in a schematic block diagram a general arrangement of a control apparatus for an internal combustion according to a seventh embodiment which incarnates the second aspect of the present invention.

Figure 30:
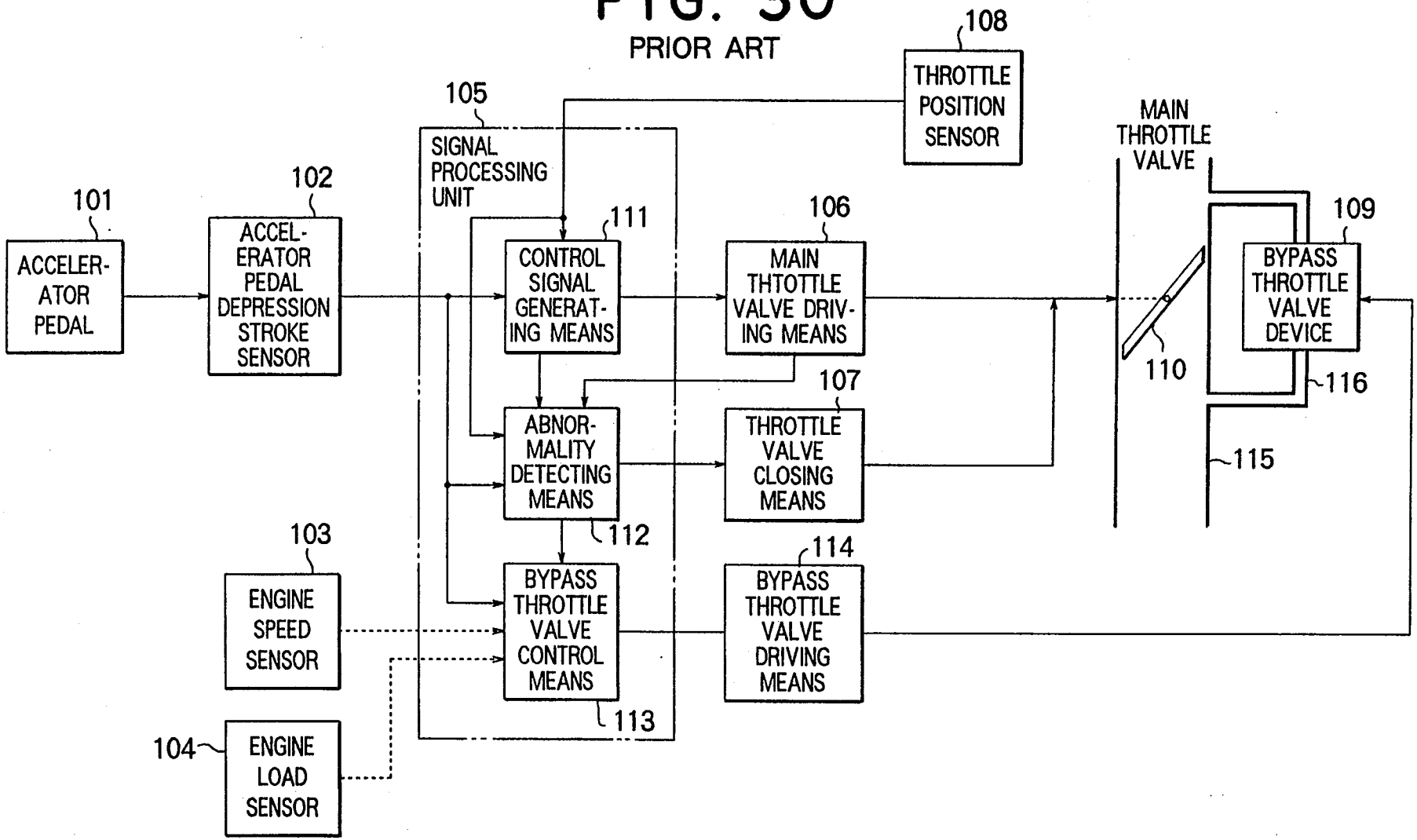
FIG. 30 PRIOR ART
FIG. 30 is a schematic block diagram showing another known control apparatus for an internal combustion engine.
Figure 31:
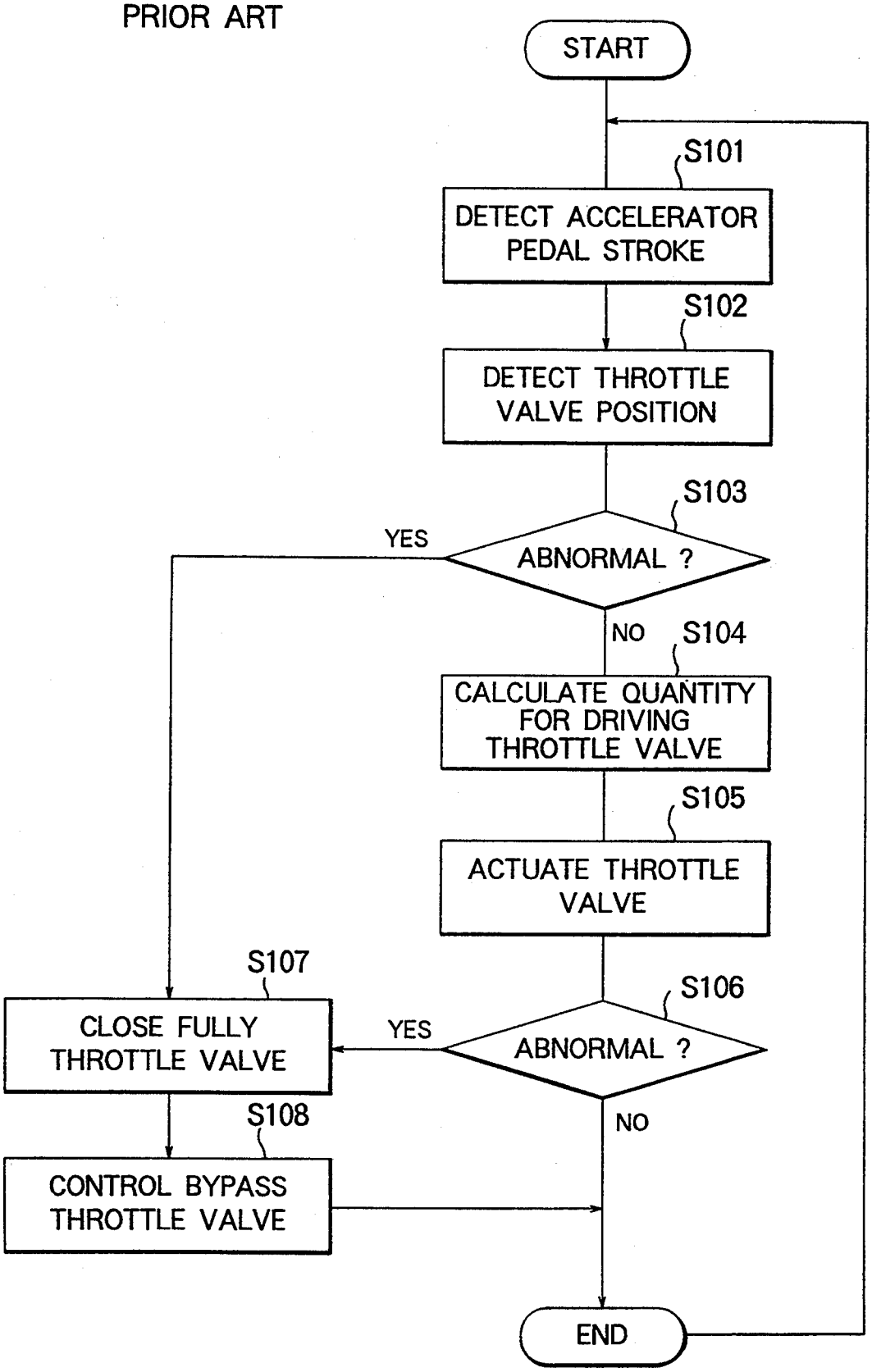
FIG. 31 PRIOR ART
FIG. 31 is a flow chart for illustrating an intake air flow control method known heretofore.

Referring to the figure, the main control system, the abnormality detecting system and the auxiliary control system are implemented, respectively, in substantially same structures of those described hereinbefore in conjunction with the related art by reference to FIG. 30. Accordingly, repeated description of these systems will be unnecessary.

In the control apparatus according to the instant embodiment, the control means which constitutes a part of the engine control unit 105 corresponding to that denoted by the reference numeral 7A in the description of the first embodiment are supplied with not only an engine rotation speed (rpm) signal from an engine speed sensor 103, an intake air flow signal from an intake air flow sensor 117 and an engine load state signal from an engine load sensor 104 but also an abnormality signal from the abnormality detecting means 112, if issued. A fuel control means 118 is so designed as to change over a normal engine operation range or a normal fuel injection range to a limp engine operation range (a limp fuel injection range) when the abnormality signal indicative of occurrence of abnormality or a fault in the main intake air flow control means (including the main throttle valve 115) and/or devices associated therewith is issued from the abnormality detecting means 112.

The change-over or switching of the engine operation range mentioned above is realized by changing the fuel injection range in dependence on the engine speed (rpm). More specifically, so long as the main intake air flow control or regulating means (including the main throttle valve 110) is operating normally, the fuel injection to the engine is effected within a range which is permissible in view of the engine speed (rpm). However, in the case where abnormality or trouble takes place and the function of the main intake air flow control means is thereby transferred to the bypass or auxiliary intake air flow control means, the fuel injecting operation of the injection valve control means 119 is stopped when the engine rotation speed increases up to about 2500 rpm. The limp operation range or limp fuel injection range is thus so determined that an upper limit thereof corresponds to the engine speed of about 2500 rpm and that when this upper limit is exceeded, the fuel injection is stopped. In practical applications, the engine speed lower than 2500 rpm is sufficient for guaranteeing the limp-homing operation mode of the motor vehicle described hereinbefore.

By virtue of the switching of the fuel injection range between the normal operation state and the abnormal state of the main intake air control means (main throttle valve device 110), steep increase in the engine speed and thus overrun of the motor vehicle possibly brought about by a delay involved in the activation of the bypass air flow control means for the reason described previously in conjunction with the related art can be prevented by stopping the fuel injection when the upper limit thereof is exceeded.

Figure 19:
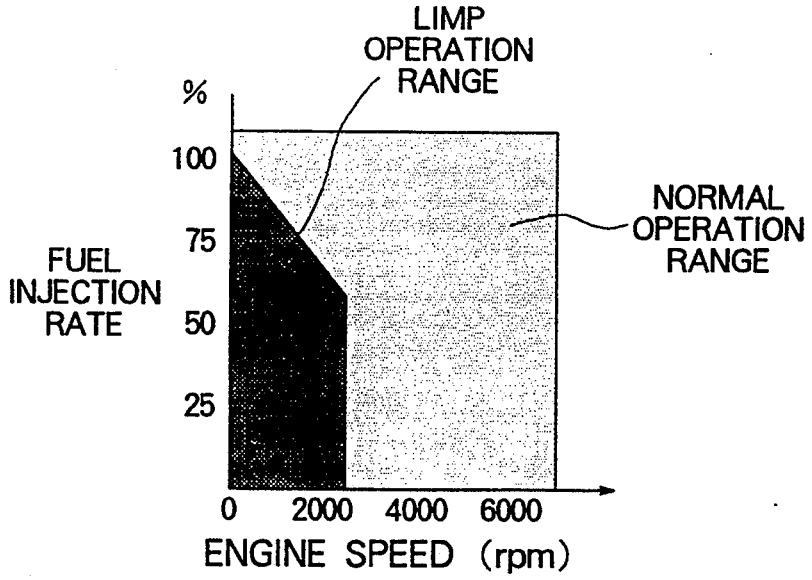
FIG. 19 is a diagram for graphically illustrating fuel injection ranges in normal and abnormal operation states, respectively, of an intake air flow system.

The normal operation range and the limp operation range are illustrated in FIG. 19. The reason why the charging efficiency in the limp fuel injection range decreases as the engine speed (rpm) increases can be explained as follows. In general, the upper limit of the intake air flow controlled by the auxiliary or bypass intake air flow control means is generally set at a relatively low level, and thus the intake air flow rate is easy to reach the upper limit. Accordingly, it is necessary to decrease the fuel charging efficiency as the engine speed increases.

Next, operation of the fuel control apparatus according to the instant embodiment will be described by reference to FIG. 20, being understood that the procedure for controlling the intake air flow is substantially same as described hereinbefore in conjunction with the preceding embodiments.

Figure 20:
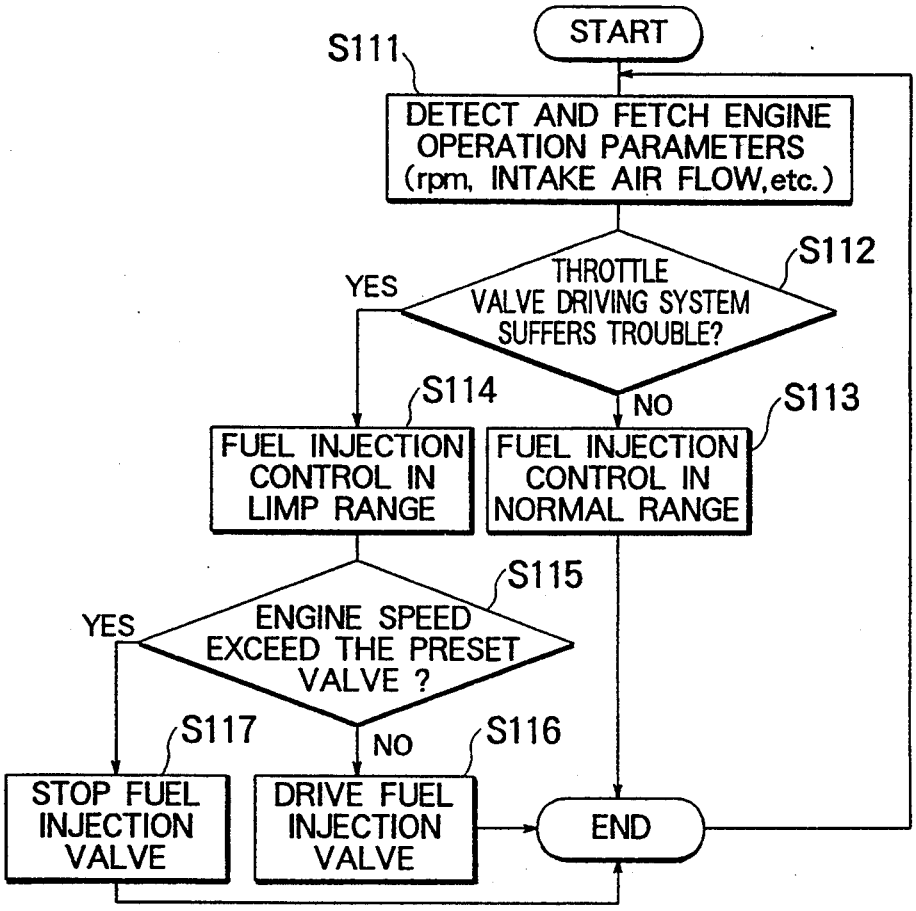
FIG. 20 is a flow chart for illustrating an intake air flow control method carried out by the control apparatus according to the seventh embodiment of the invention.

Referring to FIG. 20, in a step Sill, information of the engine states such as the intake air flow rate, the engine speed (rpm) and others are fetched.

Further, in a step S112, decision is made as to whether the signal indicative of abnormality of the main intake air flow control means (i.e., the main throttle valve 110 as well as the driving system therefor is issued by the abnormality detecting means 112 and inputted to the fuel control means 118. When this decision step S112 results in negation (NO), the fuel control is performed within the normal fuel injection range (labelled "NORMAL OPERATION RANGE") shown in FIG. 19 in dependence on the intake air flow, the engine speed and other parameters in a step S113. On the other hand, when answer of the decision step S112 is affirmative (YES), the fuel injection control is then performed within the limp fuel injection range (LIMP OPERATION RANGE) shown in FIG. 19 in a step S114. In this case, the fuel injection control is performed in dependence on the detection output signal of the accelerator pedal depression stroke sensor 102.

Next, in a step S115, it is decided whether or not the engine speed exceeds a predetermined value which is set to e.g. 2500 rpm in the case of the instant embodiment. When the decision in the step S115 is negative (NO), the processing proceeds to a step S116 where the fuel injection is controlled in dependence on the engine speed and the intake air flow controlled by the auxiliary or bypass air flow control means 113 (constituted by bypass valves as described hereinbefore). On the contrary, when the decision in the step S115 is affirmative (YES, the fuel injection through the fuel injection valve 120 is stopped by the fuel control means 118 in a step S115, to thereby prevent the engine speed (rpm) from further increasing.

As a modification of the instant embodiment, the bypass air flow control means 113 may additionally be used as the intake air flow control means in the idling operation mode, as described hereinbefore. In that case, arrangement may be made such that the engine speed signal and engine load signals such as an electric load signal, a power steering signal, an air conditioner signal, etc. are inputted to the bypass throttle valve control means 113, as indicated by broke lines in FIG. 18. Further, although it has been described that the bypass throttle valve control means (i.e., auxiliary intake air flow control means) 113 is incorporated in the signal processing unit 105, the former may be provided independently or alternatively incorporated in the fuel control means 118. Same hold true for the abnormality detecting means 112. Additionally, instead of stopping the engine when the upper limit of the limp fuel injection range is exceeded, other measures such as stopping of some of engine cylinders, change of the ignition timing or the like may equally be adopted.

Embodiment 8

This embodiment is directed to a bypass air flow control apparatus for ensuring the limp-homing (backup) operation mode according to the third aspect of the invention.

Figure 21:
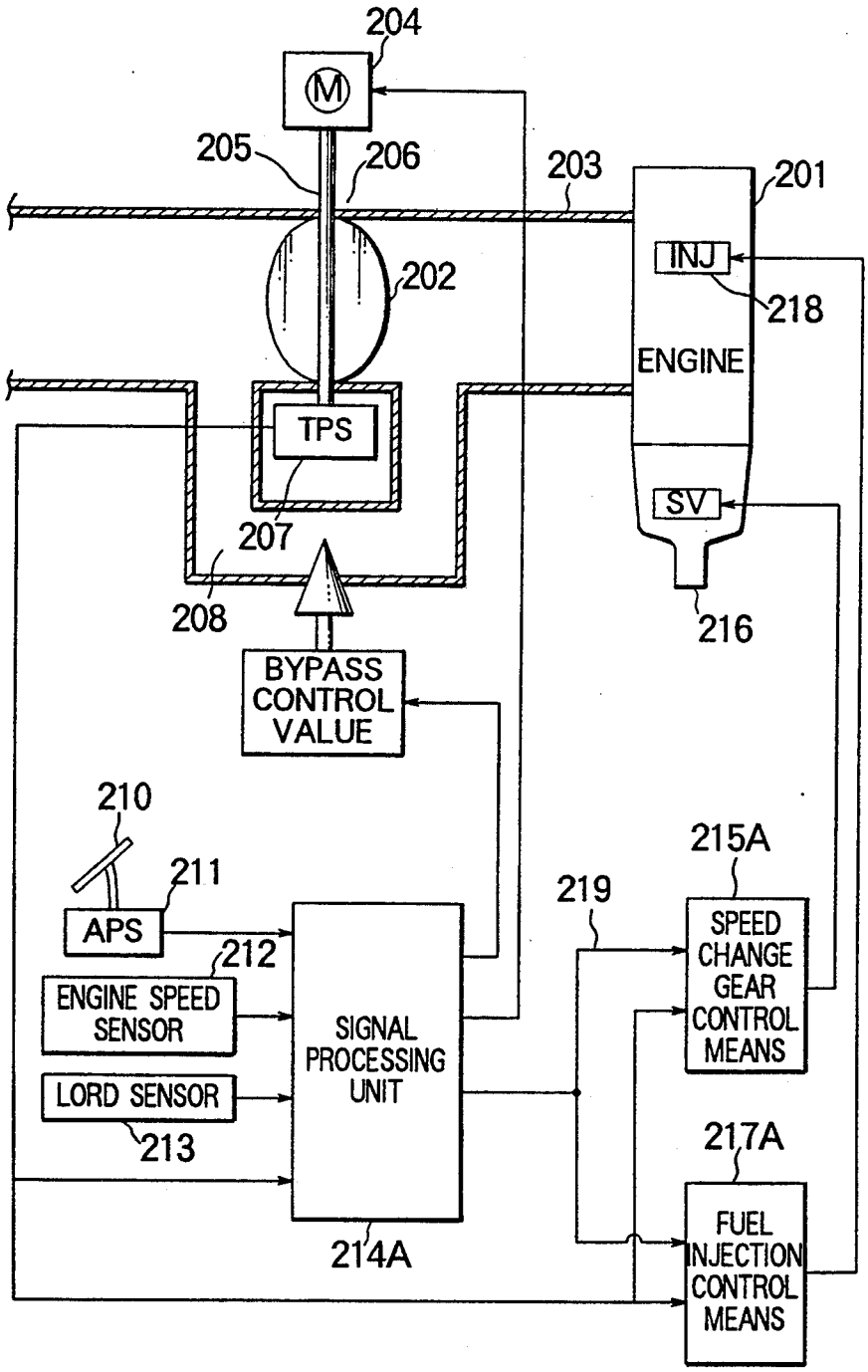
FIG. 21 is a schematic diagram showing a general arrangement of a control apparatus for an internal combustion engine according to an eighth embodiment incarnating the third aspect of the present invention.
Figure 32:
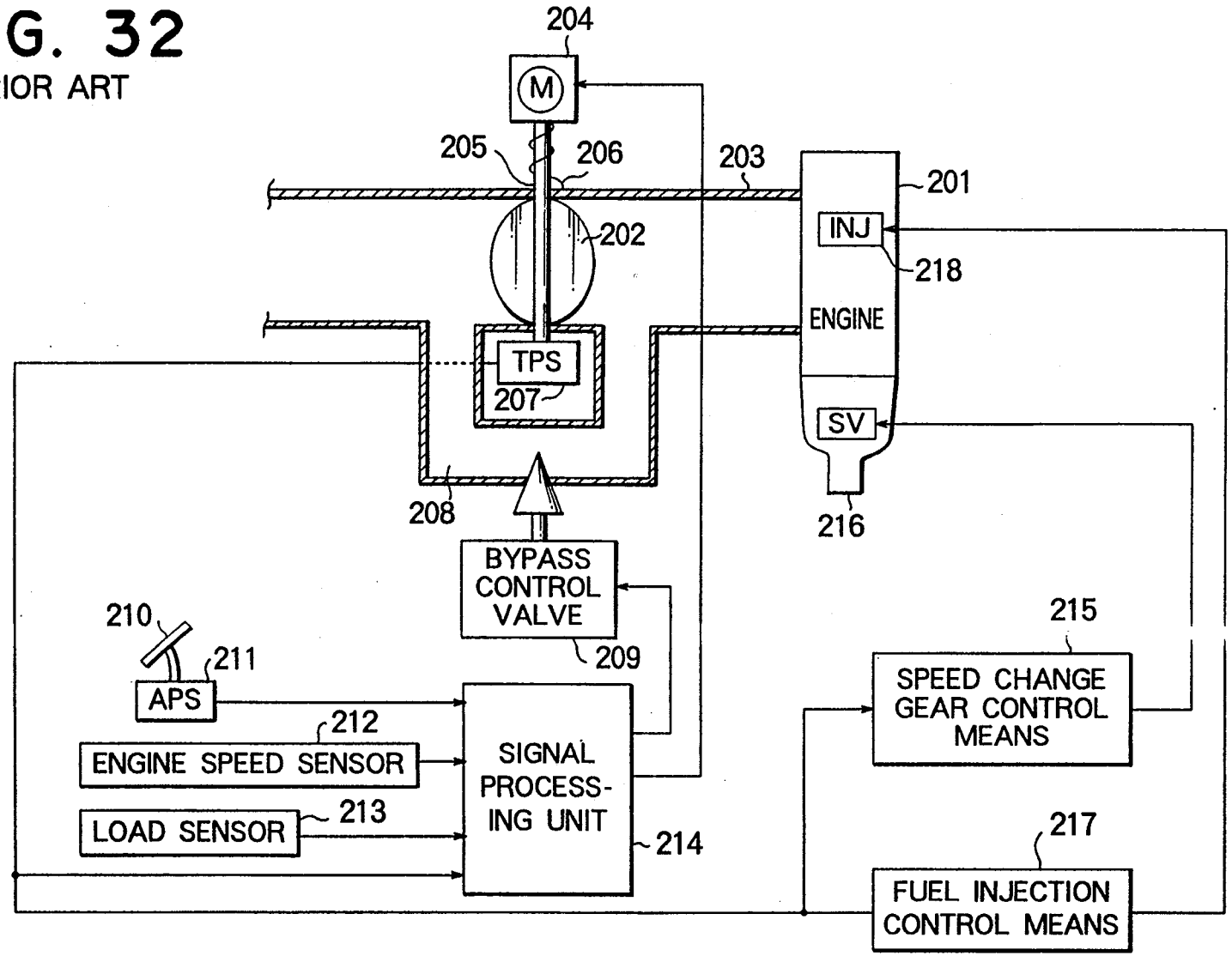
FIG. 32 PRIOR ART
FIG. 32 is a schematic block diagram showing an arrangement of another known intake air flow control apparatus for an internal combustion engine.
Figure 33:
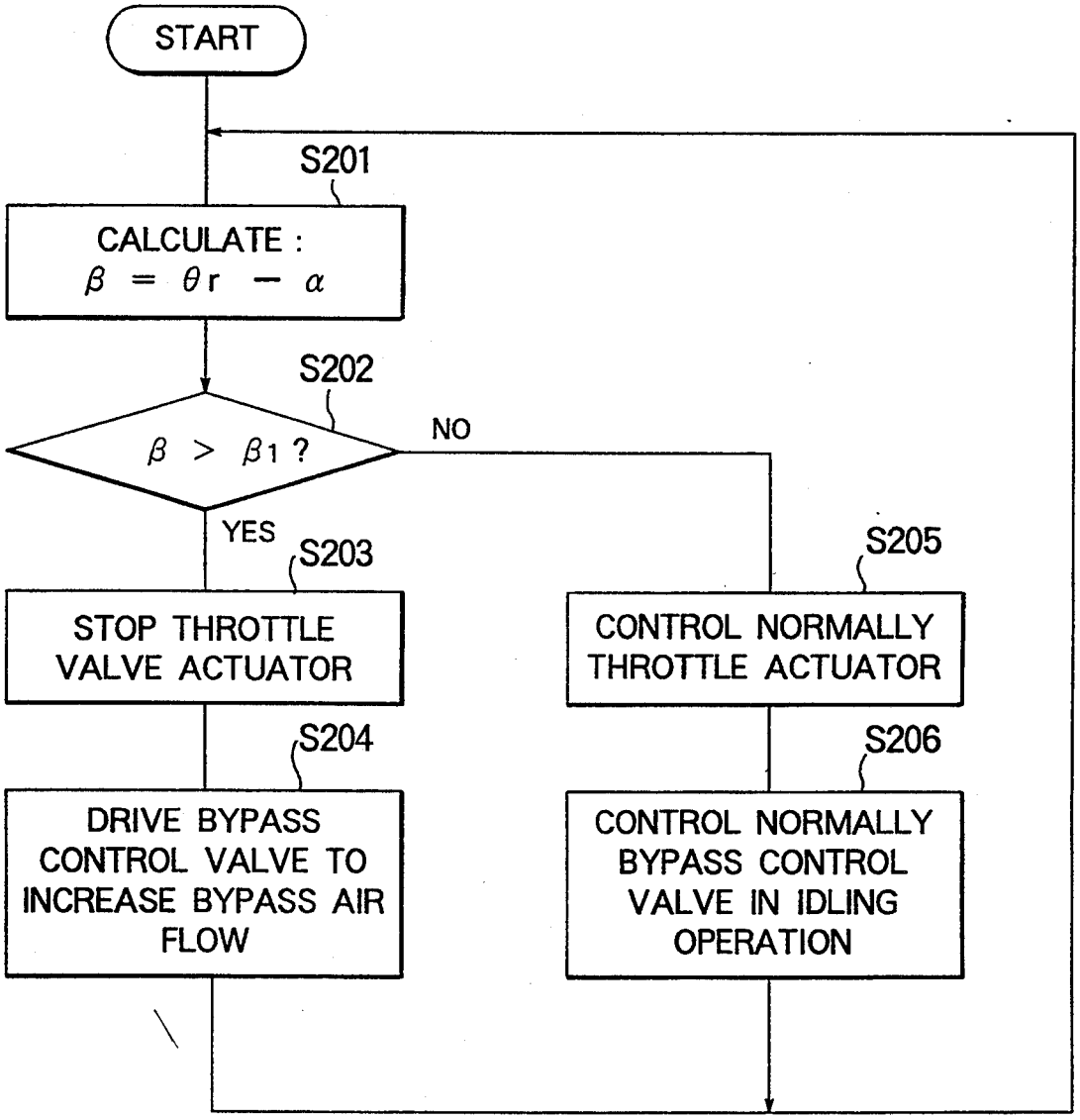
FIG. 33 PRIOR ART
FIG. 33 is a flow chart for illustrating a control procedure adopted in the apparatus shown in FIG. 32.

FIG. 21 is a schematic diagram showing a general arrangement of a control apparatus for an internal combustion engine according to an eighth embodiment of the invention incarnating the third aspect of the invention. In the figure, parts same as or equivalent to those described hereinbefore by referring to FIG. 32 are denoted by like reference characters, and repeated description thereof is omitted.

Referring to FIG. 21, the control apparatus includes a signal processing unit 214A which may be realized by using a conventional microcomputer and which serves as a first control means for controlling the throttle actuator 204 on the basis of the outputs of various sensors such as the throttle position sensor 207 serving as the second detecting means, the accelerator pedal depression stroke sensor 211 serving as the first detecting means, the engine speed sensor 212, the load sensor 213 and others on one hand and controlling on the other hand the transmission control means 215A and the fuel injection control means 217A on the basis of at least the output of the throttle position sensor 207 via the signal transmission means 219. Parenthetically, the transmission control means 215A and the fuel injection control means 217A cooperate to constitute the first control means, while the throttle valve 202 and the throttle actuator 204 constitute the first regulating means with the bypass passage 208, the bypass control valve (bypass throttle valve) 209 and a stepping motor (not shown) for driving them constituting the second control means.

As the signal transmission means 219, there may be employed, for example, a local area network (LAN).

In the normal operation state of the throttle control system, the transmission control means 215A performs the speed control of the automatic transmission 216 by utilizing at least the output of the throttle position sensor 207 as the engine torque information. However, when the throttle control system suffers trouble, the transmission control means 215A controls the automatic transmission 216 on the basis of the throttle opening information which is determined arithmetically from the opening degree of the bypass control valve 209 by the signal processing unit 214A, as described in detail hereinafter.

Similarly, the fuel injection control means 217A controls the fuel supply to the engine 201 by driving the fuel injector 218 at least on the basis of the output of the throttle position sensor 207 so long as the throttle control system operates normally. However, upon occurrence of trouble in the throttle control system or the throttle valve 202 itself, the fuel injection control means 217A drives the fuel injector 218 on the basis of the throttle opening degree arithmetically determined from the opening degree of the bypass throttle or control valve 209 by the signal processing unit 214A to thereby control correspondingly the fuel supply to the engine 201.

Figure 22:
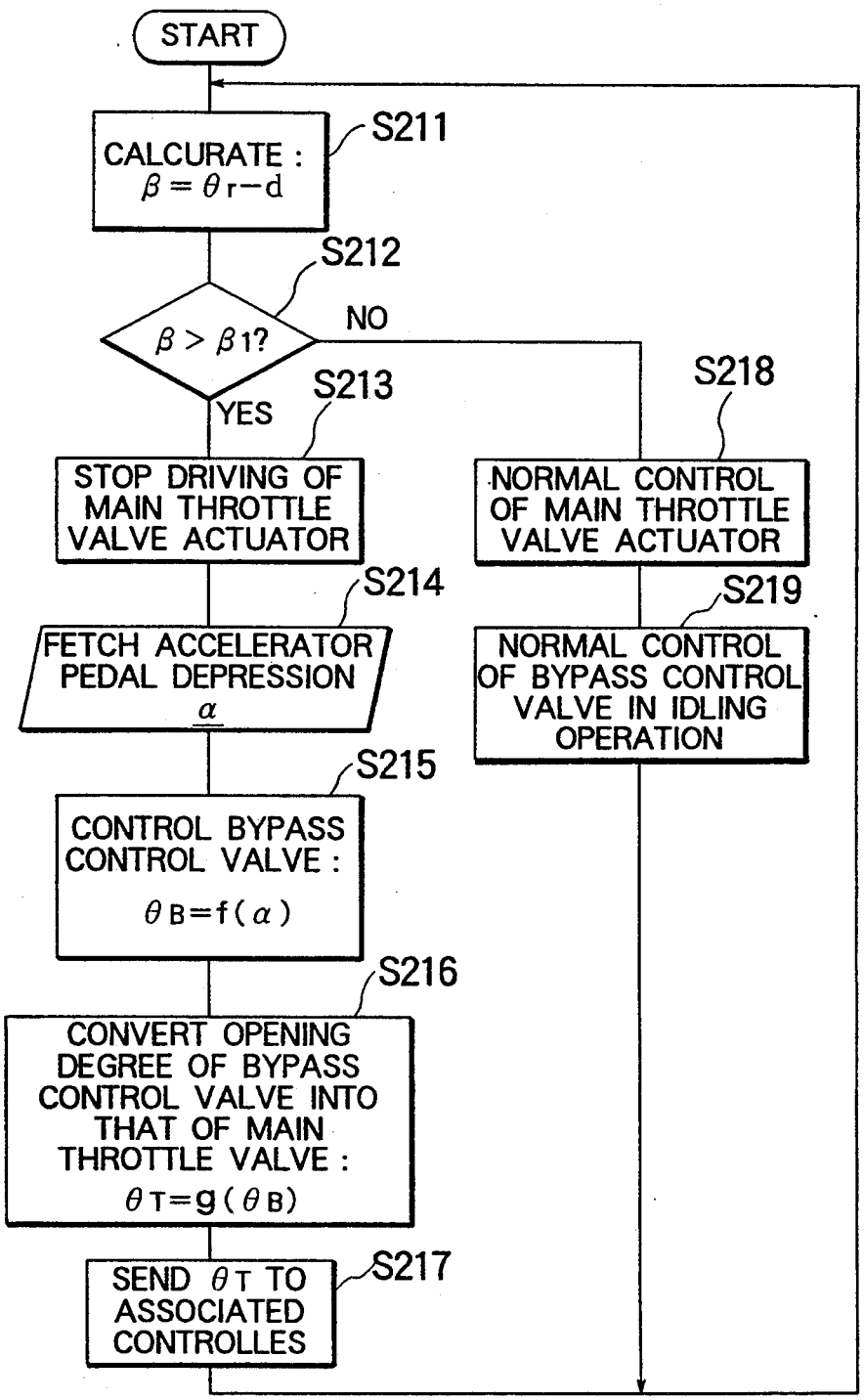
FIG. 22 is a flow chart for illustrating an operation of the control apparatus according to the eighth embodiment of the invention.

Next, description will turn to operation of the control apparatus by referring to a flow chart of FIG. 22. At this juncture, it should be mentioned that the arithmetic operations as well as the decision processings mentioned below are executed by the signal processing unit 214A.

First, in a step S211, the accelerator pedal stroke $\alpha$ and the actual throttle opening degree $\theta_r$ are fetched from the accelerator pedal depression stroke sensor 211 and the throttle position sensor 8, respectively, whereon the difference $\beta$ between-the accelerator pedal stroke $\alpha$ and the actual throttle opening degree $\theta_r$ is determined.

Subsequently, in a step S212, decision is made as to whether the difference $\beta$ is greater than a predetermined value $\beta_1$. If so (YES), it is then decided that the throttle control system inclusive of main throttle valve 202 suffers trouble, and the main throttle valve actuator 204 is deenergized in a step S21S. Consequently, the main throttle valve 202 is forcively positioned to a fully closed state under the influence of the return spring 206.

Figure 23:
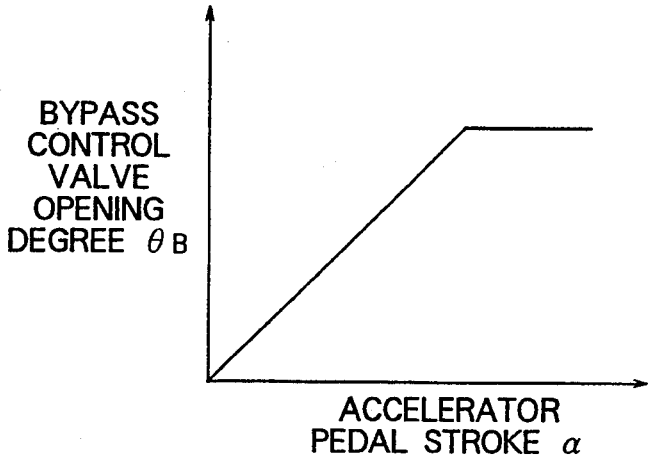
FIG. 23 is a diagram for illustrating a relation between a bypass control valve opening degree and an accelerator pedal stroke in the control apparatus according to the eighth embodiment of the invention.

In a step S214, the accelerator pedal stroke $\alpha$ is fetched from the accelerator pedal depression stroke sensor 211, which is then followed by a step S215 where the bypass control valve (bypass throttle valve 209 is controlled so that the bypass control valve opening degree $\theta_B$ thereof changes in dependence on the accelerator pedal stroke $\alpha$ in such a manner as illustrated characteristically in FIG. 23. Thus, it is possible to set rather arbitrarily the speed of the motor vehicle within a limited range.

In this conjunction, it should be added that the bypass control valve opening degree $\theta_s$ can be determined by the signal processing unit 214A on the basis of the number of stepping pulses applied to a stepping motor (not shown) for driving the bypass control valve 9.

Needless to say, when the throttle control system is normal, the operation of the bypass control valve 9 is controlled in dependent on the accelerator pedal depression as in the case of the idling operation. Further, in the backup or limp-homing operation, the throttle position sensor 207 outputs a signal indicating the fully-closed state of the main throttle valve 202. Consequently, control performances of the transmission control means 215A and the fuel injection control means 217A which performs the controls of the automatic transmission 216 and the fuel injector 218 by utilizing the output of the throttle position sensor 207 as the engine torque information in the normal state of the throttle control system is degraded when the throttle valve 202 continues to remain in the fully-closed state because of trouble, which ultimately results in degradation in the running performance of the motor vehicle in the backup operation mode, such as exemplified by non-smoothness of acceleration, uncontrollable increase of the engine speed upon change of gear ratio and other.

Figure 24:
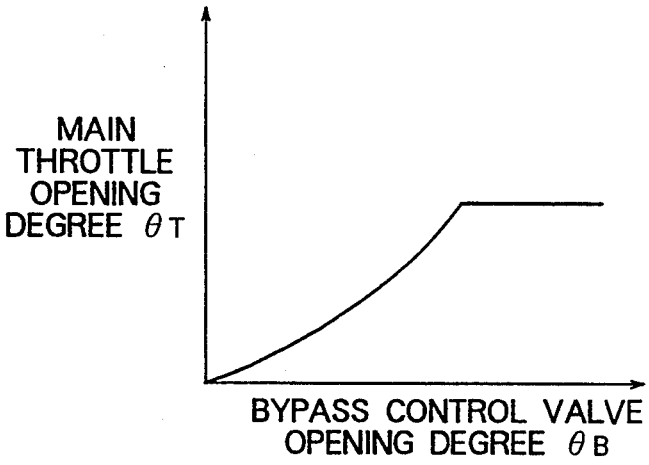
FIG. 24 is a diagram for illustrating a relation between a bypass control valve opening degree and a throttle opening degree in the control apparatus according to the eighth embodiment.

With the instant embodiment of the invention, it is contemplated to mitigate the undesirable situations mentioned above. Accordingly, in a step S216, the opening degree $\theta_B$ of the bypass control valve device 207 is converted into the main throttle opening degree $\theta_T$. In this conjunction, it is noted that the bypass control valve opening degree $\theta_B$ and the main throttle opening degree $\theta_T$ is in such a relation as illustrated in FIG. 24. More specifically, this figure shows a relation between the bypass control valve opening degree $\theta_B$ and the main throttle opening degree $\theta_T$ on the assumption that the air flow rate to be controlled by the main throttle valve 202 in the normal state of the control system thereof is equal to the flow rate of the bypass intake air flow to be fed to the engine through the bypass control valve 9.

Subsequently, in a step S217, the information obtained from the conversion of the opening degree $\theta_B$ of the bypass control valve to that ($\theta_T$) of the main throttle valve 202 in the step S216 and the abnormality decision signal are transmitted to the transmission control means 215A and the fuel injection control means 217A via the signal transmission means 219. In response, the transmission control means 215A and the fuel injection control means 217A change the throttle opening information derived from the output of the throttle position sensor 207 to the information indicative of the throttle opening degree $\theta_T$ supplied from the signal processing unit 214A to thereby control the automatic transmission 216 and the fuel injector 218 on the basis of this information. In this manner, the backup (limp-homing) operation of the motor vehicle can be assured without being accompanied with uncomfortable events mentioned previously.

On the other hand, when it is found in the step S212 that the difference $\beta$ is smaller than the predetermined value $\beta_1$, i.e., that the throttle control system is normal, the throttle actuator 204 is controlled in dependence on the depression depth of the accelerator pedal 210 and other information, as occasion requires, to thereby control correspondingly the position of the throttle valve 202 (step S218). In this normal state, the idling speed of the engine is controlled by means of the bypass control valve device 209.

Embodiment 9

In the case of the eighth embodiment, the engine torque information in the backup operation of the motor vehicle is obtained by converting the opening degree of the bypass control valve 209 to that of the throttle valve 202 in the signal processing unit 214A. It should however be appreciated that the information concerning the opening degree of the bypass control valve 209 may be sent intact to the transmission control means 215A and the fuel injection control means 217A via the signal transmission means 219. In this case, the transmission control means 215A and the fuel injection control means 217A respond to the abnormality decision signal supplied together with the bypass control valve opening information to thereby determine arithmetically or calculate the opening degree of the throttle valve 202 which corresponds to that of the bypass control valve 209, for driving the automatic transmission 216 and the fuel injector 218 on the basis of the control quantities determined by the transmission control means 215A and the fuel injection control means 217A themselves.

MODIFICATIONS OF THE EMBODIMENTS

Many features and advantages of the present invention are apparent from the detailed description and thus it is intended by the appended claims to cover all such features and advantages of the system which fall within the true spirit and scope of the invention. Further, since numerous modifications and changes will readily occur to those skilled in the art, it is not desired to limit the invention to the exact construction and operation illustrated and described.

By way of example, in the foregoing description made in conjunction with the first to sixth embodiment, it has been assumed that a pair of bypass passages 2 and 20 are disposed. It should however be understood that a given numbers of bypass passages each equipped with a bypass throttle valve can be arranged in parallel with one another and to the main intake air passage 1.

Further, although it has been described that the first bypass throttle valve **21*a* and the second bypass throttle valve 22*a* constituting the bypass air flow control means are controlled in dependence on the accelerator pedal depression stroke D, they may be controlled in accordance with a target air flow rate obtained by processing the signal indicative of the accelerator pedal depression stroke D. By way of example, the first bypass throttle valve 21*a* or the second bypass throttle valve 22*a* may be controlled when the target air low rate mentioned above exceeds a predetermined value. More specifically, the target air flow rate or target opening areas of the first bypass passage 2 and the second bypass passage 20 may be calculated on the basis of parameters such as the accelerator pedal depression stroke D, the cooling water temperature T, the intake air temperature, the atmospheric pressure and/or the rotation speed (rpm) of the engine, whereby the first bypass throttle device 21 and the second bypass throttle device 22** may be controlled in dependence on the value obtained by the calculation.

In the various embodiments described hereinbefore, the throttle valve **11*a* and 12*a* as well as the bypass throttle valves 21*a* and 22*a*** need not be fully closed. What is necessary is that they can be controlled in the direction to close or constrict the associated bypass air flow passages.

Further, the foregoing description has been made by taking as example the acceleration mode in which the accelerator pedal depression stroke D is increased as a function of time lapse. It should however be understood that the concept underlying the invention is equally applicable to operation of the deceleration mode in which the accelerator pedal depression stroke D is so controlled as to decrease as a function of time lapse, substantially to the same effect.

Furthermore, although it has been described that the power-on of the air-conditioner load 6 is inhibited by the control unit 7A or 7B in response to the abnormality decision signal, it goes without saying that this function can of course be spared in the motor vehicle which is not equipped with the air conditioner.

As the closing control means for forcibly closing the main air flow control means (the main throttle device), the return spring **10*a* is used in combination with the solenoid valve 12*b*, the rod 12B and the suspension spring 10*b* (refer to FIG. 6). However, it goes without saying that such arrangement may be adopted in which the main air flow control means is closed straightforwardly by using an electromagnetic solenoid. Further, in case the throttle valve 12*a*** serving as the main air flow control means is constituted by a linear solenoid valve or the like which operates normally and thus can be closed by the control signal, the forcibly closing means can be spared.

Further, although the LAN is used as the signal transmission means 19 in conjunction with the embodiments 8 and 9, it goes without saying that the invention is never limited thereto. Any appropriate signal transmission means designed for transmitting an analogue signal or serial signal may be used to this end.

Accordingly, all suitable modifications and equivalents may be resorted to, falling within the scope of the invention.

We claim:

1. An apparatus for controlling intake air flow fed to an internal combustion engine for a motor vehicle, comprising:

main intake air passage means for supplying air to said engine;

main intake air flow control means disposed in association with said main intake air passage means for controlling flow rate of the intake air fed to said engine through said main intake air passage means in accordance with magnitude of actuation of accelerator means of said motor vehicle;

a plurality of bypass passages disposed in parallel with said main intake air passage for allowing the intake air to be fed to said engine by bypassing said main intake air flow control means;

a plurality of bypass air flow control means provided in association with said plurality of bypass passages, respectively;

diagnosis means for diagnosing said main intake air flow control means as to occurrence of abnormality therein; and control means responsive to an abnormality decision signal issued by said diagnosis means upon detection of abnormality in said main intake air flow control means to thereby close said main intake air flow control means while allowing said bypass air flow control means to control the intake air flowing through said bypass passages in accordance with magnitude of actuation of said accelerator means.

2. An intake air flow control apparatus for an internal combustion engine according to claim 1, wherein said diagnosis means compares an actual throttle opening degree of a throttle valve constituting a part of said main intake air flow control means with a target throttle opening degree determined arithmetically by said control means on the basis of magnitude of the actuation of said accelerator means in consideration of parameters indicating operation state of said engine and issues said abnormality signal when difference between said actual throttle opening degree and said target opening degree continues to be greater than a predetermined value for a predetermined time.

3. An intake air flow control apparatus for an internal combustion engine according to claim 1, further comprising:

closing control means for causing said main intake air flow control means to close forcively said main intake air passage in response to an activation command issued by said control means in response to said abnormality decision signal generated by said diagnosis means.

4. An intake air flow control apparatus for an internal combustion engine according to claim 3, said close control means includes electromagnetic actuator means controlled by said control means;

said main intake air flow control means including a throttle valve disposed rotatably within said main intake air passage means and mechanically coupled to said electromagnetic actuator means through electromagnetic coupling means, said throttle valve being resiliently urged constantly to a close position under influence of a return spring against effort exerted by said electromagnetic actuator means;

wherein upon detection of occurrence of abnormality in said main intake air flow control means, said electromagnetic coupling is deenergized so that said throttle valve is forcively set to the close state for closing substantially fully said main intake air flow passage under the influence of said return spring.

5. An intake air flow control apparatus for an internal combustion engine according to claim 1, wherein at least one of said plurality of bypass air flow control means includes an on/off-solenoid valve means which is switchable between first position where the associated bypass passage is fully opened and a second position where said associated bypass passage is fully closed.

6. An intake air flow control apparatus for an internal combustion engine according to claim 1, wherein at least two of said plurality of bypass air flow control means are constituted by first and second on/off-solenoid valve means each of which is switchable between a first position where the associated bypass passage is fully opened and a second position where said associated bypass passage is fully closed; and wherein upon issuance of said abnormality signal, said first on/off solenoid valve is first opened and subsequently said second on/off solenoid valve is opened at a predetermined magnitude of actuation of said accelerator means in addition to said first on/off solenoid valve.

7. An intake air flow control apparatus for an internal combustion engine according to claim 1, wherein at least one of said plurality of bypass air flow control means includes valve means adapted to move continuously between a first position where the associated bypass passage is substantially fully opened and a second position where said associated bypass passage is substantially fully closed;

said control means controlling said continuously controllable valve means through a feedback loop so that rotation speed (rpm) of said internal combustion engine in an idling operation mode assumes a target value determined arithmetically for said idling operation so long as said abnormality decision signal is absent.

8. An intake air flow control apparatus for an internal combustion engine according to claim 7, wherein said control means responds to generation of said abnormality decision signal for thereby controlling said continuously controllable valve means through a feedback loop so that the opening degree of said continuously controllable valve changes in accordance with magnitude of actuation of said accelerator means.

9. An intake air flow control apparatus for an internal combustion engine according to claim 8, wherein said control means responds to generation of said abnormality decision signal for thereby controlling opening degree of said continuously controllable valve so that rate of air flow in said associated bypass passage means is high when temperature of said internal combustion engine is low.

10. An intake air flow control apparatus for an internal combustion engine according to claim 1, wherein at least two of said plurality of bypass air flow control means includes:

a continuously controllable valve means which can continuously be actuated between a first position where the associated bypass passage is substantially fully opened and a second position where said associated bypass passage is substantially fully closed, and an on/off-solenoid valve which is switchable between a first position where the associated bypass passage is substantially fully opened and a second position where said associated bypass passage is substantially fully closed;

wherein upon issuance of said abnormality signal, said continuously controllable valve is first opened and subsequently said on/off solenoid valve is additionally opened at a predetermined magnitude of actuation of said accelerator means.

11. An intake air flow control apparatus for an internal combustion engine according to claim 1, wherein said control means responds to generation of said abnormality decision signal to thereby inhibit power supply to a load of said engine.

12. An intake air flow control apparatus for an internal combustion engine according to claim 1, wherein at least one of said plurality of bypass air flow control means includes on/off-solenoid valve means and at least another one of said plural bypass air flow control means includes valve means controlled continuously;

said control means responding to generation of said abnormality decision signal for controlling the air supply through said on/off solenoid valve means when the magnitude of actuation of said accelerator means is smaller than a predetermined value, and when the magnitude of actuation of said accelerator means exceeds a predetermined value, said continuously control valve means is additionally operated for controlling said air supply in cooperation with said on/off solenoid valve.

13. An intake air flow control apparatus for an internal combustion engine according to claim 1, wherein said plurality of air flow control means includes at least two on/off-solenoid valve means which differ from one another in respect to the air flow rate which said two on/off-solenoid valve means can control;

said control means responding to generation of said abnormality decision signal for thereby controlling said two on/off-solenoid valve means sequentially so that said air flow is controlled stepwise.

14. An intake air flow control apparatus for an internal combustion engine according to claim 1, wherein said control means controls said plurality of bypass air flow control means with delay times corresponding to delays involved in activation of said plural bypass air flow control means.

15. An apparatus for controlling intake air flow fed to an internal combustion engine for a motor vehicle, comprising:

main intake air passage means for supplying intake air to said engine;

first main intake air flow control means disposed in association with said main intake air passage means for controlling flow rate of the intake air fed to said engine through said main intake air passage means in accordance with magnitude of actuation of accelerator means of said motor vehicle;

second main intake air flow control means disposed in association with said main intake air passage means in series to said first main intake air flow control means;

a plurality of bypass passages disposed in parallel with said main intake air passage for allowing the intake air to be fed to said engine by bypassing said first and second main intake air flow control means;

a plurality of bypass air flow control means provided in association with said plurality of bypass passages, respectively;

diagnosis means for diagnosing said first main intake air flow control means as to occurrence of abnormality therein; and control means responsive to an abnormality decision signal issued by said diagnosis means upon detection of abnormality in said first intake air flow control means to thereby close said second main intake air flow control means allow said bypass air flow control means to control the intake air flowing through said bypass passages in accordance with magnitude of actuation of said accelerator means.

16. An intake air flow control apparatus for an internal combustion engine according to claim 15, wherein said diagnosis means compares an actual throttle opening degree of a throttle valve constituting a part of said first main intake air flow control means with a target throttle opening degree determined arithmetically by said control means on the basis of the magnitude of actuation of said accelerator means in consideration of parameters indicating operation state of said engine and issues said abnormality signal when difference between said actual throttle opening degree and said target opening degree continues to be greater than a predetermined value for a predetermined time.

17. An intake air flow control apparatus for an internal combustion engine according to claim 15, further comprising:

closing control means for causing said second main intake air flow control means to close forcively said main intake air passage in response to an activation command issued by said control means in response to said abnormality decision signal generated by said diagnosis means.

18. An intake air flow control apparatus for an internal combustion engine according to claim 17, said first main intake air flow control means including a first throttle valve disposed within said main intake air passage;

said close control means including electromagnetic actuator means provided in association with said second main intake air flow control means controlled by said control means;

said second main intake air flow control means including a throttle valve disposed rotatably within said main intake air passage means at a position downstream of said first main intake air flow control means and mechanically coupled to said electromagnetic actuator means, said second throttle valve being resiliently urged toward a close position under influence of a return spring;

wherein upon detection of occurrence of abnormality in said first main intake air flow control means, said electromagnetic actuator means is deenergized so that said second throttle valve is forcively set to the close state for closing substantially fully said main intake air flow passage under the influence of said return spring.

19. An intake air flow control apparatus for an internal combustion engine according to claim 15, wherein at least one of said plurality of bypass air flow control means includes an on/off-solenoid valve means which is switchable between first position where the associated bypass passage is fully opened and a second position where said associated bypass passage is fully closed.

20. An intake air flow control apparatus for an internal combustion engine according to claim 15, wherein at least two of said plurality of bypass air flow control means are constituted by first and second on/off-solenoid valve means each of which is switchable between a first position where the associated bypass passage is fully opened and a second position where said associated bypass passage is fully closed; and wherein upon issuance of said abnormality signal, said first on/off solenoid valve is first opened and subsequently said second on/off solenoid valve is opened at a predetermined magnitude of actuation of said accelerator means in addition to said first on/off solenoid valve.

21. An intake air flow control apparatus for an internal combustion engine according to claim 15, wherein at least one of said plurality of bypass air flow control means includes valve means adapted to move continuously between a first position where the associated bypass passage is substantially fully opened and a second position where said associated bypass passage is substantially fully closed;

said control means controlling said continuously controllable valve means through a feedback loop so that rotation speed (rpm) of said internal combustion engine in an idling operation mode assumes a target value determined arithmetically for said idling operation so long as said abnormality decision signal is absent.

22. An intake air flow control apparatus for an internal combustion engine according to claim 21, wherein said control means responds to generation of said abnormality decision signal for thereby controlling said continuously controllable valve means through a feedback loop so that the opening degree of said continuously controllable valve changes in accordance with magnitude of actuation of said accelerator means.

23. An intake air flow control apparatus for an internal combustion engine according to claim 22, wherein said control means responds to generation of said abnormality decision signal for thereby controlling opening degree of said continuously controllable valve so that rate of air flow in said associated bypass passage means is high when temperature of said internal combustion engine is low.

24. An intake air flow control apparatus for an internal combustion engine according to claim 15, wherein at least two of said plurality of bypass air flow control means includes:

a continuously controllable valve means which can continuously be actuated between a first position where the associated bypass passage is substantially fully opened and a second position where said associated bypass passage is substantially fully closed, and an on/off-solenoid valve which is switchable between a first position where the associated bypass passage is substantially fully opened and a second position where said associated bypass passage is substantially fully closed;

wherein upon issuance of said abnormality signal, said continuously controllable valve is first opened and subsequently said on/off solenoid valve is additionally opened at a predetermined magnitude of actuation of said accelerator means.

25. An intake air flow control apparatus for an internal combustion engine according to claim 15, wherein said control means responds to generation of said abnormality decision signal to thereby inhibit power supply to a load of said engine.

26. An intake air flow control apparatus for an internal combustion engine according to claim 15, wherein at least one of said plurality of bypass air flow control means includes on/off-solenoid valve means and at least another one of said plural bypass air flow control means includes valve means controlled continuously;

said control means responding to generation of said abnormality decision signal for controlling the air supply through said on/off solenoid valve means when the magnitude of actuation of said accelerator means is smaller than a predetermined value, and when the magnitude of actuation of said accelerator means exceeds a predetermined value, said continuously control valve means is additionally operated for controlling said air supply in cooperation with said on/off solenoid valve.

27. An intake air flow control apparatus for an internal combustion engine according to claim 15, wherein said plurality of air flow control means includes at least two on/off-solenoid valve means which differ from one another in respect to the air flow rate which said two on/off-solenoid valve means can control;

said control means responding to generation of said abnormality decision signal for thereby controlling said two on/off-solenoid valve means sequentially so that said air flow is controlled stepwise.

28. An intake air flow control apparatus for an internal combustion engine according to claim 15, wherein said control means controls said plurality of bypass air flow control means with delay times corresponding to delays involved in activation of said plural bypass air flow control means.

29. In an internal combustion engine for a motor vehicle, including:

main intake air flow control means for controlling an intake air flow fed to said engine;

abnormality detecting means for detecting occurrence of abnormality in said main intake air flow control means;

auxiliary intake air flow control means for controlling said intake air flow in place of said main intake air flow control means;

means for detecting rotation speed of said engine;

intake air flow rate detecting means for detecting flow rate of said intake air; and fuel injection control means for controlling fuel injection to said engine in dependence on at least said engine rotation speed and said intake air flow rate, a control method, comprising the step of:

responding to detection of said abnormality for thereby actuating said auxiliary intake air flow control means and changing a range of engine operation from a normal operation range set for a normal state in which the intake air flow is controlled by said main intake air flow control means.

30. A control method according to claim 29, said engine operation region being defined as a range of fuel injection determined in correspondence to said engine rotation speed, wherein said fuel injection range is narrowed for operation of said motor vehicle upon occurrence of said abnormality as compared with that set for the normal state of engine operation.

31. A control method according to claim 29, wherein said fuel injection is stopped when operation of said engine departs from said operation range set for the abnormal state.

32. A control apparatus for an internal combustion engine of a motor vehicle comprising:

main intake air flow control means for controlling an intake air flow supplied to said engine;

abnormality detecting means for detecting occurrence of abnormality at least in one of said main intake air flow control means and devices provided in association therewith;

auxiliary intake air flow control means responsive to detection of said abnormality for thereby controlling said intake air flow in place of said main intake air flow control means;

engine speed detecting means for detecting rotation speed of said engine;

intake air flow rate detecting means for detecting flow rate of said intake air;

fuel injection control means for controlling an amount of fuel injected to said engine in dependence on at least said intake air flow rate and said engine rotation speed; and operation range switching means responsive to detection of said abnormality for thereby actuating said auxiliary intake air flow control means and changing a range of engine operation from a normal operation range set for a normal state in which the intake air flow is controlled by said main intake air flow control means.

33. A control apparatus according to claim 32, said engine operation region being defined as a range of fuel injection determined in correspondence to said engine rotation speed, wherein said fuel injection range is narrowed for operation of said motor vehicle upon occurrence of said abnormality as compared with that set for the normal state of engine operation.

34. A control apparatus according to claim 32, wherein said fuel injection is stopped when operation of said engine departs from said operation range set for the abnormal state.

35. A method of controlling operation of an internal combustion engine for a motor vehicle, comprising the steps of:

detecting magnitude of actuation of an accelerator pedal;

detecting an opening degree of a throttle valve disposed in an intake pipe of said engine;

controlling an intake air flow supplied to said engine by controlling said throttle valve on the basis of said magnitude of actuation of said accelerator pedal and said throttle valve opening degree as detected;

detecting whether abnormality occurs in devices employed for the control of said throttle valve;

responding to detection of said abnormality for thereby controlling an valve opening degree of auxiliary intake air flow control means which allows said intake air flow to bypass said throttle valve in dependence on said magnitude of actuation of said accelerator pedal;

detecting a rotation speed of said engine;

controlling an amount of fuel to be injected to said engine on the basis of at least said engine rotation speed and said intake air flow; and responding to detection of said abnormality for thereby changing a range of engine operation from a normal operation range set for a normal state in which the intake air flow is controlled by said main intake air flow control means.

36. An apparatus for controlling operation of an internal combustion engine for a motor vehicle, comprising:

accelerator pedal actuation detecting means for detecting magnitude of actuation of an accelerator pedal;

throttle valve position detecting means for detecting an opening degree of a throttle valve disposed in an intake pipe of said engine;

throttle valve control means for controlling an intake air flow supplied to said engine by driving said throttle valve in dependence on said magnitude of actuation of said accelerator pedal and said throttle valve opening degree as detected;

abnormality detecting means for detecting whether abnormality occurs in devices provided in association with the control of said throttle valve;

control means responsive to detection of said abnormality outputted from said abnormality detecting means for controlling an valve opening degree of auxiliary intake air flow control means which allows said intake air flow to bypass said throttle valve in dependence on said magnitude of actuation of said accelerator pedal;

engine speed detecting means for detecting a rotation speed of said engine;

fuel injection control means for controlling an amount of fuel to be injected to said engine in dependence on at least said engine rotation speed and said intake air flow; and operation range switching means operatively coupled to said abnormality detecting means and said fuel injection control means for responding to detection of said abnormality by changing a range of fuel injection from a normal fuel injection range set for a normal state in which the intake air flow is controlled by said main intake air flow control means.

37. A control apparatus according to claim 36, said engine operation region being defined as a range of fuel injection determined in correspondence to said engine rotation speed, wherein said fuel injection range is narrowed for operation of said motor vehicle in the state where said abnormality in taking place when compared with the fuel injection range set for the normal state of engine operation.

38. A control apparatus according to claim 36, wherein said fuel injection is stopped when operation of said engine departs from said operation range set for the abnormal state.

39. A control apparatus for an internal combustion engine of a motor vehicle, comprising:

first detecting means for determining a throttle opening corresponding to magnitude of actuation of accelerator means;

first regulating means for regulating an intake air flow supplied to said engine by means of a throttle valve;

second detecting means for detecting an actual opening degree of said throttle valve;

second regulating means for regulating an auxiliary intake air flow charged to said engine in an idling operation thereof by means of auxiliary valve means;

first control means for controlling said first and second regulating means on the basis of outputs of said first and second detecting means, respectively; and second control means for controlling a speed of said motor vehicle and an amount of air flow injected to said engine on the basis of the output of said second detecting means;

wherein upon occurrence of abnormality in said first regulating means, said first control means controls said second regulating means on the basis of the output of said first detecting means and converts an opening degree of said auxiliary valve means as determined arithmetically on the basis of a driving force required for driving said auxiliary valve means into a corresponding opening degree of said throttle valve; and wherein said second control means controls the speed of said motor vehicle and a fuel supply to said engine on the basis of said converted opening degree supplied from said first control means in place of the output of said second detecting means.

40. A control apparatus for an internal combustion engine of a motor vehicle, comprising:

first detecting means for determining a throttle opening corresponding to magnitude of actuation of accelerator means;

first regulating means for regulating an intake air flow supplied to said engine by means of a throttle valve;

second detecting means for detecting an actual opening degree of said throttle valve;

second regulating means for regulating an auxiliary intake air flow charged to said engine in an idling operation thereof by means of auxiliary valve means;

first control means for controlling said first and second regulating means on the basis of outputs of said first and second detecting means, respectively;

second control means for controlling a speed of said motor vehicle and an amount of air flow injected to said engine on the basis of the output of said second detecting means; and signal transmission means for transferring signals between said first and second control means;

wherein upon occurrence of abnormality in said first regulating means, said first control means controls said second regulating means on the basis of the output of said first detecting means, determines arithmetically an opening degree of said auxiliary valve means on the basis of a driving force required for driving said auxiliary valve means, and sends a signal indicative of said arithmetically determined opening degree to said second control means through said signal transmission means; and wherein said second control means converts said arithmetically determined opening degree of said auxiliary valve means sent from said first control means into a corresponding opening degree of said throttle valve and controls the speed of said motor vehicle and a fuel supply to said engine on the basis of said converted opening degree in place of the output of said second detecting means.

41. An apparatus for controlling intake air flow fed to an internal combustion engine for a motor vehicle, comprising:

main intake air passage means for supplying air to said engine;

main intake air flow control means disposed in association with said main intake air passage means for controlling flow rate of the intake air fed to said engine through said main intake air passage means in dependence on magnitude of actuation of accelerator means of said motor vehicle;

a plurality of bypass passages disposed in parallel with said main intake air passage for allowing the intake air to be fed to said engine by bypassing said main intake air flow control means;

a plurality of bypass air flow control means provided in association with said plurality of bypass passages, respectively;

diagnosis means for diagnosing said main intake air flow control means as to occurrence of abnormality therein;

control means responsive to an abnormality decision signal issued by said diagnosis means upon detection of abnormality in said main intake air flow control means to thereby close said main intake air flow control means while allowing said bypass air flow control means to control the intake air flowing through said bypass passages in dependence on magnitude of actuation of said accelerator means; and operation range switching means responsive to detection of said abnormality for thereby shifting a range of engine operation from a normal operation range set for a normal state in which the intake air flow is controlled by said main intake air flow control means.

42. An apparatus for controlling intake air flow fed to an internal combustion engine for a motor vehicle, comprising:

main intake air passage means for supplying air to said engine;

main intake air flow control means including a throttle valve disposed in assoGiation with said main intake air passage means for controlling flow rate of the intake air fed to said engine through said main intake air passage means in dependence on magnitude of actuation of accelerator means of said motor vehicle;

a plurality of bypass passages disposed in parallel with said main intake air passage for allowing the intake air to be fed to said engine by bypassing said main intake air flow control means;

a plurality of bypass air flow control means provided in association with said plurality of bypass passages and including bypass valve means, respectively;

first detecting means for determining an opening degree of said throttle valve on the basis of magnitude of actuation of said accelerator means;

second detecting means for detecting an actual opening degree of said throttle valve;

first control means for controlling said main intake air flow control means on the basis of outputs of said first and second detecting means, respectively;

second control means for controlling a speed of said motor vehicle and an amount of air flow injected to said engine on the basis of the output of said second detecting means;

diagnosis means for diagnosing said main intake air flow control means as to occurrence of abnormality therein; and third control means responsive to an abnormality decision signal issued by said diagnosis means upon detection of abnormality in said main intake air flow control means to thereby close said main intake air flow control means while allowing said bypass air flow control means to control the intake air flowing through said bypass passages in accordance with magnitude of actuation of said accelerator means;

wherein upon occurrence of said abnormality, said first control means controls said bypass air flow control means on the basis of the output of said first detecting means and converts an opening degree of said bypass valve means as determined arithmetically on the basis of a driving force required for driving said bypass valve means into a corresponding opening degree of said throttle valve; and wherein said second control means controls the speed of said motor vehicle and a fuel supply to said engine on the basis of said converted opening degree supplied from said first control means in place of the output of said second detecting means.

* * * * *